US007609993B2

(12) United States Patent
Maeda et al.

(10) Patent No.: US 7,609,993 B2
(45) Date of Patent: Oct. 27, 2009

(54) IMAGE FORMING APPARATUS THAT PREVENTS DEVELOPER FROM SPILLING

(75) Inventors: Masahiro Maeda, Shiojiri (JP); Yoichi Yamada, Shiojiri (JP); Mamoru Mizunokura, Nagano (JP); Takatomo Fukumoto, Shiojiri (JP); Fuyuto Yamashita, Iwata (JP)

(73) Assignee: Seiko Epson Corporation, Tokyo (JP)

( * ) Notice: Subject to any disclaimer, the term of this patent is extended or adjusted under 35 U.S.C. 154(b) by 449 days.

(21) Appl. No.: 11/537,917

(22) Filed: Oct. 2, 2006

(65) Prior Publication Data

US 2007/0189802 A1 Aug. 16, 2007

(30) Foreign Application Priority Data

| | | |
|---|---|---|
| Sep. 30, 2005 | (JP) | 2005-289342 |
| Sep. 30, 2005 | (JP) | 2005-289343 |
| Sep. 30, 2005 | (JP) | 2005-289344 |
| Sep. 30, 2005 | (JP) | 2005-289345 |
| Sep. 30, 2005 | (JP) | 2005-289346 |
| Sep. 30, 2005 | (JP) | 2005-289347 |
| Sep. 30, 2005 | (JP) | 2005-289348 |
| Sep. 30, 2005 | (JP) | 2005-289349 |
| Sep. 30, 2005 | (JP) | 2005-289350 |

(51) Int. Cl.
*G03G 15/16* (2006.01)
*G03G 21/00* (2006.01)

(52) U.S. Cl. ..... 399/101; 399/345; 399/350

(58) Field of Classification Search ..... 399/92, 399/93, 101, 345, 350, 351, 102
See application file for complete search history.

(56) References Cited

U.S. PATENT DOCUMENTS

| | | | | |
|---|---|---|---|---|
| 5,612,775 | A * | 3/1997 | Nagaoka | 399/345 |
| 7,139,502 | B2 * | 11/2006 | Koishi et al. | 399/93 |
| 7,190,919 | B2 * | 3/2007 | Kitagawa | 399/101 |
| 2004/0141780 | A1 * | 7/2004 | Osawa | 399/350 |
| 2005/0196205 | A1 * | 9/2005 | Osawa | 399/345 |

FOREIGN PATENT DOCUMENTS

| | | |
|---|---|---|
| JP | 2004-061858 | 2/2004 |
| JP | 2004-157285 | 6/2004 |

* cited by examiner

*Primary Examiner*—Sandra L Brase
(74) *Attorney, Agent, or Firm*—Hogan & Hartson LLP

(57) ABSTRACT

An image forming apparatus, includes: a developer moving element that moves developer in order to transfer the developer onto a medium by rotating with the developer being borne on the developer moving element; and a collector for collecting the developer that has not been transferred onto the medium and remains on the developer moving element, the collector having a scraper blade that can abut against and separate from the developer moving element and that is for scraping off the developer on the developer moving element by abutting against the developer moving element, a sealing member that can contact with and separate from the developer moving element and that is for preventing, by contacting the developer moving element, the developer from spilling outside the collector, a ventilation opening for moving air in the collector outside the collector, and a valve for adjusting an amount of air passing through the ventilation opening, and the collector being made such that when either one of the scraper blade and the sealing member, whichever separates earlier from the developer moving element, starts separating therefrom, air can pass through the ventilation opening.

16 Claims, 30 Drawing Sheets

IMAGE FORMING APPARATUS THAT PREVENTS DEVELOPER FROM SPILLING

CROSS-REFERENCE TO RELATED APPLICATIONS

The present application claims priority from Japanese Patent Applications No. 2005-289342 filed on Sep. 30, 2005, No. 2005-289343 filed on Sep. 30, 2005, No. 2005-289344 filed on Sep. 30, 2005, No. 2005-289345 filed on Sep. 30, 2005, No. 2005-289346 filed on Sep. 30, 2005, No. 2005-289347 filed on Sep. 30, 2005, No. 2005-289348 filed on Sep. 30, 2005, No. 2005-289349 filed on Sep. 30, 2005, and No. 2005-289350 filed on Sep. 30, 2005, which are herein incorporated by reference.

BACKGROUND

1. Technical Field

The present invention relates to image forming apparatuses.

2. Related Art

Image forming apparatuses such as a laser beam printer have been well-known. Such image forming apparatuses are furnished with, for example, a developer moving element which moves developer by rotating with the developer being borne thereon in order to transfer the developer onto a medium, and a collector for collecting the developer which has not been transferred onto the medium and remains on the developer moving element.

The above-mentioned collector is furnished with a scraper blade and the scraper blade abuts against the developer moving element to scrape the developer on the developer moving element (the developer which moves with the rotation of the developer moving element), in order to collect the developer which remains on the developer moving element. In addition, the collector is furnished with a sealing member, which contacts the developer moving element at a contacting section to prevent the developer scraped by the scraper blade from spilling outside the collector. Further, the scraper blade and the sealing member are structured such that they can contact with and separate from the developer moving element. More specifically, the scraper blade is movable between an abutting position and a non-abutting position and the sealing member is movable between a contact position and a non-contact position.

Now, when either of the scraper blade and the sealing member moves (contacts and separates), airflow occurs in the collector which moves the developer in the collector, and it may cause a problem that the developer is spilled from between the separated scraper blade and developer moving element or from between the separated sealing member and developer moving element. In order to resolve such a problem, there are cases where the image forming apparatuses are furnished with a ventilation opening for moving air in the collector outside the collector and a valve for adjusting an amount of air passing through the ventilation opening. In such a case, the ventilation opening moves air in the collector outside the collector to lower air pressure in the collector, and thus, serves to appropriately prevent developer from spilling from between the separated scraper blade and developer moving element or from between the separated sealing member and developer moving element. And, the valve serves to adjust air pressure in the collector depending on a degree of occurrence of the airflow. In heretofore image forming apparatuses, in a normal state in which the scraper blade abuts against the developer moving element and the sealing member contacts the developer moving element, the valve closes the ventilation opening, and thus air cannot pass through the ventilation opening. Besides, when either one of the scraper blade and the sealing member, whichever separates earlier from the developer moving element, starts separating therefrom, the above-mentioned condition remains maintained. In such a case, when the member starting separating earlier starts separating, high air pressure in the collector causes a problem that the developer is spilled from between the member and the developer moving element. Therefore, there is a demand for an image forming apparatus which enables to appropriately prevent developer from spilling.

When either of the scraper blade and the sealing member moves (contacts and separates), the volume of the collector (for example, the volume of a section surrounded by a housing of the collector, the scraper blade, the sealing member, a member for supporting the scraper blade, and a member for supporting the sealing member) changes. This change of the volume causes airflow in the collector and movement of developer in the collector by that airflow causes a problem that developer is spilled from between the separated scraper blade and developer moving element. The above-mentioned ventilation opening is for resolving the problem, and lowering air pressure in the collector by moving air in the collector outside the collector prevents appropriately the developer from spilling from between the separated scraper blade and developer moving element. Now then, some of the above-mentioned image forming apparatuses are furnished with a valve for adjusting an amount of air passing through the ventilation opening. It is desirable to adjust the amount of the air with the valve, to minimize an amount of the developer spilled from between the separated scraper blade and developer moving element. In short, there is a demand for an image forming apparatus which enables to appropriately prevent developer from spilling.

Further, the collector is furnished with a container for containing toner, and the container contains developer which has not been transferred onto a medium and remains on the developer moving element and which is collected by the collector. If the collector is furnished with a ventilation opening, there are cases in which, when air in a containing chamber moves outside the containing chamber through the ventilation opening, developer in the containing chamber also moves outside the containing chamber passing through the ventilation opening. In such a case, the developer moving outside the containing chamber through the ventilation opening may diffuse. Therefore, there is a demand for an image forming apparatus which enables to prevent diffusion of developer passing through a ventilation opening.

Further, since there are cases in which, when the collector has the ventilation opening, the developer in the collector passes through the ventilation opening to spill outside the collector, a filter is attached to the ventilation opening in some of the above-mentioned image forming apparatuses in order to prevent the developer in the collector from spilling outside the collector passing through the ventilation opening. Thus, since the developer passing through the ventilation opening adheres to the filter, it is possible to prevent the developer from spilling outside the collector. However, if a large amount of the developer in the collector adheres to the filter, the filter may become clogged with the developer. Then, when the filter becomes clogged with the developer, air in the collector cannot appropriately move outside the collector. Therefore, there is a demand for an image forming apparatus which enables to prevent a filter from being clogged with developer.

Note that JP-A-2004-61858 and JP-A-2004-157285 are examples of a related art.

SUMMARY

The present invention has been made in view of the above issues. An object of the present invention is to achieve an image forming apparatus which enables to appropriately prevent developer from spilling.

A primary aspect of the present invention is the following image forming apparatus.

An image forming apparatus includes:

a developer moving element that moves developer in order to transfer the developer onto a medium by rotating with the developer being borne on the developer moving element; and a collector for collecting the developer that has not been transferred onto the medium and remains on the developer moving element, the collector having a scraper blade that can abut against and separate from the developer moving element and that is for scraping off the developer on the developer moving element by abutting against the developer moving element, a sealing member that can contact with and separate from the developer moving element and that is for preventing, by contacting the developer moving element, the developer from spilling outside the collector, a ventilation opening for moving air in the collector outside the collector, and a valve for adjusting an amount of air passing through the ventilation opening, and the collector being made such that when either one of the scraper blade and the sealing member, whichever separates earlier from the developer moving element, starts separating therefrom, air can pass through the ventilation opening.

Further, the present invention has been made in view of the above issues. Another object of the present invention is to achieve an image forming apparatus which enables to appropriately prevent developer from spilling.

Another primary aspect of the present invention is the following image forming apparatus.

An image forming apparatus includes:

a developer moving element that moves developer in order to transfer the developer onto a medium by rotating with the developer being borne on the developer moving element; and a collector for collecting the developer that has not been transferred onto the medium and remains on the developer moving element, the collector having a scraper blade that is for scraping off the developer on the developer moving element by abutting against the developer moving element and that moves between an abutting position and a non-abutting position, a sealing member that is for preventing, by contacting the developer moving element, the developer from spilling outside the collector and that moves between a contact position and a non-contact position, a ventilation opening for moving air in the collector outside the collector, and a valve for adjusting an amount of air passing through the ventilation opening, the volume of the collector changing depending on movement of the scraper blade and the sealing member; wherein the valve adjusts the amount such that the amount reaches a maximum when a change rate of the volume changing depending on the movement reaches a maximum.

Further, the present invention has been made in view of the above issues. Another object of the present invention is to achieve an image forming apparatus which enables to prevent diffusion of developer passing through a ventilation opening.

Another primary aspect of the present invention is the following image forming apparatus.

An image forming apparatus includes:

a developer moving element that moves developer in order to transfer the developer onto a medium by rotating with the developer being borne on the developer moving element; and a collector that is for collecting the developer that has not been transferred onto the medium and remains on the developer moving element, and that has a containing chamber for containing the developer, a ventilation opening for moving air in the containing chamber outside the containing chamber, and an opposite wall located opposite the ventilation opening outside the ventilation opening.

Further, the present invention has been made in view of the above issues. Another object of the present invention is to achieve, through a simple configuration, an image forming apparatus which enables to prevent a filter from being clogged with developer.

Another primary aspect of the present invention is the following image forming apparatus.

An image forming apparatus includes:

a developer moving element that moves developer in order to transfer the developer onto a medium by rotating with the developer being borne on the developer moving element; and a collector for collecting the developer that has not been transferred onto the medium and remains on the developer moving element, the collector having a ventilation opening for moving air in the collector outside the collector, a filter attached to the ventilation opening in order to prevent the developer in the collector from spilling outside the collector passing through the ventilation opening, an abutting/separating member that abuts against and separates from the developer moving element by moving, and a cleaning member that cleans the filter by moving, while keeping in contact with the filter, in conjunction with movement of the abutting/separating member.

Other features of the present invention will become clear by the accompanying drawings and the description hereinbelow.

BRIEF DESCRIPTION OF THE DRAWINGS

For a more complete understanding of the present invention and the advantages thereof, reference is now made to the following description taken in conjunction with the accompanying drawings.

DESCRIPTION OF EXEMPLARY EMBODIMENTS

Figure 1:
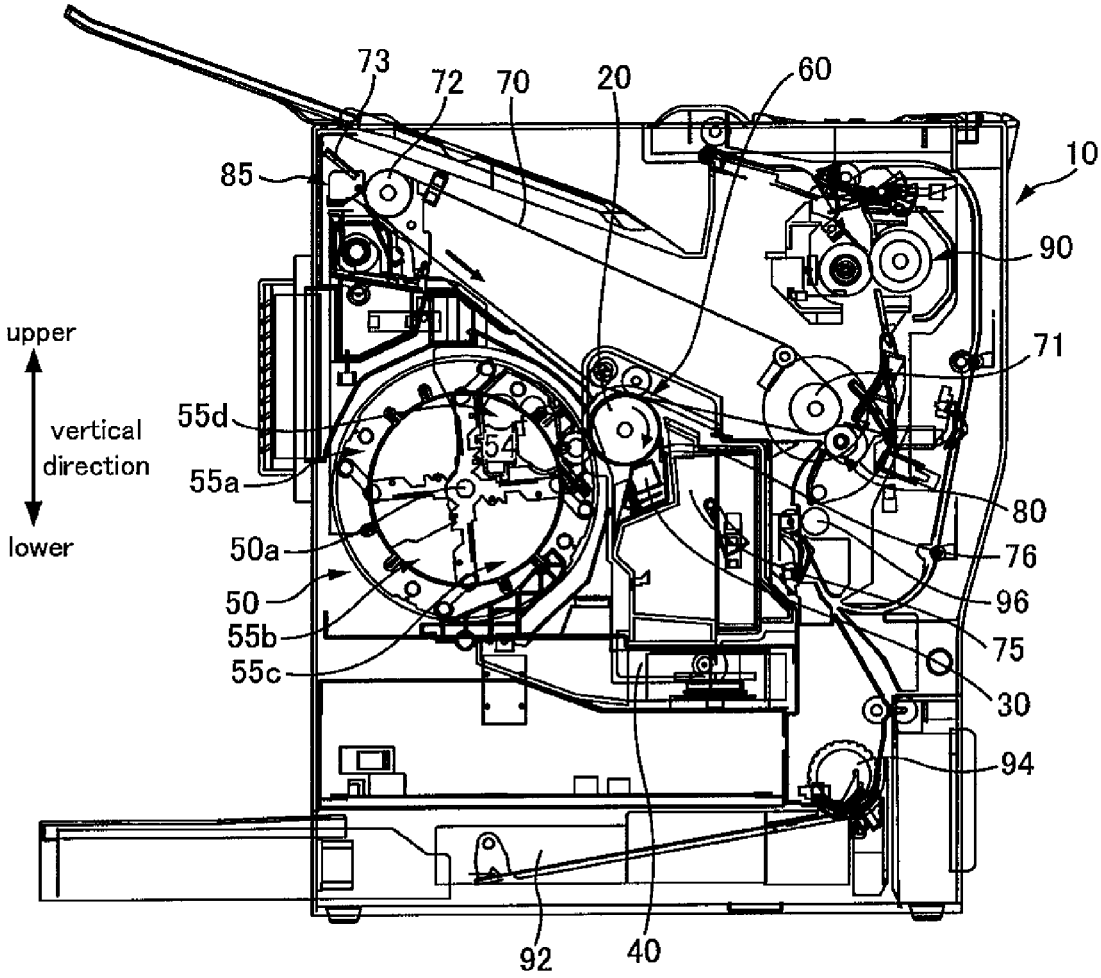
FIG. 1 is a diagram showing main components structuring a printer 10.

At least the following matters will be made clear by the description in the present specification and the accompanying drawings.

An image forming apparatus includes:

a developer moving element that moves developer in order to transfer the developer onto a medium by rotating with the developer being borne on the developer moving element; and a collector for collecting the developer that has not been transferred onto the medium and remains on the developer moving element, the collector having a scraper blade that can abut against and separate from the developer moving element and that is for scraping off the developer on the developer moving element by abutting against the developer moving element, a sealing member that can contact with and separate from the developer moving element and that is for preventing, by contacting the developer moving element, the developer from spilling outside the collector, a ventilation opening for moving air in the collector outside the collector, and a valve for adjusting an amount of air passing through the ventilation opening, and the collector being made such that when either one of the scraper blade and the sealing member, whichever separates earlier from the developer moving element, starts separating therefrom, air can pass through the ventilation opening.

With such an image forming apparatus, it is possible to appropriately suppress developer spillage.

It is also possible that, before either one of the scraper blade and the sealing member, whichever separates earlier from the developer moving element, starts separating therefrom, the valve opens the ventilation opening which is closed thereby.

In such a case, it is possible to avoid the occurrence of a problem that developer passes through the ventilation opening together with air in the normal state in which the scraper blade abuts against the developer moving element and the sealing member contacts the developer moving element.

It is also possible that, when either one of the scraper blade and the sealing member, whichever separates earlier from the developer moving element, starts separating therefrom, the valve keeps the ventilation opening closed, and that the valve is breathable.

In such a case, a problem does not occur that the valve intercepts the path of air by mistake (by contacting the member).

It is also possible that the collector has a housing which forms the ventilation opening and which is furnished with a rib, and that, when either one of the scraper blade and the sealing member, whichever separates earlier from the developer moving element, starts separating therefrom, the valve does not keep the ventilation opening closed and contacts the rib.

In such a case, a problem does not occur that the valve intercepts the path of air by mistake (by contacting the member)

An image forming apparatus includes:

a developer moving element that moves developer in order to transfer the developer onto a medium by rotating with the developer being borne on the developer moving element; and a collector for collecting the developer that has not been transferred onto the medium and remains on the developer moving element, the collector having a scraper blade that is for scraping off the developer on the developer moving element by abutting against the developer moving element and that moves between an abutting position and a non-abutting position, a sealing member that is for preventing, by contacting the developer moving element, the developer from spilling outside the collector and that moves between a contact position and a non-contact position, a ventilation opening for moving air in the collector outside the collector, and a valve for adjusting an amount of air passing through the ventilation opening, the volume of the collector changing depending on movement of the scraper blade and the sealing member; wherein the valve adjusts the amount such that the amount reaches a maximum when a change rate of the volume changing depending on the movement reaches a maximum.

With such an image forming apparatus, it is possible to appropriately suppress developer spillage.

It is also possible that the valve adjusts the amount such that the amount does not decrease when the change rate is increasing and such that the amount does not increase when the change rate is decreasing.

In such a case, it is possible to more appropriately suppress developer spillage.

It is also possible that the collector has a seal supporting member which supports the sealing member and is movable together with the sealing member, and that the valve is provided in the seal supporting member.

In such a case, it is possible to easily construct an image forming apparatus which can appropriately suppress developer spillage.

It is also possible that the sealing member moves in conjunction with movement of the scraper blade.

In such a case, it is possible to easily construct an image forming apparatus which can appropriately suppress developer spillage.

An image forming apparatus includes:

a developer moving element that moves developer in order to transfer the developer onto a medium by rotating with the developer being borne on the developer moving element; and a collector that is for collecting the developer that has not been transferred onto the medium and remains on the developer moving element, and that has a containing chamber for containing the developer, a ventilation opening for moving air in the containing chamber outside the containing chamber, and an opposite wall located opposite the ventilation opening outside the ventilation opening.

With such an image forming apparatus, since the opposite wall located opposite the ventilation opening restricts movement of the developer which has passed through the ventilation opening together with air, it is possible to prevent diffusion of the developer passing through the ventilation opening.

It is also possible that the ventilation opening is a first ventilation opening, and that the collector has a second ventilation opening for moving, outside the collector, air which moves outside the containing chamber passing through the first ventilation opening.

In such a case, since the second ventilation opening enables air in the containing chamber to move outside the collector, it is possible to prevent air pressure in the containing chamber from rising.

It is also possible that the collector includes a gathering chamber which is for gathering the developer which has moved outside the containing chamber passing through the first ventilation opening, and which is furnished with the opposite wall on a central portion of the gathering chamber in a longitudinal direction thereof and the second ventilation opening in an end portion of the gathering chamber in the longitudinal direction.

In such a case, until air passing through the first ventilation opening reaches the second ventilation opening, developer which is moving together with the air drops because of the weight of the developer itself, and this helps to gather the developer into the gathering chamber. Thus, in the above-mentioned case, it is possible to prevent the developer passing through the first ventilation opening from spilling outside the gathering chamber.

It is also possible that the containing chamber serves as a first containing chamber, that a second containing chamber different from the first containing chamber is provided, that the first containing chamber has a carrying member for carrying the developer contained in the first containing chamber to the second containing chamber, and that a bottom section of the gathering chamber is in communication with the first containing chamber.

In such a case, the developer in the bottom section of the gathering chamber moves to the first containing chamber. And then, since the carrying member carries to the second containing chamber the developer which has moved to the first containing chamber, it is possible to prevent a large amount of the developer from accumulating in the gathering chamber.

An image forming apparatus includes:

a developer moving element that moves developer in order to transfer the developer onto a medium by rotating with the developer being borne on the developer moving element; and a collector for collecting the developer that has not been transferred onto the medium and remains on the developer moving element, the collector having a ventilation opening for moving air in the collector outside the collector, a filter attached to the ventilation opening in order to prevent the developer in the collector from spilling outside the collector passing through the ventilation opening, an abutting/separating member that abuts against and separates from the developer moving element by moving, and a cleaning member that cleans the filter by moving, while keeping in contact with the filter, in conjunction with movement of the abutting/separating member.

With such an image forming apparatus, since the cleaning member can remove the developer adhering to the filter, it is possible to prevent a large amount of developer from adhering to the filter, and thereby, to prevent the filter from being clogged with developer. Besides, since the cleaning member moves in conjunction with movement of the abutting/separating member, it is possible to move the cleaning member while keeping the cleaning member in contact with the filter through a simple configuration. Accordingly, if the above-mentioned cleaning member is provided, it is possible to prevent, through a simple configuration, the filter from being clogged with developer. Such a printing apparatus enables to further improve convenience for the user.

It is also possible that the abutting/separating member is a sealing member for preventing, by abutting against the developer moving element, the developer from spilling outside the collector, and that the sealing member is located opposite the ventilation opening.

In such a case, since the developer inside the collector tends to move to the filter when the abutting/separating member abutting against the developer moving element separates therefrom, providing the cleaning member makes the effect be achieved more advantageously that it becomes possible to prevent the filter from being clogged with developer.

It is also possible that the cleaning member adjusts an amount of air passing through the ventilation opening by moving in conjunction with movement of the sealing member.

In such a case, the cleaning member further serves as a so-called valve. In such circumstances as where it is less necessary to move air in the collector outside the collector, it is possible to effectively prevent the filter from being clogged with developer because the cleaning member enables to reduce an amount of the developer moving towards the filter by reducing an amount of air passing through the ventilation opening.

It is also possible that the filter is flexible, and that the volume of the collector is increased by bending of the filter when the cleaning member moves, while keeping in contact with the filter, in conjunction with movement of the abutting/separating member.

In such circumstances as where it is less necessary to move air in the collector outside the collector, increasing the volume of the collector enables to reduce an amount of air passing through the ventilation opening, the volume being increased by bending of the filter when the cleaning member moves keeping in contact with the filter in conjunction with movement of the abutting/separating member. Reducing an amount of air passing through the ventilation opening enables to reduce an amount of the developer moving towards the filter. Therefore, if the volume of the collector is increased by bending of the filter, it is possible to effectively prevent the filter from being clogged with developer.

An image forming apparatus includes:

a developer moving element that moves developer in order to transfer the developer onto a medium by rotating in a predetermined rotating direction with the developer being borne on the developer moving element; and a collector for collecting the developer that has not been transferred onto the medium and remains on the developer moving element, the collector having a scraper blade that is for scraping off the developer on the developer moving element by abutting against the developer moving element at an abutting section, and that moves between an abutting position and a non-abutting position, and a sealing member that is for preventing the developer from spilling outside the collector by contacting the developer moving element at a contacting section located on the upstream side in the rotating direction than the abutting section, and that moves between a contact position and a non-contact position;

wherein, after the sealing member located at the contact position starts moving to the non-contact position, the scraper blade located at the abutting position starts moving to the non-abutting position.

With such an image forming apparatus, it is possible to appropriately suppress developer spillage.

An image forming apparatus includes:

a developer moving element that moves developer in order to transfer the developer onto a medium by rotating with the developer being borne on the developer moving element; and a collector for collecting the developer that has not been transferred onto the medium and remains on the developer moving element, the collector having a scraper blade that is for scraping off the developer on the developer moving element by abutting against the developer moving element at an abutting section, and that moves between an abutting position and a non-abutting position, and a sealing member that is located above the scraper blade in the vertical direction and is for preventing the developer from spilling outside the collector by contacting the developer moving element at a contacting section, and that moves between a contact position and a non-contact position;

wherein, during a period from when the sealing member located at the contact position starts moving to the non-contact position to when the sealing member finishes moving to the non-contact position, an extended imaginary line of the sealing member extended therefrom in a lateral direction thereof passes through between the developer moving element and a front-end portion of the scraper blade.

With such an image forming apparatus, it is possible to appropriately suppress developer spillage.

An image forming apparatus includes:

a developer moving element that moves developer in order to transfer the developer onto a medium by rotating with the developer being borne on the developer moving element; and a collector for collecting the developer that has not been transferred onto the medium and remains on the developer moving element, the collector having a first contacting member that is provided on the upstream side of a rotating direction in the developer moving element and contacts the developer moving element, and that moves between a first contact position and a first non-contact position, and a second contacting member that is provided on the downstream side in the rotating direction of the developer moving element and contacts the developer moving element, and that moves between a second contact position and a second non-contact position;

wherein, during a period from when at least one of the first contacting member located at the first contact position and the second contacting member located at the second contact position starts moving to either of the first non-contact position and the second non-contact position to when the first contacting member and the second contacting member finish moving to the first non-contact position and the second non-contact position respectively, the developer moving element is located on an imaginary line joining one end portion, among both end portions of the first contacting member in a lateral direction thereof, that is closer to the second contacting member, and one end portion, among both end portions of the second contacting member in a lateral direction there of, that is closer to the first contacting member.

With such an image forming apparatus, when the first contacting member located at the first contact position moves to the first non-contact position or when the second contacting member located at the second contact position moves to the second non-contact position, the developer moving element becomes an obstruction to movement of air toward the inside of the collector from between the first or second contacting member and the developer moving element. Accordingly, this enables to prevent the developer adhering to the first or second contacting member from scattering outside the collector with the air.

An image forming apparatus includes:

a developer moving element that moves developer in order to transfer the developer onto a medium by rotating with the developer being borne on the developer moving element; and a collector that is for collecting the developer that has not been transferred onto the medium and remains on the developer moving element, and that has a container for containing the developer and a contacting member contacting the developer moving element and moving between a contact position and a non-contact positions;

wherein, during a period from when the contacting member starts separating from the developer moving element to when the contacting member finishes moving to the non-contact position, a first minimum distance between the developer moving element and one end portion closer to the container among both end portions of the contacting member in a lateral direction thereof is shorter than a second minimum distance between the developer moving element and the other end portion farther away from the container among the both end portions, and at least a part of the container is included in a zone sandwiched by a first imaginary surface formed by extension of the contacting member in the lateral direction, and a second imaginary surface including an opposite portion that is a portion of a surface of the developer moving element opposite to the above-mentioned one end portion, a line perpendicular to the second imaginary surface being an imaginary line joining the above-mentioned one end portion and the opposite portion.

If the first minimum distance is shorter than the second minimum distance, when the contacting member separates from the developer moving element, airflow passing through between one end portion and the developer moving element is stronger than airflow passing through between the other end portion and the developer moving element. Developer adhering to the side of the one end portion of the contacting member moves rapidly in the zone due to the strong airflow passing through between the one end portion and the developer moving element. Therefore, it becomes difficult for developer moving in the zone to move out of the zone, and this enables the developer to appropriately move to the container. Besides, appropriate movement of the developer adhering to the side of the one end portion into the container makes it possible that the container contains the developer. Accordingly, with the above-mentioned image forming apparatus, it is possible to appropriately contain in the container the developer adhering to the contacting member.

Example of Overall Configuration of Image Forming Apparatus

Next, an overview of an image forming apparatus is described for an example of a laser beam printer (hereinafter also referred to as a printer) 10 with reference to FIG. 1. FIG. 1 is a diagram showing main components structuring a printer 10. Note that, in FIG. 1, the arrow indicates the up-and-down direction (the vertical direction), and that a paper supply tray 92 is arranged in the lower section of the printer 10 and a fusing unit 90 is arranged in the upper section of the printer 10, for example.

Figure 2:
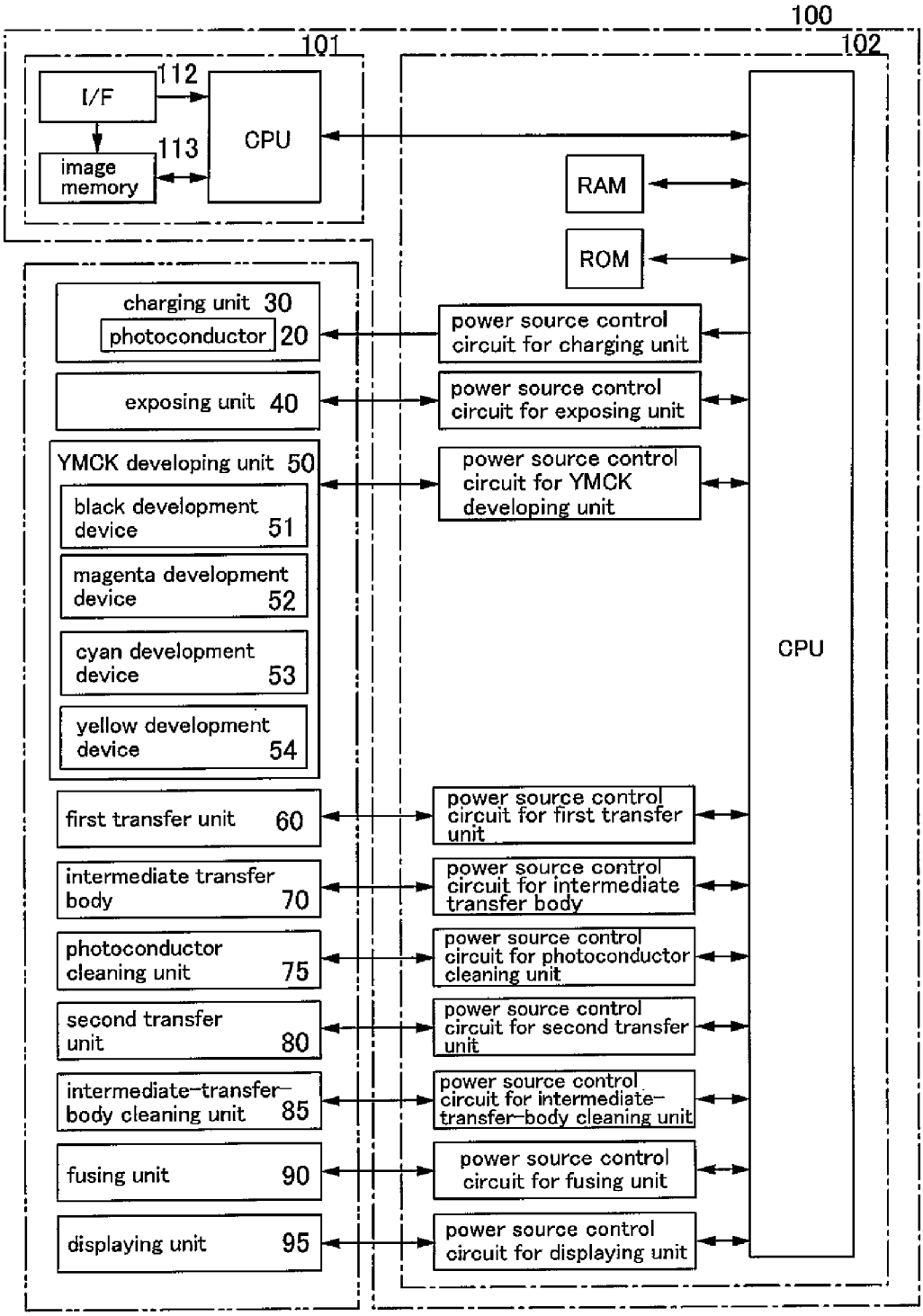
FIG. 2 is a block diagram showing a control unit of the printer 10 in FIG. 1.

As shown in FIG. 1, the printer 10 according to the present embodiment includes a charging unit 30, an exposing unit 40, a YMCK developing unit 50, a first transfer unit 60, an intermediate transfer body 70 which serves as an example of a developer moving element (a toner moving element), and a photoconductor cleaning unit 75, all of which being arranged in the direction of rotation of a photoconductor 20 which serves as an example of an image bearing body. In addition, the printer 10 includes a second transfer unit 80, an intermediate-transfer-body cleaning unit 85 which serves as an example of a collector, the fusing unit 90, a displaying unit 95 which serves as means for making notifications to users and is constructed of a liquid-crystal panel, and a control unit 100 which controls these units, etc. and manages the operations as a printer (FIG. 2).

The photoconductor 20 has a cylindrical conductive base and a photoconductive layer formed on the outer peripheral surface, and it is rotatable about its central axis. In the present embodiment, the photoconductor 20 rotates clockwise, as indicated by the arrow in FIG. 1.

The charging unit 30 is a device for charging the photoconductor 20. The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 according to image signals having been input from a not-shown host computer such as a personal computer or a word processor.

The YMCK developing unit 50 is a device for making (being used for developing) an latent image visible, which is formed on the photoconductor 20 (borne by the photoconductor 20), and as a toner image which serves as an example of a developer image, using toner which serves as an example of developer contained in a development device, that is, black (K) toner contained in a black development device 51, magenta (M) toner contained in a magenta development device 52, cyan (C) toner contained in a cyan development device 53, and yellow (Y) toner contained in a yellow development device 54.

The YMCK developing unit 50 enables to move the positions of the four development devices 51, 52, 53, and 54 by rotating the four development devices 51, 52, 53, and 54 with keeping them attached to the unit. More specifically, in the YMCK developing unit 50, the four development devices 51, 52, 53, and 54 are held by four holders 55*a*, 55*b*, 55*c*, and 55*d* (note that FIG. 1 shows a state in which only the yellow development device 54 is held by the holder 55*d*, but the black development device 51, the magenta development device 52, and the cyan development device 53 can be held by the holder 55*c*, the holder 55*a*, and the holder 55*b*, respectively), and the four development devices 51, 52, 53, and 54 are rotatable about a central axis 50*a* while keeping their respective positions relatively. Every time an image forming process for one page is completed, each of the four development devices 51, 52, 53, and 54 selectively becomes located opposite the photoconductor 20 to successively develop the latent image formed on the photoconductor 20 using toner contained in each of the development devices 51, 52, 53, and 54. Note that each of the above-mentioned four development devices 51, 52, 53, and 54 is attachable to and detachable from a main body of the image forming apparatus, more specifically, the holders 55*a*, 55*b*, 55*c*, and 55*d* of the YMCK developing unit 50.

The first transfer unit 60 is a device for transferring, onto the intermediate transfer body 70, a single-color toner image formed on the photoconductor 20. When toners of four colors are successively transferred in a superposed manner, a full-color toner image is formed on the intermediate transfer body 70.

The intermediate transfer body 70 is an intermediate medium which is used when the toner image on the photoconductor 20 is transferred onto a recording material which serves as an example of a medium (paper, film, cloth and the like), and moves the toner (the toner image) by rotating in a predetermined rotating direction (indicated by the arrow in FIG. 1) with the toner (the toner image) being borne thereon, in order to transfer the toner (the toner image) onto the recording material. The intermediate transfer body 70 is an annular laminated endless belt which is made by providing a tin layer on the surface of a PET film by vapor deposition and further applying semiconducting coating on the outer layer thereof (that is, the intermediate transfer body 70 is a belt which moves developer). The intermediate transfer body 70 is spanned in a tensioned condition round a driving roller 71, a driven roller 72, etc., which are support rollers that support the intermediate transfer body 70 by being provided in contact with an internal surface of the intermediate transfer body 70, and is driven and rotated at a circumferential speed approximately the same as the photoconductor 20.

A patch sensor 73, which serves as a density-detecting member (a sensor) for detecting density of a toner image (toner) on the intermediate transfer body 70, is provided near the intermediate transfer body 70 and the below-mentioned intermediate-transfer-body cleaning unit 85. The printer 10 performs the operation for controlling density of an image at a predetermined timing; on performing the operation, the patch sensor 73 (information detected thereby) is used. More specifically, when performing the controlling operation, a patch image as a toner image (a test pattern) is developed and the patch image is transferred onto the intermediate transfer body 70. Density of the patch image transferred onto the intermediate transfer body 70 is detected by the patch sensor 73, and density of the image is adjusted according to the detected density of the patch image.

The photoconductor cleaning unit 75 is provided between the first transfer unit 60 and the charging unit 30 and includes a photoconductor cleaning blade 76 which is made of rubber and made to abut against the surface of the photoconductor 20. The photoconductor cleaning unit 75 is a device for collecting toner remaining on the photoconductor 20 by scraping it off with the photoconductor cleaning blade 76 after the toner image has been transferred onto the intermediate transfer body 70 by the first transfer unit 60.

The second transfer unit 80 is a device for transferring onto the recording material a single-color toner image or a full-color toner image formed on the intermediate transfer body 70.

The intermediate-transfer-body cleaning unit 85 is provided in the upper section of the YMCK developing unit 50 and is a device for collecting toner which has not been transferred to the recording material and remains on the intermediate transfer body 70. The intermediate-transfer-body cleaning unit 85 will be described in greater detail later.

The fusing unit 90 is a device for creating a permanent image by fusing the single-color toner image or the full-color toner image transferred onto the recording material, to this recording material.

The control unit 100 includes a main controller 101 and a unit controller 102 as shown in FIG. 2. Image signals and control signals are input to the main controller 101, and according to instructions based on these image signals and control signals, the controller 102 forms an image by controlling each of the above-mentioned units and the like.

Next, operations of the printer 10 having the above-mentioned configuration are described.

When the image signals and the control signals are input from the not-shown host computer to the main controller 101 of the printer 10 through an interface (I/F) 112, the photoconductor 20 and the intermediate transfer body 70 rotate under the control of the unit controller 102 according to the instructions from the main controller 101. With being rotating, the photoconductor 20 is successively charged by the charging unit 30 at a charging position.

With the rotation of the photoconductor 20, the charged area of the photoconductor 20 reaches an exposing position. A latent image which corresponds to image information for a first color, for example yellow Y, is formed in the area by the exposing unit 40. Further, in the YMCK developing unit 50, a yellow development device 54 containing yellow (Y) toner is located at a developing position in opposition to the photoconductor 20.

With the rotation of the photoconductor 20, the latent image formed on the photoconductor 20 reaches its developing position, and is developed by the yellow development device 54 using yellow toner. In other words, the yellow development device 54 make visible using toner as a toner image the latent image borne on the photoconductor 20. Thereby, a yellow toner image is formed on the photoconductor 20.

With the rotation of the photoconductor 20, the yellow toner image formed on the photoconductor 20 reaches a first transfer position, and is transferred onto the intermediate transfer body 70 by the first transfer unit 60. At this time, a first transfer voltage, which is in an opposite polarity to the polarity to which the toner is charged, is applied to the intermediate transfer body 70 through the first transfer unit 60, and the intermediate transfer body 70 is charged in the opposite polarity. Note that, during this time, the photoconductor 20 and the intermediate transfer body 70 are placed in contact with each other and the second transfer unit 80 is separated from the intermediate transfer body 70.

By performing successively the above-mentioned process for each of the development devices associating with a second color, a third color, and a fourth color respectively, toner images in four colors associated with the respective image signals are transferred onto the intermediate transfer body 70 in a superposed manner. Thereby, a full-color toner image is formed on the intermediate transfer body 70.

With the rotation of the intermediate transfer body 70, the full-color toner image formed on the intermediate transfer body 70 reaches a second transfer position, and is transferred onto the recording material by the second transfer unit 80. Note that the recording material is carried from the paper supply tray 92 to the second transfer unit 80 through a paper supply roller 94 and resisting rollers 96. During the transfer operation, a second transfer voltage is applied to the second transfer unit 80, the second transfer unit 80 being pressed against the intermediate transfer body 70. Further, toner which has not been transferred onto the recording material and remains on the intermediate transfer body 70 is collected by the intermediate-transfer-body cleaning unit 85.

The full-color toner image transferred onto the recording material is heated and pressurized by the fusing unit 90, to be fused to the recording material.

On the other hand, after the photoconductor 20 has passed the first transfer position, toner adhering to the surface thereof is collected by the photoconductor cleaning unit 75, and the photoconductor 20 is prepared for charging which is for formation of a next latent image.

Overview of Control Unit

Next, a configuration of the control unit 100 is described with reference to FIG. 2. The main controller 101 of the control unit 100 is connected to the host computer through the interface 112 and is furnished with an image memory 113 for storing the image signals which have been input from the host computer. The unit controller 102 is electrically connected to the units in the body of the apparatus (for example, the charging unit 30, the exposing unit 40, the YMCK developing unit 50, the first transfer unit 60, the intermediate transfer body 70, the photoconductor cleaning unit 75, the second transfer unit 80, the intermediate-transfer-body cleaning unit 85, the fusing unit 90, and the displaying unit 95), and it detects the state of the units by receiving signals from sensors provided in those units and controls them base on the signals which are input from the main controller 101.

First Embodiment

Figure 3:
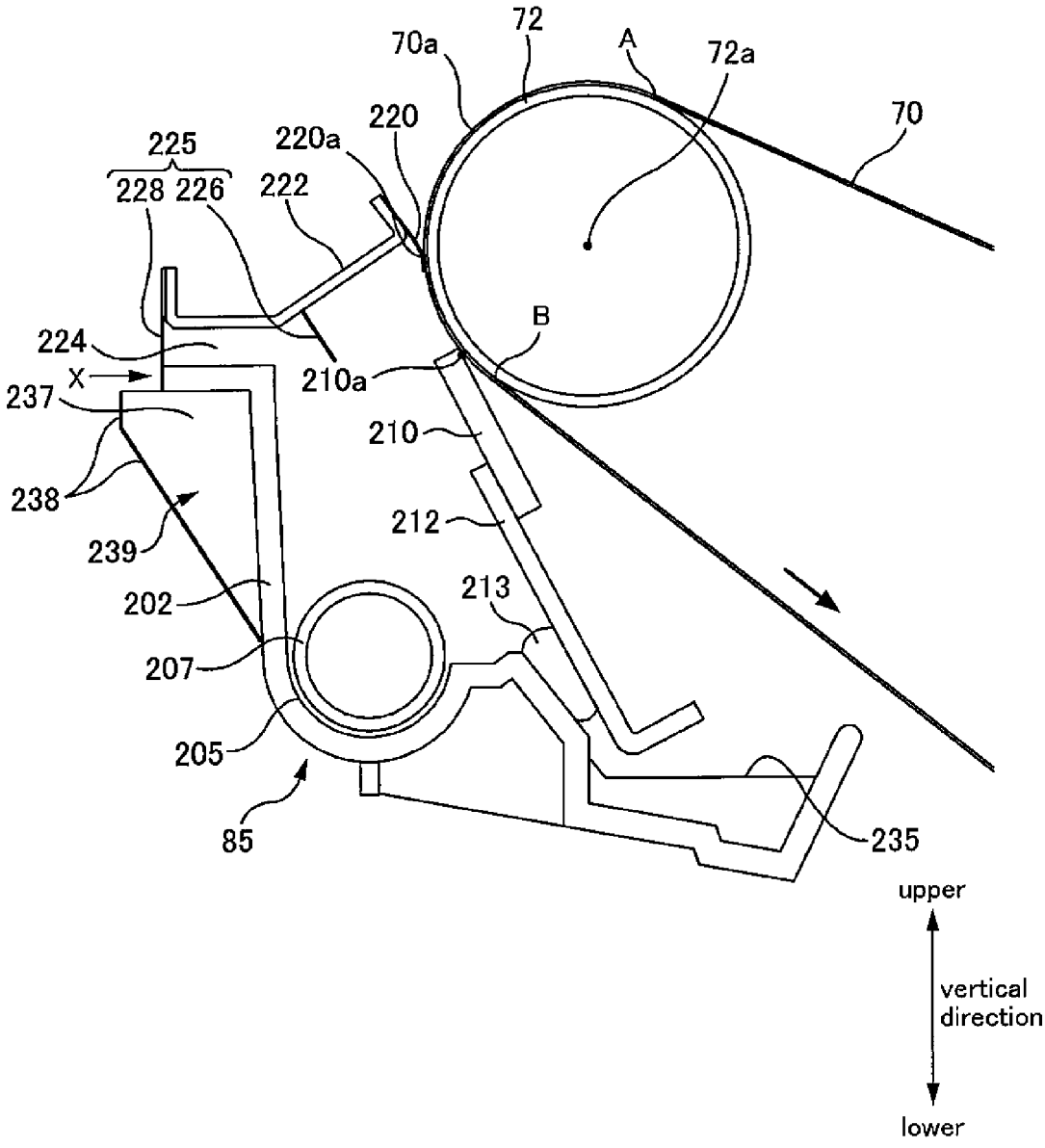
FIG. 3 is a (first) schematic diagram showing a cross-section of an intermediate-transfer-body cleaning unit 85 according to the first embodiment.
Figure 4:
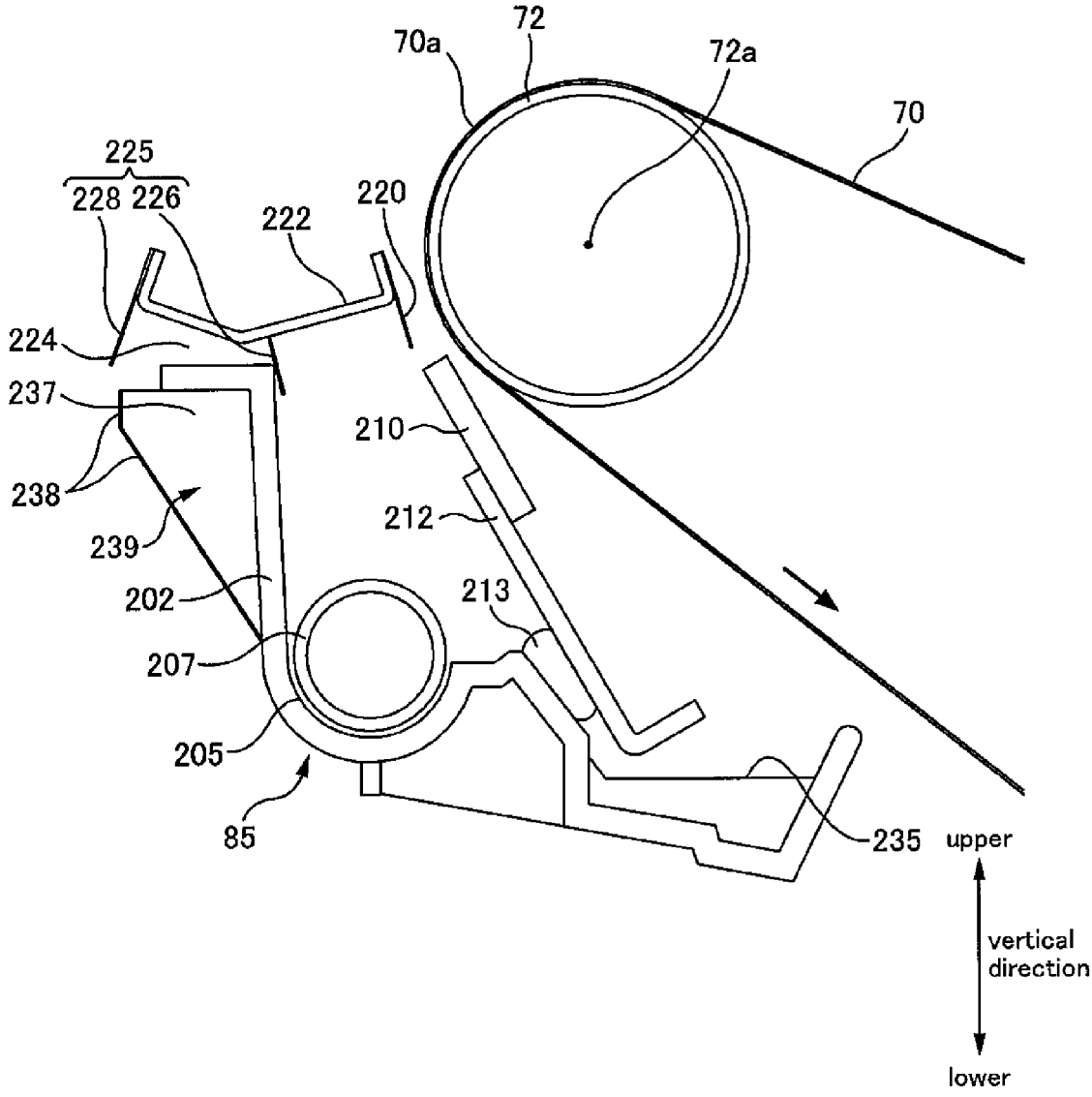
FIG. 4 is a (second) schematic diagram showing a cross-section of the intermediate-transfer-body cleaning unit 85 according to the first embodiment.
Figure 5:
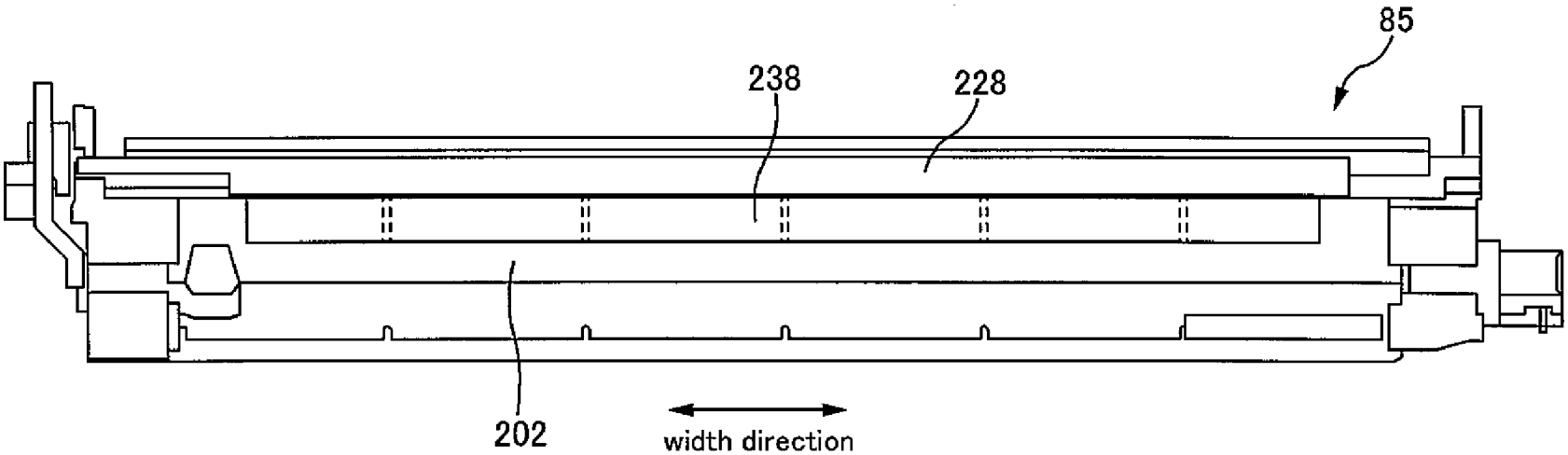
FIG. 5 is a view in X-direction of the intermediate-transfer-body cleaning unit 85 shown in FIG. 3.
Figure 6:
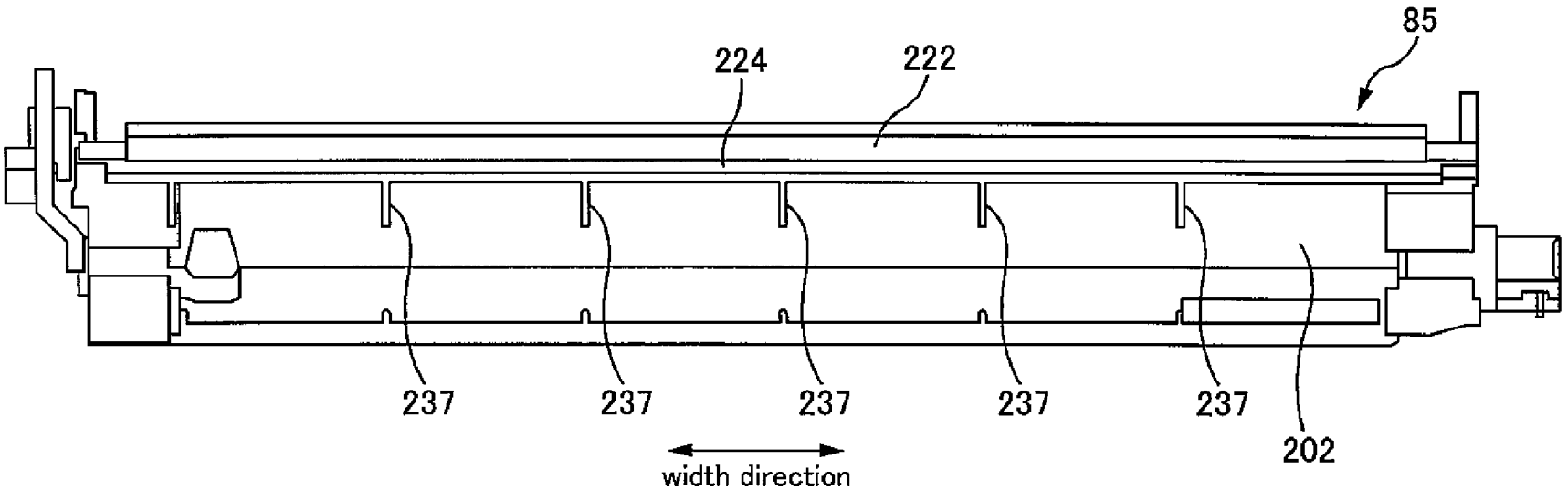
FIG. 6 is a view showing a state in which a second valve 228 and a sheeting 238 are removed from the intermediate-transfer-body cleaning unit 85 shown in FIG. 5.
Figure 7:
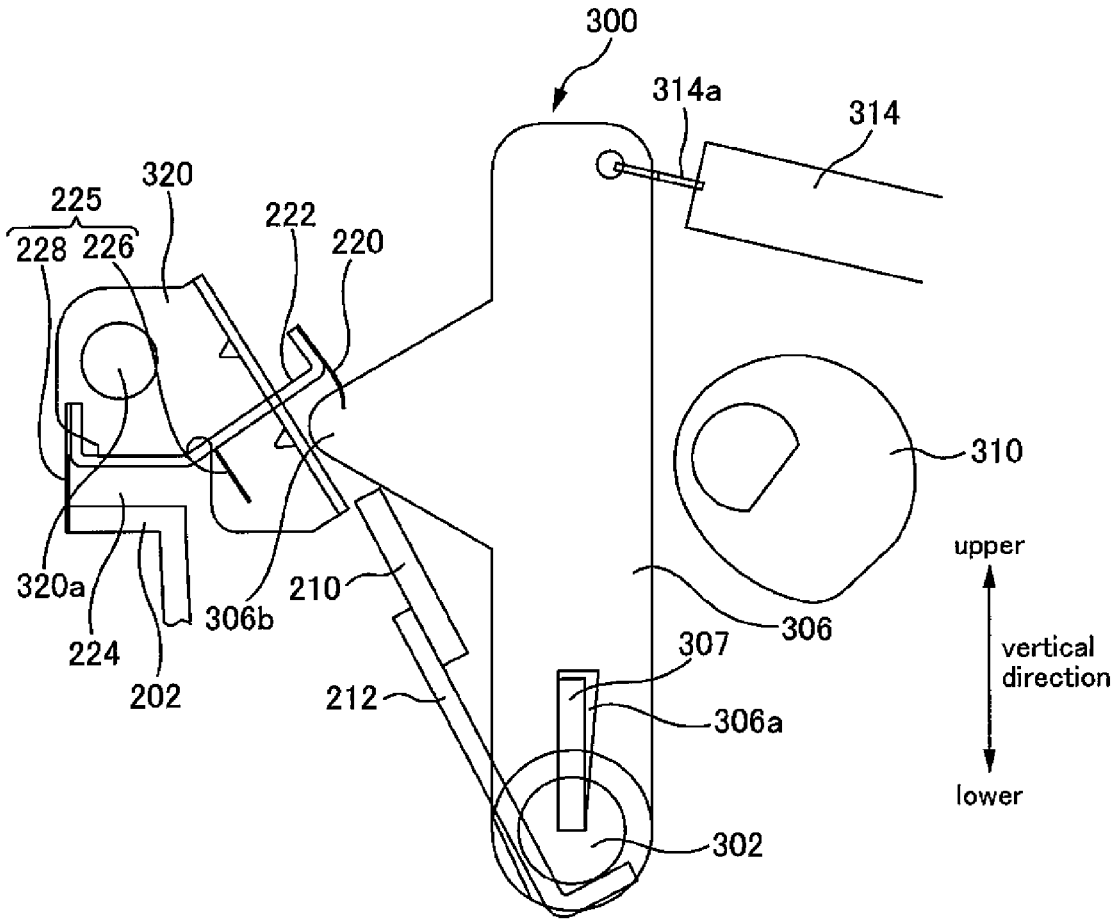
FIG. 7 is a schematic diagram according to the first embodiment showing a contacting/separating mechanism 300, etc. when an intermediate-transfer-body cleaning blade 210 is located at an abutting position and an upper seal 220 is located at a contact position.
Figure 8:
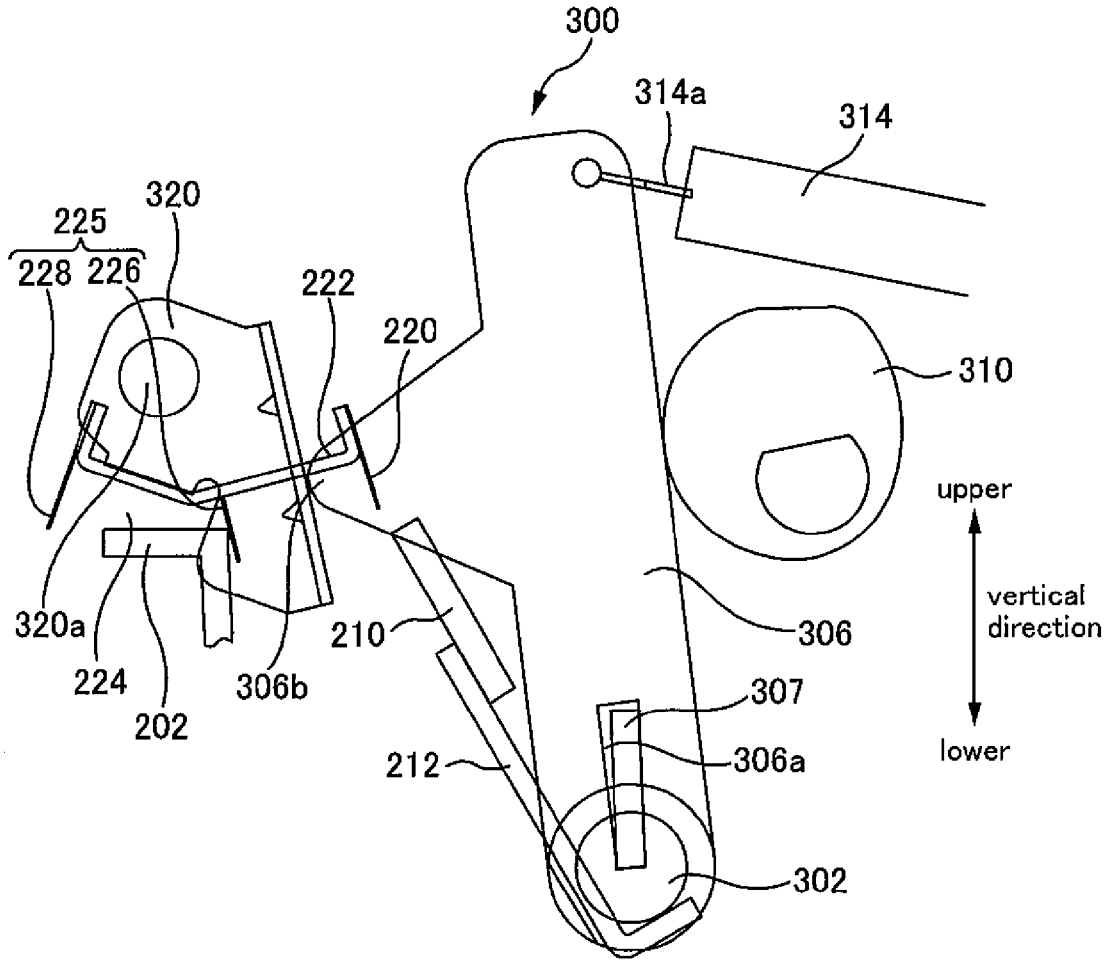
FIG. 8 is a schematic diagram according to the first embodiment showing the contacting/separating mechanism 300, etc. when the intermediate-transfer-body cleaning blade 210 is located at a non-abutting position and the upper seal 220 is located at a non-contact position.

Example of Configuration of Intermediate-Transfer-Body Cleaning Unit 85 According to First Embodiment Next, an example of a configuration of the intermediate-transfer-body cleaning unit 85 is described with reference to FIGS. 3 through 8. FIGS. 3 and 4 are schematic diagrams showing cross-sections of the intermediate-transfer-body cleaning unit 85: FIG. 3 shows a state in which an intermediate-transfer-body cleaning blade 210 is located at an abutting position and an upper seal 220 is located at a contact position, and FIG. 4 shows a state in which the intermediate-transfer-body cleaning blade 210 is located at a non-abutting position and the upper seal 220 is located at a non-contact position. FIG. 5 is a view in X-direction of the intermediate-transfer-body cleaning unit 85 shown in FIG. 3. FIG. 6 shows a state in which a second valve 228 and a sheeting 238 are removed from the intermediate-transfer-body cleaning unit 85 shown in FIG. 5. FIG. 7 is associated with FIG. 3 and is a schematic diagram showing a contacting/separating mechanism 300, etc. when the intermediate-transfer-body cleaning blade 210 is located at the abutting position and the upper seal 220 is located at the contact position. FIG. 8 is associated with FIG. 4 and is a schematic diagram showing the contacting/separating mechanism 300, etc. when the intermediate-transfer-body cleaning blade 210 is located at the non-abutting position and the upper seal 220 is located at the non-contact position.

The intermediate-transfer-body cleaning unit 85 is for collecting toner which has not been transferred onto the recording material and remains on the intermediate transfer body 70, and includes a housing 202, a toner container 205, the intermediate-transfer-body cleaning blade 210 which serves as an example of a scraper blade, the upper seal 220 which serves as an example of a sealing member, a ventilation opening 224, valves 225, a first toner receiver 235, a second toner receiver 239 which serves as an example of a developer receiver, the contacting/separating mechanism 300 and the like.

The housing 202 operates in cooperation with the upper seal 220 and the intermediate-transfer-body cleaning blade 210 to prevent the collected toner from spilling outside the intermediate-transfer-body cleaning unit 85. Inside the housing 202, the toner container 205 and the first toner receiver 235 are formed and the intermediate-transfer-body cleaning blade 210 and the like are also provided.

The intermediate-transfer-body cleaning blade 210 has the function of scraping toner remaining on the intermediate transfer body 70 (that is, toner which moves with the rotation of the intermediate transfer body 70) by abutting against the intermediate transfer body 70 at the abutting section 210*a*. The intermediate-transfer-body cleaning blade 210 is provided such that its longitudinal direction is along the width direction of the intermediate transfer body 70 (a direction perpendicular to the surface of the paper in FIGS. 3 and 4). The intermediate-transfer-body cleaning blade 210 is an approximately 2 mm thick rubber blade, and is arranged such that its front end faces toward the upstream side of the rotating direction of the intermediate transfer body 70. Note that the intermediate-transfer-body cleaning blade 210 abuts against a section being located vertically below a central axis 72*a* of the driven roller 72 of a spanned-round portion 70*a* which is a part of the intermediate transfer body 70 that is spanned round the driven roller 72 (the spanned-round portion 70*a* is the upper left portion above a boundary which is defined by positions indicated by symbols A and B in FIG. 3).

Besides, the intermediate-transfer-body cleaning blade 210 is configured such that it can abut against and separate from (can contact with and separate from) the intermediate transfer body 70. More specifically, the intermediate-transfer-body cleaning blade 210 is secured to a rotationally-moving shaft 302 through a blade-supporting metal plate 212 supporting it, and the intermediate-transfer-body cleaning blade 210 moves back and forth between the abutting position (FIG. 3) and the non-abutting position (FIG. 4) by back-and-forth rotational movement of the rotationally-moving shaft 302 between a first rotated position and a second rotated position. Note that a configuration of the contacting/separating mechanism 300 in the intermediate-transfer-body cleaning blade 210, etc. will be described in greater detail later.

Further, a lower seal 213 is provided between the blade-supporting metal plate 212 and the housing 202 and is for preventing toner from spilling toward a first toner receiver 235 mentioned below from between the blade-supporting metal plate 212 and the housing 202. The lower seal 213 is made of sponge and is provided such that its longitudinal direction is along the longitudinal direction of the intermediate-transfer-body cleaning blade 210.

The toner container 205 is for containing toner scraped by the intermediate-transfer-body cleaning blade 210. The toner container 205 is formed in the lower section of the intermediate-transfer-body cleaning unit 85, and is furnished with a screw section 207 rotatable about its central axis. The screw section 207 rotates to send toner contained in the toner container 205 to a not-shown waste toner box (which is provided frontward of the screw section 207 in the direction perpendicular to the surface of the paper in FIG. 3). In other words, the toner container 205 and the waste toner box serve as a first container and a second container of toner respectively.

The first toner receiver 235 has the function of receiving toner which has not been contained in the toner container 205 and has been moved to the side opposite the toner container 205 relative to the intermediate-transfer-body cleaning blade 210. The first toner receiver 235 is formed in the lower section of the intermediate-transfer-body cleaning unit 85 and on the side opposite the toner container 205 relative to the intermediate-transfer-body cleaning blade 210 (the side of the photoconductor 20).

The upper seal 220 contacts the intermediate transfer body 70 at a contacting section 220*a*, to prevent the collected toner from spilling outside the intermediate-transfer-body cleaning unit 85. The upper seal 220 is located above the intermediate-transfer-body cleaning blade 210 in the vertical direction, and is provided such that its longitudinal direction is along the width direction of the intermediate transfer body 70 (a direction perpendicular to the surface of the paper in FIGS. 3 and 4). The upper seal 220 is an approximately 120 μm thick sheet-like member, and is arranged such that its front end faces toward the downstream side of the rotating direction of the intermediate transfer body 70. Materials which the upper seal 220 is made of are the same as those of the intermediate transfer body 70. More specifically, the upper seal 220 is laminated and made by providing a tin layer on the surface of a PET film by vapor deposition, then further applying semi-conducting coating on the outer layer thereof. Note that, in the same way as the intermediate-transfer-body cleaning blade 210, the upper seal 220 contacts a portion located vertically below the central axis 72*a* of the driven roller 72 of the spanned-round portion 70*a* which is a part of the intermediate transfer body 70 that is spanned round the driven roller 72. Further, the contacting section 220*a* is located above an abutting section 210*a* of the intermediate-transfer-body cleaning blade 210 in the vertical direction and on the upstream side of the rotating direction of the intermediate transfer body 70.

Further, in the same way as the intermediate-transfer-body cleaning blade 210, the upper seal 220 is configured such that it can contact with and separate from the intermediate transfer body 70. More specifically, the upper seal 220 is secured to a rotationally-moving section 320 through a seal supporting member 222 which supports and moves together with the upper seal 220, and the upper seal 220 moves back and forth between a contact position (FIG. 3) and a non-contact position (FIG. 4) by back-and-forth rotational movement of the rotationally-moving section 320 between the first rotated position and the second rotated position. Further, in the present embodiment, the upper seal 220 moves in conjunction with movement of the intermediate-transfer-body cleaning blade 210 (this will be described in greater detail later). The upper seal 220 moves from the contact position to the non-contact position in conjunction with movement of the intermediate-transfer-body cleaning blade 210 from the abutting position to the non-abutting position, and the upper seal 220 moves from the non-contact position to the contact position in conjunction with movement of the intermediate-transfer-body cleaning blade 210 from the non-abutting position to the abutting position. Note that a configuration, etc. of the contacting/separating mechanism 300 of the upper seal 220 will be described in greater detail later.

The ventilation opening 224 is for moving air in the intermediate-transfer-body cleaning unit 85 outside the intermediate-transfer-body cleaning unit 85 in order to lower air pressure in the intermediate-transfer-body cleaning unit 85. The ventilation opening 224 is provided in the upper section of the intermediate-transfer-body cleaning unit 85, and is in communication with the outside of the intermediate-transfer-body cleaning unit 85 from the inside thereof. The ventilation opening 224, as shown in FIG. 6, is provided such that its longitudinal direction is along the width direction of the intermediate transfer body 70 (a direction perpendicular to the surface of the paper in FIGS. 3 and 4). Further, the ventilation opening 224 is structured by the housing 202 and the seal supporting member 222.

The valves 225 are for adjusting an amount of air passing through the ventilation opening 224. In the present embodiment, a first valve 226 provided inside the intermediate-transfer-body cleaning unit 85 and the second valve 228 provided outside the intermediate-transfer-body cleaning unit 85 are provided as the valves 225.

Both of the first valve 226 and the second valve 228 are provided such that their respective longitudinal directions are along the width direction of the intermediate transfer body 70 (a direction perpendicular to the surface of the paper in FIGS. 3 and 4) (FIG. 5 shows a state in which the longitudinal direction of the second valve 228 is along the above-mentioned width direction). Further, both of the first valve 226 and the second valve 228 are attached to the seal supporting member 222. Therefore, the first valve 226 and the second valve 228 move in conjunction with movement of the upper seal 220 (it also can be said that the first valve 226 and the second valve 228 move in conjunction with movement of the intermediate-transfer-body cleaning blade 210 since the upper seal 220 moves in conjunction with movement of the intermediate-transfer-body cleaning blade 210), and thus, an amount of air passing through the ventilation opening 224 is adjusted. Note that, in the present embodiment, as shown in FIG. 3, when the intermediate-transfer-body cleaning blade 210 is located at the abutting position and the upper seal 220 is located at the contact position, the second valve 228 keeps an exit of the ventilation opening 224 closed, and, as shown in FIG. 4, when the intermediate-transfer-body cleaning blade 210 is located at the non-abutting position and the upper seal 220 is located at the non-contact position, the first valve 226 keeps an entrance of the ventilation opening 224 closed.

The second toner receiver 239 is for receiving toner which moves outside the intermediate-transfer-body cleaning unit 85 through the ventilation opening 224. A plural of ribs 237 for reinforcement are provided on an external surface of the housing 202 as shown in FIG. 6, and the sheeting 238 made of PET (polyethylene terephthalate) is provided along the ribs 237 as shown in FIGS. 3 and 4. The second toner receiver 239 is structured by the sheeting 238 and the external surface of the housing 202.

The contacting/separating mechanism 300 is a mechanism for causing the intermediate-transfer-body cleaning blade 210 and the upper seal 220 to perform contacting and separation. The contacting/separating mechanism 300 is provided mainly outside the intermediate transfer body 70 in the width direction of the intermediate transfer body 70 (a direction perpendicular to the surface of the paper in FIGS. 3 and 4), and includes the above-mentioned rotationally-moving shaft 302, a lever 306, a cam 310, a tension spring 314, the above-mentioned rotationally-moving section 320, a torsion spring and the like as shown in FIGS. 7 and 8.

The rotationally-moving shaft 302 is a shaft which can rotate back and forth between the first rotated position (a position shown in FIG. 7) and the second rotated position (a position shown in FIG. 8). As mentioned above, the intermediate-transfer-body cleaning blade 210 is secured to the rotationally-moving shaft 302 through the blade-supporting metal plate 212. In addition, a pin 307 is secured to the rotationally-moving shaft 302.

The rotationally-moving shaft 302 is furnished with the lever 306 which is rotationally movable about the rotationally-moving shaft 302. Further, a groove portion 306*a* and a projecting section 306*b* are formed in the lever 306. When the lever 306 moves rotationally, the groove portion 306*a* contacts and presses the pin 307, to rotationally move the rotationally-moving shaft 302 to which the pin 307 is secured. As a result thereof, the projecting section 306*b* contacts and presses the rotationally-moving section 320, to rotationally move the rotationally-moving section 320.

The cam 310 is for moving the lever 306 rotationally by contacting the lever 306, and is rotated and driven by a not-shown driving power source.

The tension spring 314 is an urging member which urges the lever 306 in the clockwise direction in FIGS. 7 and 8. One end 314*a* of the tension spring 314 is connected to the other end portion of the lever 306, and the other end (not shown) is connected to a not-shown spring-hook section which is provided on the intermediate-transfer-body cleaning unit 85.

The rotationally-moving section 320 can rotate back and forth, about a shaft 320*a*, between the first rotated position (a position shown in FIG. 7) and the second rotated position (a position shown in FIG. 8). As mentioned above, the upper seal 220 is secured to the rotationally-moving section 320 through the seal supporting member 222. Accordingly, the rotationally-moving section 320 and the upper seal 220 are configured such that they rotationally move together.

The torsion spring (not shown) is an urging member which urges the rotationally-moving section 320 in the counterclockwise direction in FIGS. 7 and 8. The torsion spring is attached to the shaft 320*a*. One end of the torsion spring is connected to the rotationally-moving section 320, and the other end thereof is connected to the not-shown spring-hook section which is provided on the intermediate-transfer-body cleaning unit 85.

Note that the following section describes operations of the contacting/separating mechanism 300 and contacting/separating operation of the intermediate-transfer-body cleaning blade 210 and the upper seal 220 caused thereby.

Regarding Contacting/Separating Operation of Intermediate-Transfer-Body Cleaning Blade 210 and Upper Seal 220 According to First Embodiment This section describes the contacting/separating operation of the intermediate-transfer-body cleaning blade 210 and the upper-seal 220. Note that, before describing the contacting/separating operation, this section describes timing when the intermediate-transfer-body cleaning blade 210 and the upper seal 220 contact or separate while the printer 10 performs the above-mentioned image formation operation. After that, the contacting/separating operation of the intermediate-transfer-body cleaning blade 210 and the upper seal 220 is described.

Regarding Contacting/Separating Timing of Intermediate-Transfer-Body Cleaning Blade 210 and Upper Seal 220 during Image Formation Operation Here, timing when the intermediate-transfer-body cleaning blade 210 and the upper seal 220 contact or separate is described.

As mentioned above, the first transfer unit 60 has transferred successively, onto the intermediate transfer body 70, toner images in the respective colors which are formed on the photoconductor 20, and thereby the toner images in four colors are transferred in a superposed manner onto the intermediate transfer body 70. As a result thereof, the full-color toner image is formed on the intermediate transfer body 70. With the rotation of the intermediate transfer body 70, the full-color toner image formed on the intermediate transfer body 70 reaches the second transfer position and is transferred onto the recording material by the second transfer unit 80.

With the rotation of the intermediate transfer body 70, immediately before toner that has not been transferred onto the recording material and remains on the intermediate transfer body 70 reaches the intermediate-transfer-body cleaning unit 85, the intermediate-transfer-body cleaning blade 210 abuts against the intermediate transfer body 70 and the upper seal 220 contacts the intermediate transfer body 70. When the intermediate-transfer-body cleaning blade 210 finishes scraping off toner remaining on the intermediate transfer body 70, the intermediate-transfer-body cleaning blade 210 and the upper seal 220 separate from the intermediate transfer body 70 and they make themselves ready for a next transfer of toner images in the respective colors which are formed on the photoconductor 20, the next transfer being performed by the first transfer unit 60.

Regarding Contacting/Separating Operation of Intermediate-Transfer-Body Cleaning Blade 210 and Upper Seal 220

Figure 9:
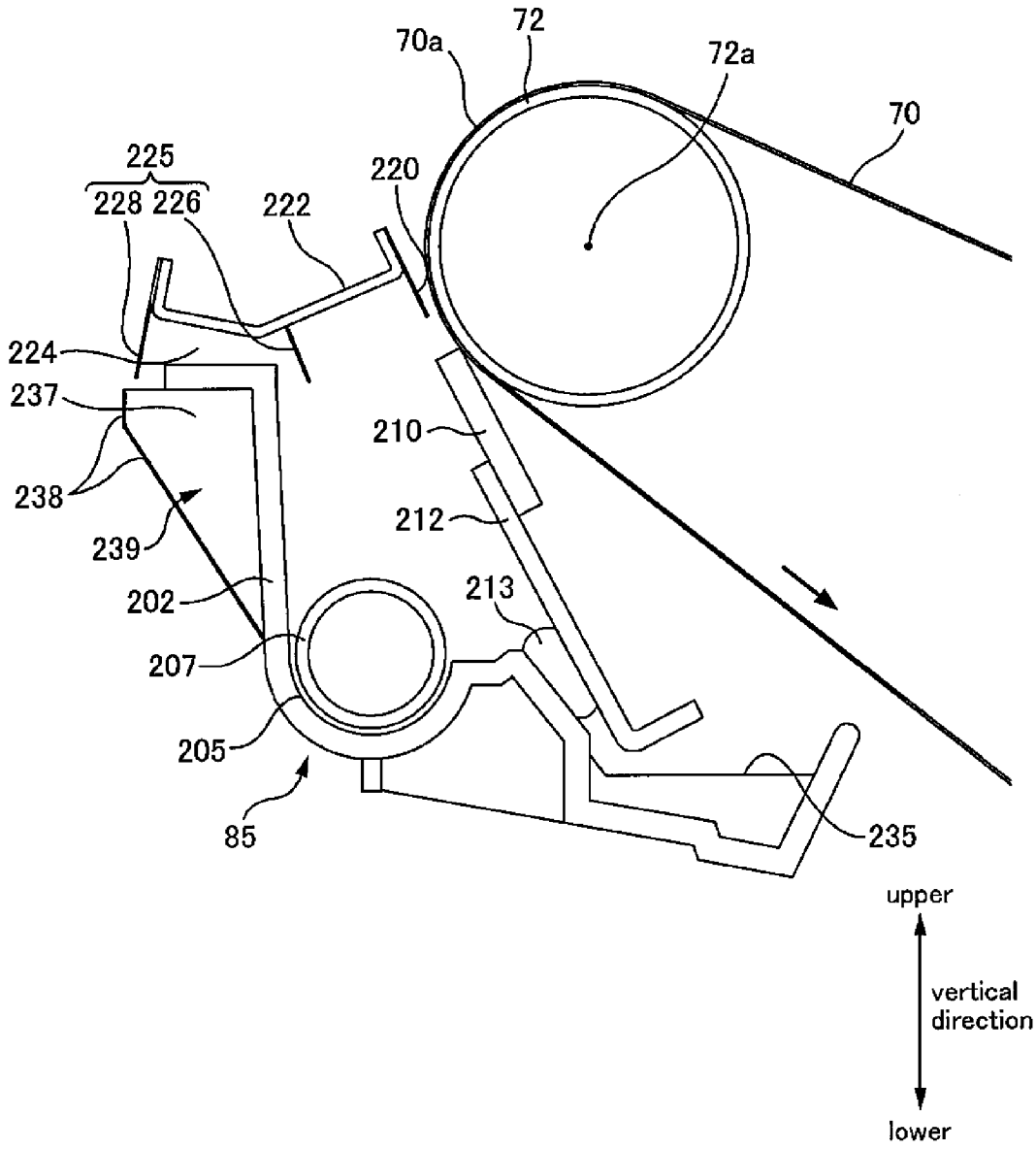
FIG. 9 is a (third) schematic diagram showing a cross-section of the intermediate-transfer-body cleaning unit 85 according to the first embodiment.
Figure 10:
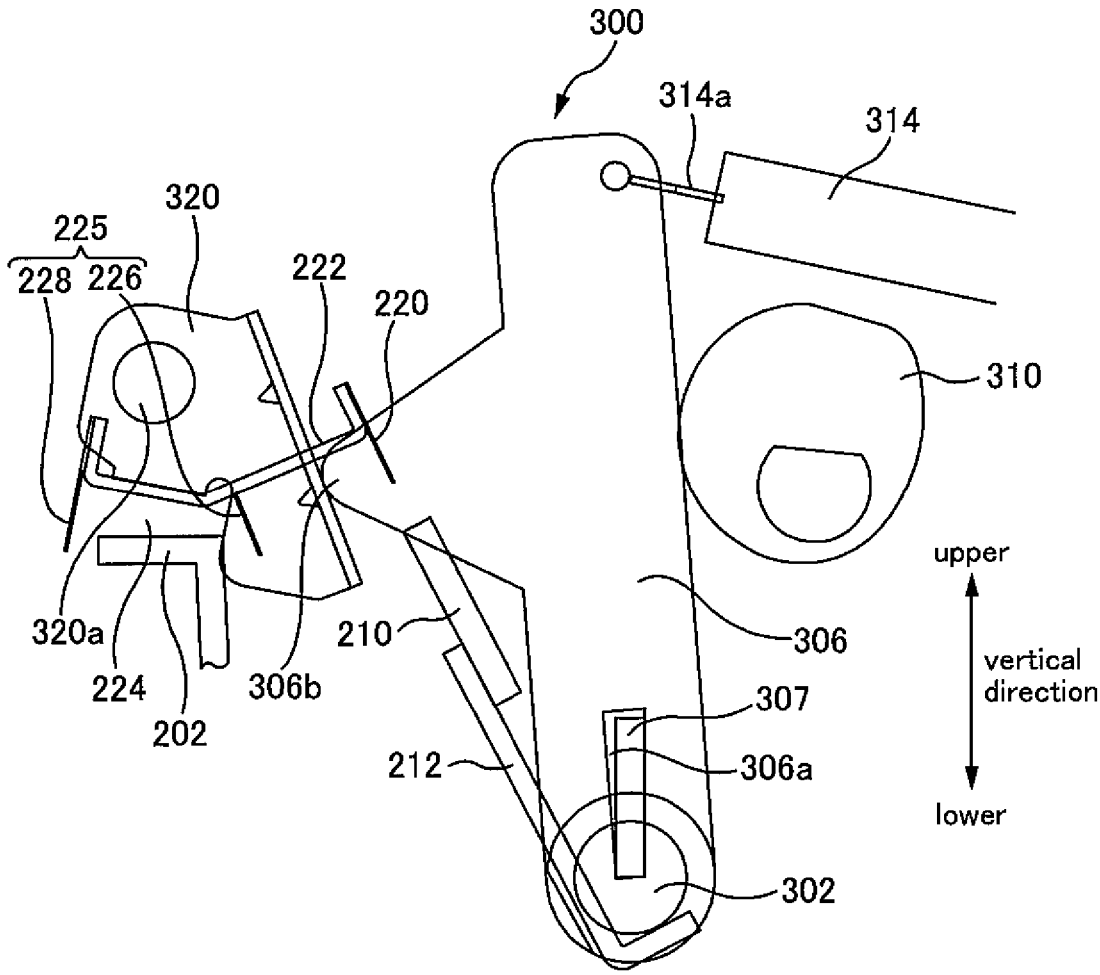
FIG. 10 is a schematic diagram according to the first embodiment showing the contacting/separating mechanism 300, etc. when a groove portion 306*a* contacts a pin 307.

In this section, the contacting/separating operation of the intermediate-transfer-body cleaning blade 210 and the upper seal 220 is described with reference to FIGS. 7 through 10. FIG. 9 is a schematic diagram showing a cross-section of the intermediate-transfer-body cleaning unit 85, and shows a state in which the groove portion 306*a* contacts the pin 307. FIG. 10 is a schematic diagram showing the contacting/separating mechanism 300 and the like when the groove portion 306*a* contacts the pin 307. Note that the following description refers to operation of the valves 225 (the first valve 226 and the second valve 228).

First, in the condition in which the intermediate-transfer-body cleaning blade 210 abuts against the intermediate transfer body 70 and the upper seal 220 contacts the intermediate transfer body 70 (FIG. 7), when the cam 310 is rotated by the driving power source, the cam 310 contacts the lever 306, to press the lever 306. The lever 306 pressed by the cam 310 starts moving rotationally in the counterclockwise direction in FIG. 7 against the urging force of the tension spring 314. Note that, when the cam 310 starts rotating, the second valve 228 keeps the exit of the ventilation opening 224 closed and the first valve 226 keeps the entrance of the ventilation opening 224 opened, as shown in FIG. 7.

When the lever 306 continues to move rotationally in the counterclockwise direction in FIG. 7, the projecting section 306*b* of the lever 306 finally contacts and presses the rotationally-moving section 320. The rotationally-moving section 320 pressed by the projecting section 306*b* of the lever 306 starts moving rotationally in the clockwise direction in FIG. 7 against the urging force of the torsion spring.

Besides, since the upper seal 220 is secured to the rotationally-moving section 320, the upper seal 220 also moves rotationally in the clockwise direction in FIG. 7 in conjunction with rotational-movement of the rotationally-moving section 320. As a result thereof, the upper seal 220 located at the contact position separates from the intermediate transfer body 70 and starts moving to the non-contact position. Since the valves 225 (the first valve 226 and the second valve 228) and the upper seal 220 are provided together in the seal supporting member 222, the valves 225 starts moving when the upper seal 220 starts moving.

Note that, as shown in FIG. 3, before the projecting section 306*b* contacts the rotationally-moving section 320, while the upper seal 220 contacts the intermediate transfer body 70 in a bent state, the second valve 228 contacts the housing 202 without bending (otherwise slightly bent). Accordingly, when the upper seal 220 and the valves 225 move rotationally in conjunction with rotational-movement of the rotationally-moving section 320, the second valve 228 opens the ventilation opening 224 which the valve has kept closed, before the upper seal 220 starts separating from the intermediate transfer body 70.

The lever 306 and the rotationally-moving section 320 continue to move rotationally together. And finally, the groove portion 306*a* of the lever 306 contacts the rotationally-moving shaft 302 to which the pin 307 is secured, and presses the pin 307 (this state is shown in FIGS. 9 and 10). The pin 307 pressed by the groove portion 306*a* of the lever 306 starts moving rotationally in the counterclockwise direction in FIG. 10.

Further, since the pin 307 and the intermediate-transfer-body cleaning blade 210 are secured to the rotationally-moving shaft 302, the rotationally-moving shaft 302 and the intermediate-transfer-body cleaning blade 210 rotationally move in the counterclockwise direction in FIG. 10 in conjunction with rotational-movement of the pin 307. As a result thereof, the intermediate-transfer-body cleaning blade 210 located at the abutting position separates from the intermediate transfer body 70, and starts moving to the non-abutting position.

The lever 306, the rotationally-moving section 320, and the rotationally-moving shaft 302 continue to move rotationally together. And finally, the intermediate-transfer-body cleaning blade 210 reaches the non-abutting position and the upper seal 220 reaches the non-contact position (FIG. 8). The second valve 228 which has moved opens the exit of the ventilation opening 224, and on the contrary, the first valve 226 which has moved closes the entrance of the ventilation opening 224 (FIG. 8).

On the other hand, when the cam 310 is rotated by the driving power source in the condition in which the intermediate-transfer-body cleaning blade 210 and the upper seal 220 are separated from the intermediate transfer body 70 (FIG. 8), the lever 306 rotationally moves in the clockwise direction in FIG. 8 because of the urging force of the tension spring 314. The rotationally-moving shaft 302 and the intermediate-transfer-body cleaning blade 210 also rotationally move in the clockwise direction in FIG. 8 in conjunction with rotational-movement of the lever 306, and finally, the intermediate-transfer-body cleaning blade 210 abuts against the intermediate transfer body 70 (moves up to the abutting position shown in FIG. 7). Further rotational-movement in the clockwise direction of the lever 306, the rotationally-moving shaft 302, and the intermediate-transfer-body cleaning blade 210 is restricted by abutting of the intermediate-transfer-body cleaning blade 210 against the intermediate transfer body 70.

When the lever 306 rotationally moves in the clockwise direction in FIG. 8, the rotationally-moving section 320 rotationally moves in the counterclockwise direction in FIG. 8 because of the urging force of the torsion spring. The upper seal 220 also rotationally moves in the counterclockwise direction in FIG. 8 in conjunction with rotational-movement of the rotationally-moving section 320, and finally, the upper seal 220 contacts the intermediate transfer body 70 (moves up to the contact position shown in FIG. 7). The intermediate-transfer-body cleaning unit 85 is furnished with a not-shown stopper for restricting rotational-movement of the rotationally-moving section 320 when the upper seal 220 contacts the intermediate transfer body 70, and thus the stopper restricts further rotational-movement of the upper seal 220 and the rotationally-moving section 320 in the counterclockwise direction. Note that, during this time, the first valve 226 which has kept the entrance of the ventilation opening 224 closed (FIG. 8) moves, to open the entrance of the ventilation opening 224 (FIG. 7). On the contrary, the second valve 228 which has kept the exit of the ventilation opening 224 opened (FIG. 8) moves, to close the exit of the ventilation opening 224 (FIG. 7).

Regarding Relationship Between Volume Change Rate of Intermediate-Transfer-Body Cleaning Unit 85 and Amount of Air Passing Through Ventilation Opening 224 According to First Embodiment As mentioned above, in the present embodiment, the intermediate-transfer-body cleaning blade 210 and the upper seal 220 are configured such that they can contact with and separate from the intermediate transfer body 70, and the intermediate-transfer-body cleaning blade 210 moves between the abutting position and the non-abutting position and the upper seal 220 moves between the contact position and the non-contact position. When either of the intermediate-transfer-body cleaning blade 210 and the upper seal 220 moves (contacts and separates), the volume of the intermediate-transfer-body cleaning unit 85 (that is, the volume of a section surrounded by the housing 202, the intermediate-transfer-body cleaning blade 210, the upper seal 220, the blade-supporting metal plate 212, and the seal supporting member 222 in FIGS. 3 and 4) changes. On the other hand, the intermediate-transfer-body cleaning unit 85 is furnished with the ventilation opening 224 and the valves 225, and the valves 225 adjust an amount of air passing through the ventilation opening 224.

Figure 11:
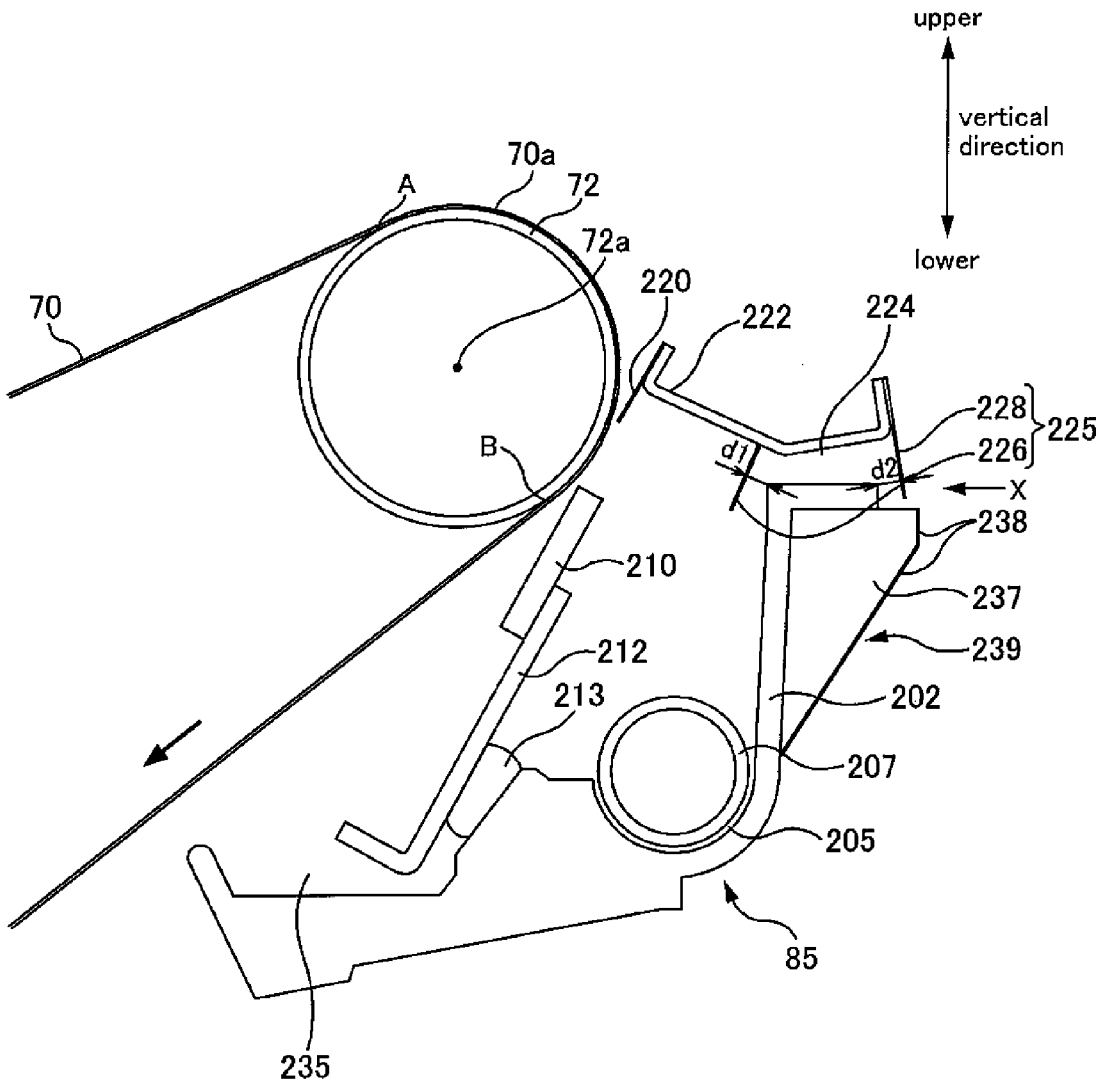
FIG. 11 is a (fourth) schematic diagram showing a cross-section of the intermediate-transfer-body cleaning unit 85 according to the first embodiment.
Figure 12:
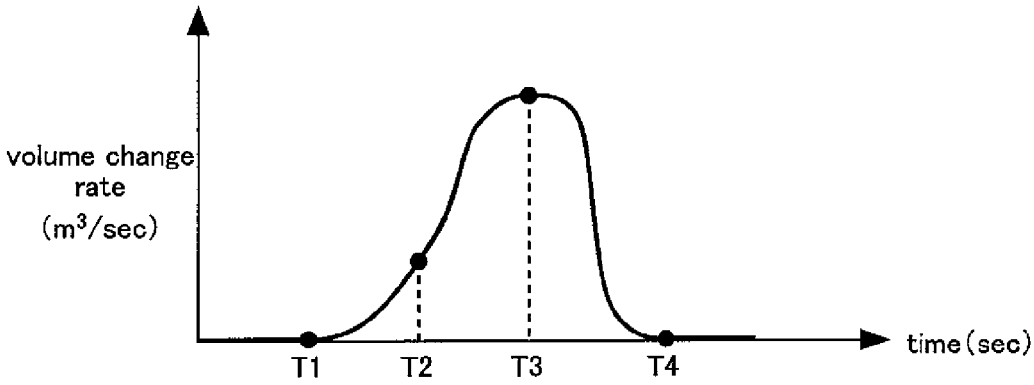
FIG. 12 is a (first) graph showing transition of the volume change rate of the intermediate-transfer-body cleaning unit 85.

The intermediate-transfer-body cleaning unit 85 according to the present embodiment is designed such that there is a certain relationship between the change rate of its volume (that is, an amount of change of the volume per unit time; hereinafter merely referred to as a volume change rate) and an amount of the air adjusted by the valves 225 (shapes, positions, etc. of the intermediate-transfer-body cleaning blade 210, the upper seal 220, the blade-supporting metal plate 212, the seal supporting member 222, the contacting/separating mechanism 300 etc. are determined). This section describes it with reference to FIGS. 3, 4, 11 and 12. FIG. 11 is a schematic diagram showing a cross-section of the intermediate-transfer-body cleaning unit 85 when a first distance d1 becomes equal to a second distance d2. FIG. 12 is a graph showing transition of the volume change rate of the intermediate-transfer-body cleaning unit 85.

First, an amount of air passing through the ventilation opening 224 is described. As mentioned above, the intermediate-transfer-body cleaning unit 85 according to the present embodiment is furnished with, as the valves 225, the first valve 226 provided inside the intermediate-transfer-body cleaning unit 85 and the second valve 228 provided outside the intermediate-transfer-body cleaning unit 85. Accordingly, in this case, an amount of air passing through the ventilation opening 224 depends on the smaller distance of: a first distance between the first valve 226 and the housing 202 (indicated by a symbol d1 in FIG. 11) and a second distance between the second valve 228 and the housing 202 (indicated by a symbol d2 in FIG. 11) (that is, an amount of air passing through the ventilation opening 224 is large if this smaller distance is large, and an amount of air passing through the ventilation opening 224 is small if this smaller distance is small).

Since the first distance d1 reaches the maximum and the second distance d2 is zero when the upper seal 220 is located at the contact position, the smaller distance is zero and air does not pass through the ventilation opening 224. And then, when, from this condition, the upper seal 220 separates from the intermediate transfer body 70 and starts moving to the non-contact position, the first distance d1 becomes gradually smaller and the second distance d2 becomes gradually larger. Therefore, the smaller distance (that is, the second distance d2) becomes gradually larger and an amount of air passing through the ventilation opening 224 becomes gradually larger.

If the upper seal 220 continues to move, the first distance d1 finally becomes equal to the second distance d2, as shown in FIG. 11. And then, at this time, the smaller distance reaches the maximum, and an amount of air passing through the ventilation opening 224 reaches the maximum. Thereafter, the smaller distance (that is, the first distance d1) becomes gradually smaller, and accordingly, an amount of air passing through the ventilation opening 224 becomes gradually smaller. Finally, the upper seal 220 reaches the non-contact position and the first distance d1 becomes zero (but the second distance d2 reaches the maximum). Accordingly, the smaller distance becomes zero, and air does not pass through the ventilation opening 224.

Next, the volume change rate is described with reference to FIG. 12. With the intermediate-transfer-body cleaning blade 210 being located at the abutting position and the upper seal 220 being located at the contact position (time T1 in FIG. 12), when the intermediate-transfer-body cleaning blade 210 separates from the intermediate transfer body 70 and starts moving to the non-abutting position, the volume change rate gradually increases. However, then, the volume change rate reaches the maximum at time T3, and thereafter, the volume change rate starts decreasing. After that, the volume change rate continues to decrease until the intermediate-transfer-body cleaning blade 210 and the upper seal 220 respectively reach the non-abutting position and the non-contact position (time T4 in FIG. 12).

Here, the relationship between the volume change rate and an amount of air passing through the ventilation opening 224 is considered. The valves 225 provided in the intermediate-transfer-body cleaning unit 85 according to the present embodiment adjust an amount of air passing through the ventilation opening 224 such that the amount reaches the maximum (that is, the smaller distance reaches the maximum) when the volume change rate reaches the maximum (time T3). Further, the valves 225 adjust an amount of air passing through the ventilation opening 224 such that the amount does not decrease when the volume change rate is increasing (that is, a period from time T1 to time T3) and such that the amount does not increase when the volume change rate is decreasing (that is, a period from time T3 to time T4).

Regarding Effectiveness of Printer According to First Embodiment

As mentioned above, in the printer 10 according to the present embodiment, because the valve 225 (the second valve 228) opens the closed ventilation opening 224 before either one of the intermediate-transfer-body cleaning blade 210 and the upper seal 220, whichever separates earlier from the intermediate transfer body 70 (the upper seal 220 in this example), starts separating therefrom, air can pass through the ventilation opening 224 when the member starting separating earlier (the upper seal 220) starts separating. As a result thereof, it is possible to achieve the printer 10, etc. which appropriately suppresses toner spillage.

In other words, as described in the section of "Problems to be solved by the Invention", in a heretofore printer 10, in the normal state in which the intermediate-transfer-body cleaning blade 210 abuts against the intermediate transfer body 70, and in which the upper seal 220 contacts the intermediate transfer body 70, the valves 225 keep the ventilation opening 224 closed such that air cannot pass through the ventilation opening 224. In addition, when either one of the intermediate-transfer-body cleaning blade 210 and the upper seal 220, whichever separates earlier from the intermediate transfer body 70 (for example, the upper seal 220), starts separating therefrom, the above-mentioned condition remains maintained. In this case, when the member starting separating earlier (for example, the upper seal 220) starts separating, high air pressure in the intermediate-transfer-body cleaning unit 85 causes a problem that toner is spilled from between the member and the intermediate transfer body 70.

In contrast, in the present embodiment, air can pass through the ventilation opening 224 when either one of the intermediate-transfer-body cleaning blade 210 and the upper seal 220, whichever separates earlier from the intermediate transfer body 70 (the upper seal 220), starts separating therefrom. Therefore, air pressure in the intermediate-transfer-body cleaning unit 85 becomes lower when the member starting separating earlier (the upper seal 220) starts separating. This results in appropriate suppression of toner spillage from between the member (the upper seal 220) and the intermediate transfer body 70.

Further, the following effect is produced because the volume change rate and an amount of air passing through the ventilation opening 224 have the above-mentioned relationship. More specifically, airflow occurs in the intermediate-transfer-body cleaning unit 85 when the volume changes, and the airflow moves toner in the intermediate-transfer-body cleaning unit 85, to cause a problem that the toner is spilled from between the separated intermediate-transfer-body cleaning blade 210 and intermediate transfer body 70. It is desirable that the valves 225 adjust an amount of the air, to minimize an amount of the spilled toner.

In contrast, in the present embodiment, since an amount of air passing through the ventilation opening 224 reaches the maximum when the volume change rate reaches the maximum, an amount of air passing through the ventilation opening 224 reaches the maximum and air pressure in the intermediate-transfer-body cleaning unit 85 become lowest when airflow occurs most significantly by great change of the volume, that is, when toner spills most easily from between the separated intermediate-transfer-body cleaning blade 210 and intermediate transfer body 70. Accordingly, in the printer 10 according to the present embodiment, toner spillage is appropriately suppressed. Besides, in the present embodiment, in a case where the volume does not change greatly and airflow does not occur significantly (that is, in a case where toner spillage from between the separated intermediate-transfer-body cleaning blade 210 and intermediate transfer body 70 tends to be insignificant), since an amount of air passing through the ventilation opening 224 does not become so large, this reduces the occurrence of a problem that toner passes through the ventilation opening 224 together with air.

Further, in the present embodiment, when the volume change rate increases (that is, in a condition in which airflow becomes more likely to occur), an amount of air passing through the ventilation opening 224 does not become smaller, and when the volume change rate decreases (that is, in a condition in which airflow becomes less likely to occur), an amount of air passing through the ventilation opening 224 does not become larger. This suppresses toner spillage more appropriately.

Furthermore, in the printer 10 according to the present embodiment, after the upper seal 220 located at the contact position starts moving to the non-contact position, the intermediate-transfer-body cleaning blade 210 located at the abutting position starts moving to the non-abutting position. As a result thereof, it is possible to achieve the printer 10, etc. which appropriately suppresses toner spillage.

More specifically, in a heretofore printer 10, when the upper seal 220 located at the contact position starts moving to the non-contact position, the intermediate-transfer-body cleaning blade 210 is separated from the intermediate transfer body 70. This causes a problem that toner which flies when the upper seal 220 starts moving (toner, etc. which is located between the upper seal 220 and the intermediate transfer body 70) is spilled from between the intermediate-transfer-body cleaning blade 210 and the intermediate transfer body 70. The problem causes the spilled toner to adhere to a portion located on the downstream side of the intermediate transfer body 70 relative to the intermediate-transfer-body cleaning blade 210.

In contrast, in the present embodiment, since the intermediate-transfer-body cleaning blade 210 located at the abutting position starts moving to the non-abutting position after the upper seal 220 located at the contact position starts moving to the non-contact position, the intermediate-transfer-body cleaning blade 210 is still abutting against the intermediate transfer body 70 when the upper seal 220 starts moving to the non-contact position. Accordingly, a problem is not caused that toner which flies when the upper seal 220 starts moving (toner, etc. which is located between the upper seal 220 and the intermediate transfer body 70) is spilled from between the intermediate-transfer-body cleaning blade 210 and the intermediate transfer body 70. This suppresses toner spillage from the gap appropriately. Also, it is possible to appropriately avoid a problem that the spilled toner adheres to a portion located on the downstream side of the intermediate transfer body 70 relative to the intermediate-transfer-body cleaning blade 210.

Other Embodiments According to First Embodiment

In the above-mentioned embodiment, the intermediate transfer body 70 which moves toner by rotating with the toner being borne thereon in order to transfer the toner on a recording material (a medium) is described as an example of a developer moving element, and the intermediate-transfer-body cleaning unit 85 for collecting toner which has not been transferred onto the recording material and remains on the intermediate transfer body 70 is described as an example of a collector. However, this invention is not limited thereto. For example, a developer moving element can be the photoconductor 20 which moves toner in order to transfer the toner onto the intermediate transfer body 70 (serves as an intermediate medium) by rotating with the toner being borne on the photoconductor, and a collector can be the photoconductor cleaning unit 75 for collecting toner which has not been transferred onto the intermediate transfer body 70 and remains on the photoconductor 20. Further, in such a case, the present invention is also applicable to a laser printer which is not of the intermediate transferring type.

Further, in the above description, the following intermediate-transfer-body cleaning unit 85 is described as an example of an intermediate-transfer-body cleaning unit 85 in which air can pass through its ventilation opening 224 when either one of the intermediate-transfer-body cleaning blade 210 and the upper seal 220, whichever separates earlier from the intermediate transfer body 70 (the upper seal 220), starts separating: an intermediate-transfer-body cleaning unit 85 wherein the valves 225 thereof (the second valve 228) keep the ventilation opening 224 closed (air cannot pass through the ventilation opening 224) in the normal state in which the intermediate-transfer-body cleaning blade 210 abuts against the intermediate transfer body 70 and the upper seal 220 contacts the intermediate transfer body 70 and wherein the valves 225 (the second valve 228) open the closed ventilation opening 224 before the member starting separating earlier (the upper seal 220) starts separating from the intermediate transfer body 70. However, this invention is not limited thereto. For example, the following intermediate-transfer-body cleaning unit 85 is also acceptable: an intermediate-transfer-body cleaning unit 85 wherein air can pass through the ventilation opening 224 in the normal state in which the intermediate-transfer-body cleaning blade 210 abuts against the intermediate transfer body 70 and the upper seal 220 contacts the intermediate transfer body 70 and wherein air can pass through the ventilation opening 224 also when the member starting separating earlier (the upper seal 220) starts separating from the intermediate transfer body 70.

However, since air cannot pass through the ventilation opening 224 in the normal state in which the intermediate-transfer-body cleaning blade 210 abuts against the intermediate transfer body 70 and the upper seal 220 contacts the intermediate transfer body 70, it is possible in the normal state to avoid the occurrence of a problem that toner passes through the ventilation opening 224 together with air. Considering this point, the above-mentioned embodiment is more desirable.

Further, as an example of the intermediate-transfer-body cleaning unit 85 in which air can pass through the ventilation opening 224 in the above-mentioned normal state, and in which air can pass through the ventilation opening 224 when the member starting separating earlier (the upper seal 220) starts separating from the intermediate transfer body 70, an intermediate-transfer-body cleaning unit 85 can be considered in which the second valve 228 does not contact the housing 202 in a state shown in FIG. 3 (used as a comparison example). However, the following two examples (herein referred to as first and second modified examples respectively) are more desirable.

An intermediate-transfer-body cleaning unit 85 according to the first modified example is an intermediate-transfer-body cleaning unit 85 in which the valves 225 thereof keep the ventilation opening 224 closed when the member starting separating earlier starts separating from the intermediate transfer body 70 and in which the valves 225 are breathable (the valves 225 are made of, for example, a sponge, a porous filter and the like). Since, also in this example, air can pass through the ventilation opening 224 when the member starting separating earlier starts separating from the intermediate transfer body 70, air pressure in the intermediate-transfer-body cleaning unit 85 becomes lower when the member starting separating earlier starts separating. This appropriately suppresses toner spillage from between the member and the intermediate transfer body 70.

Figure 13:
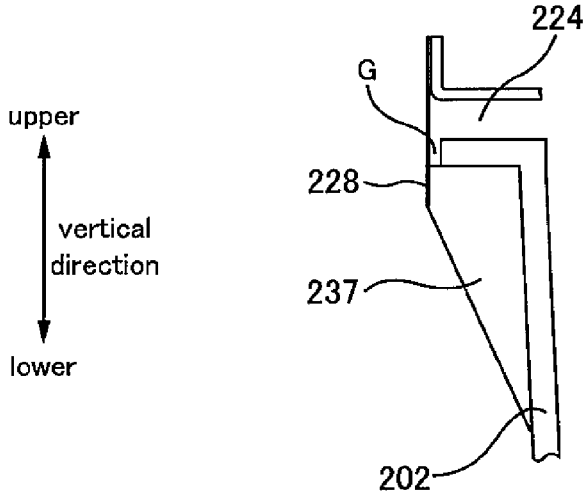
FIG. 13 is a cross-section schematic diagram according to the second modified example of the first embodiment showing the vicinity of the second valve 228 provided on the intermediate-transfer-body cleaning unit 85.

An intermediate-transfer-body cleaning unit 85 according to the second modified example is an intermediate-transfer-body cleaning unit 85 having the following configuration. The intermediate-transfer-body cleaning unit 85 according to the second modified example is described with reference to FIG. 13. FIG. 13 is a cross-section schematic diagram according to the second modified example showing the vicinity of the second valve 228 provided on the intermediate-transfer-body cleaning unit 85.

As can be seen from FIG. 13, in the second modified example, unlike the above-mentioned embodiment (FIG. 3), a gap G is provided between the housing 202 and the second valve 228, and the second valve 228 can contact a plurality of the ribs 237 for reinforcement provided on the housing 202. When the member starting separating earlier starts separating from the intermediate transfer body 70, the second valve 228 does not keep the ventilation opening 224 closed and contacts the ribs 237.

Since, also in this example, air can pass through the ventilation opening 224 when the member starting separating earlier starts separating from the intermediate transfer body 70, air pressure in the intermediate-transfer-body cleaning unit 85 becomes lower when the member starting separating earlier starts separating. This appropriately suppresses toner spillage from between the member and the intermediate transfer body 70.

In the first and second modified examples, unlike the above-mentioned comparison example, a condition is ensured in which air can pass through the ventilation opening 224 with the valves 225 contacting a member (the housing 202 in the first modified example, and the ribs 237 in the second modified example), regardless of whether the valves 225 keep the ventilation opening 224 closed or not. Therefore, it is impossible to cause a problem that the valves 225 intercept the path of air by mistake (by contacting the member). Considering this point, the first and second modified examples are more desirable.

Figure 14:
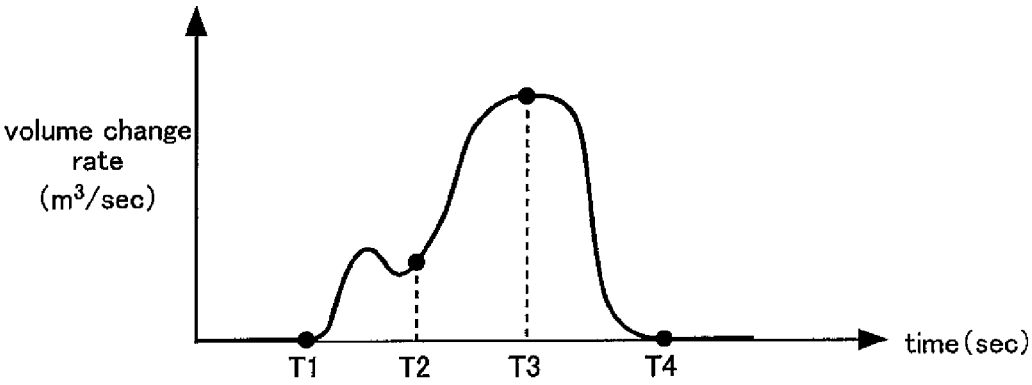
FIG. 14 is a (second) graph showing transition of the volume change rate of the intermediate-transfer-body cleaning unit 85.

Further, in the above-mentioned embodiment, when the volume change rate is increasing, the valves 225 adjust an amount of air passing through the ventilation opening 224 such that the amount does not decrease, and when the volume change rate is decreasing, the valves 225 adjust the amount such that the amount does not increase. However, this invention is not limited thereto. For example, it is possible for the valves 225 to adjust an amount of air passing through the ventilation opening 224 when the volume change rate is decreasing such that air passing through the ventilation opening 224 increases, as shown in FIG. 14.

Further, in the above-mentioned embodiment, the intermediate-transfer-body cleaning unit 85 includes the seal supporting member 222 which supports the upper seal 220 and is movable together with the upper seal 220, and the valves 225 are provided on the seal supporting member 222. However, this invention is not limited thereto. For example, it is possible that the valves 225 are not provided on the seal supporting member 222.

If the upper seal 220 which relates to whether the volume change rate is large or small and the valves 225 which adjust an amount of air passing through the ventilation opening 224 are provided on a common member (the seal supporting member 222), it is possible to easily construct a printer 10 having the above-mentioned relationship between the volume change rate and an amount of air passing through the ventilation opening 224, that is, a printer 10 appropriately suppressing toner spillage. Considering this point, the above-mentioned embodiment is more desirable.

Further, in the above-mentioned embodiment, the upper seal 220 moves in conjunction with movement of the intermediate-transfer-body cleaning blade 210, but this invention is not limited thereto. For example, it is possible that the upper seal 220 and the intermediate-transfer-body cleaning blade 210 move independently.

The intermediate-transfer-body cleaning blade 210 relates to whether the volume change rate is large or small. Therefore, if the upper seal 220 moves in conjunction with movement of the intermediate-transfer-body cleaning blade 210, it is possible to easily construct a printer 10 having the above-mentioned relationship between the volume change rate and an amount of air passing through the ventilation opening 224, that is, a printer 10 appropriately suppressing toner spillage. Considering this point, the above-mentioned embodiment is more desirable.

Second Embodiment

Figure 15:
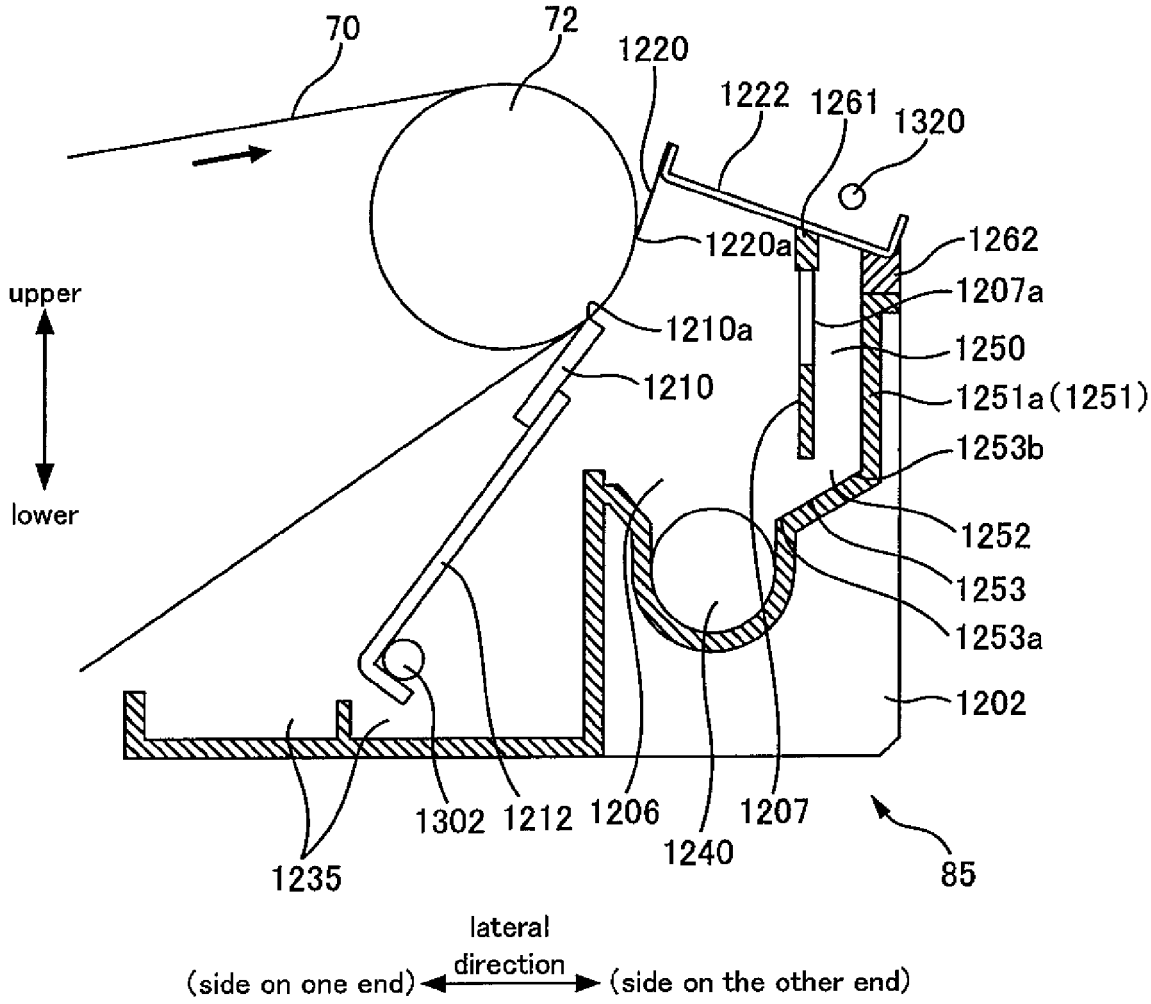
FIG. 15 is a cross-sectional view according to the second embodiment showing the intermediate-transfer-body cleaning unit 85 when an intermediate-transfer-body cleaning blade 1210 and an upper seal 1220 abut against an intermediate transfer body 70.
Figure 16:
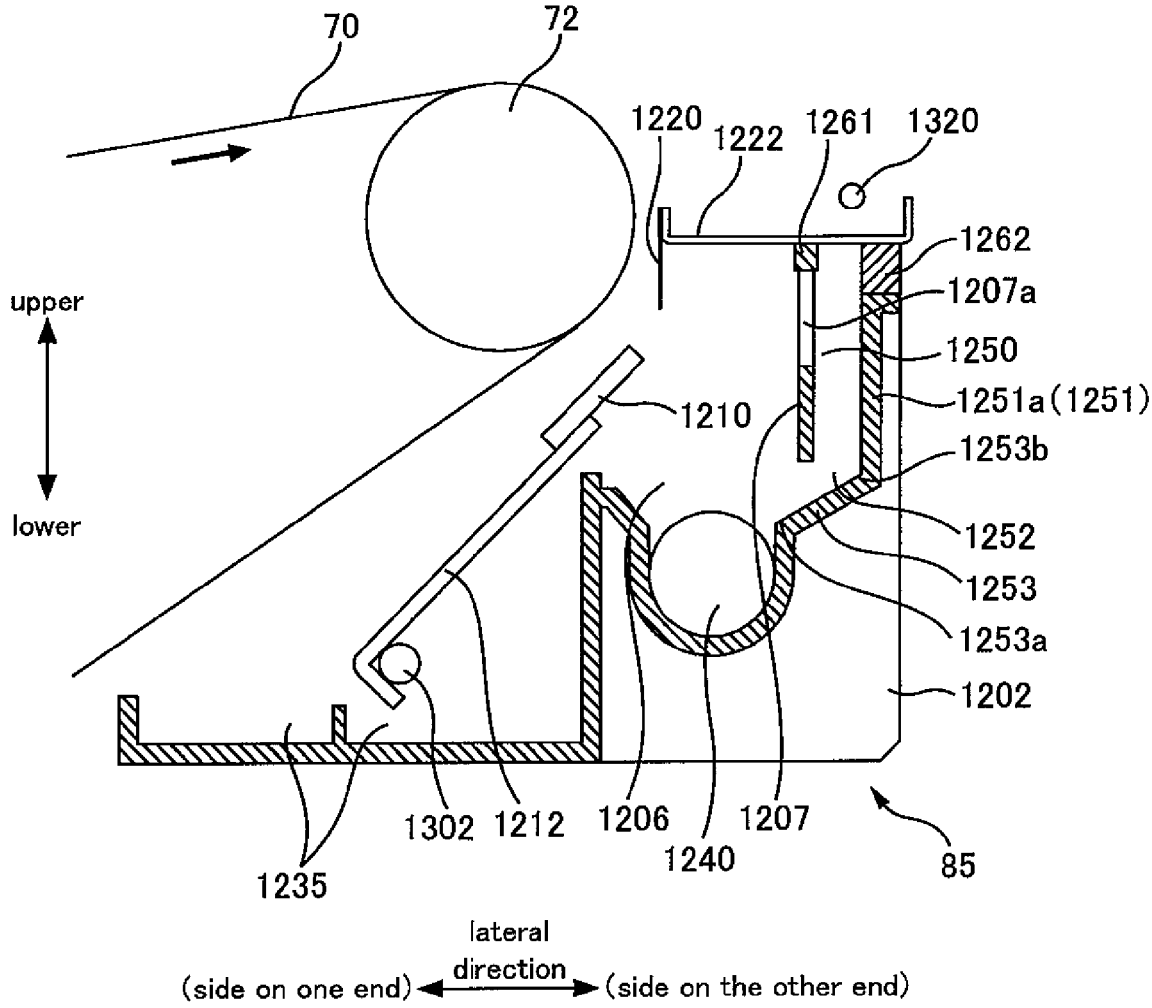
FIG. 16 is a cross-sectional view according to the second embodiment showing the intermediate-transfer-body cleaning unit 85 when the intermediate-transfer-body cleaning blade 1210 and the upper seal 1220 are separated from the intermediate transfer body 70.
Figure 17:
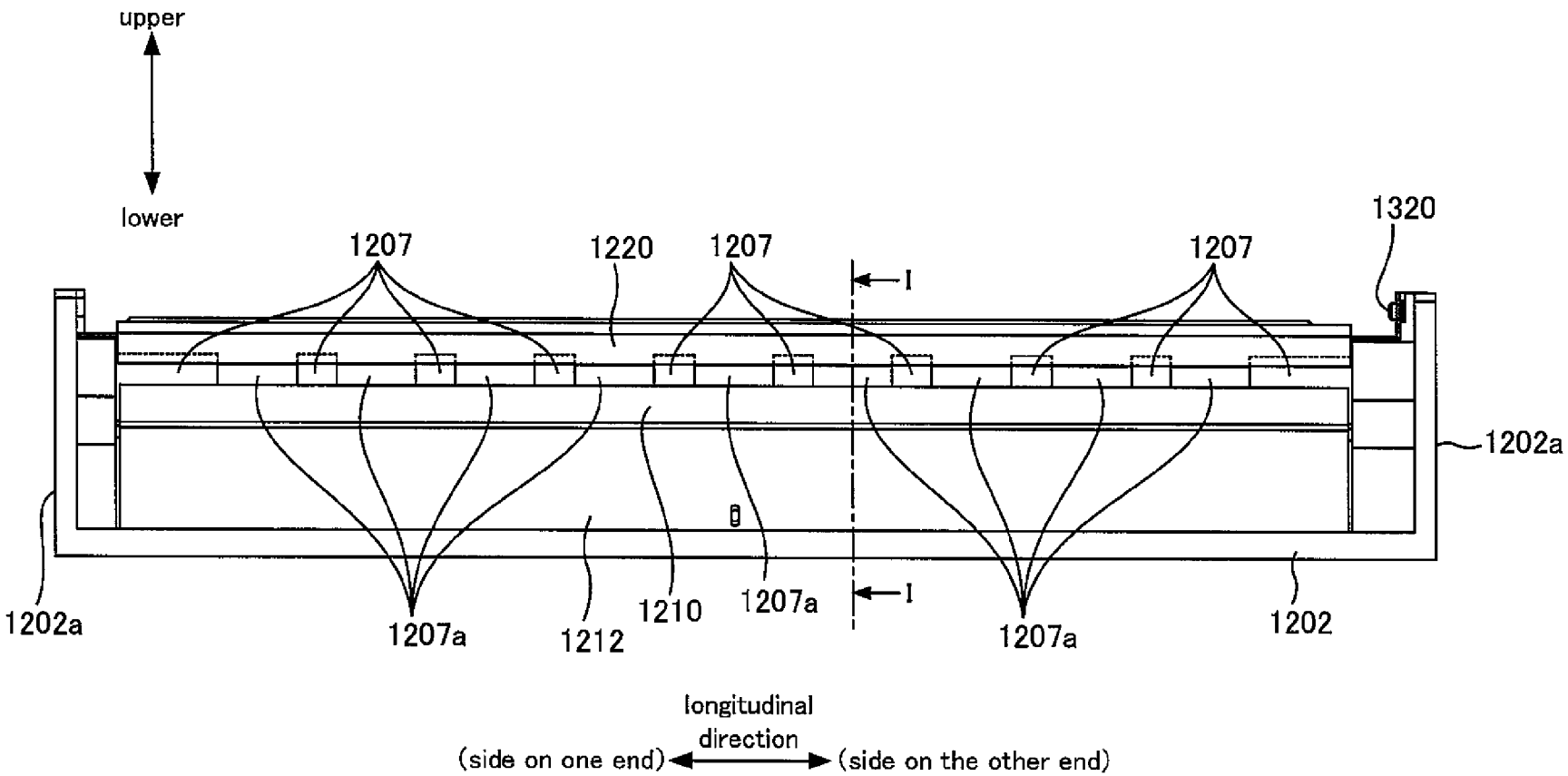
FIG. 17 is a front view showing the intermediate-transfer-body cleaning unit 85 according to the second embodiment.
Figure 18:
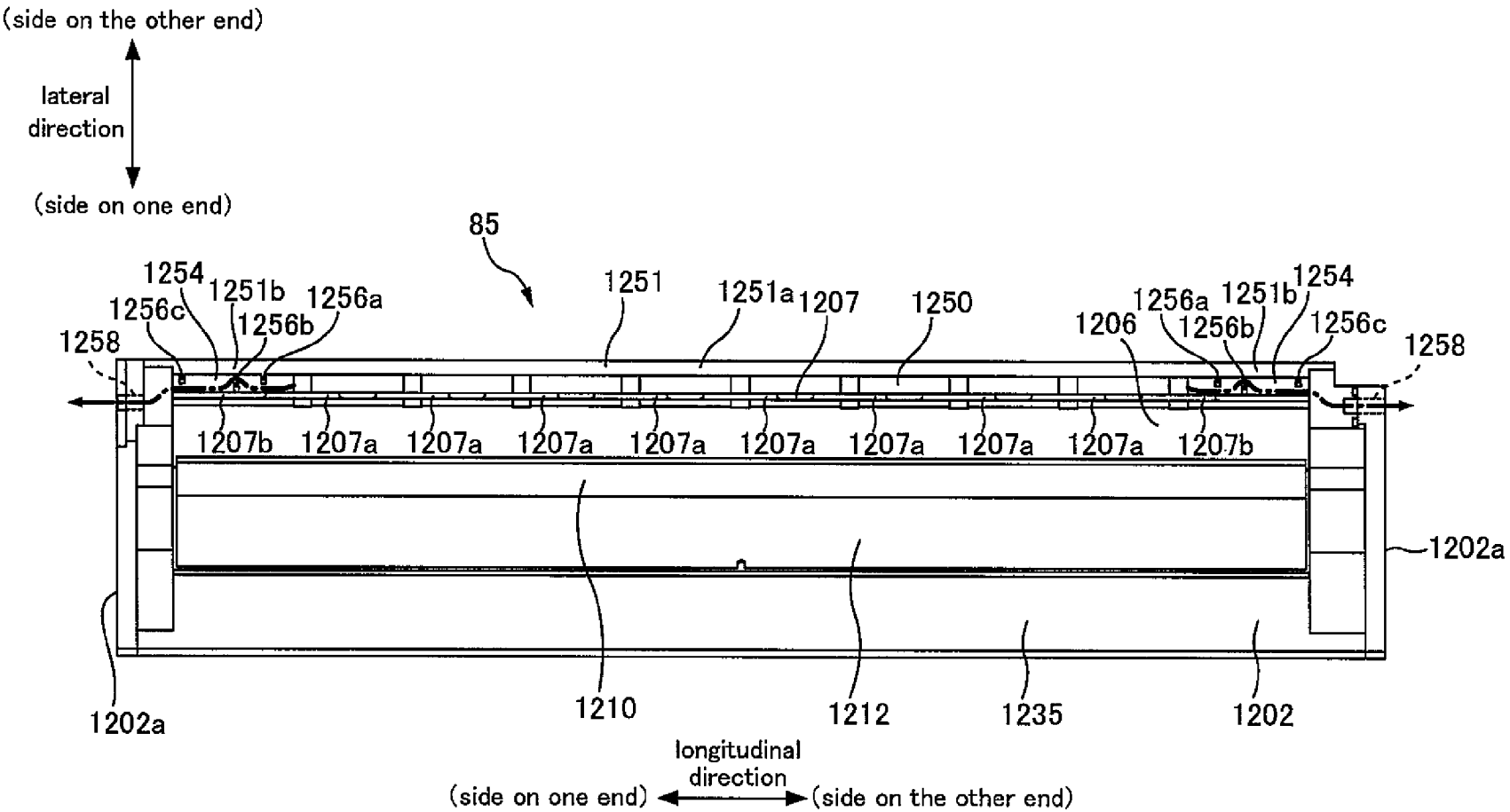
FIG. 18 is a top view showing the intermediate-transfer-body cleaning unit 85 according to the second embodiment.
Figure 19:
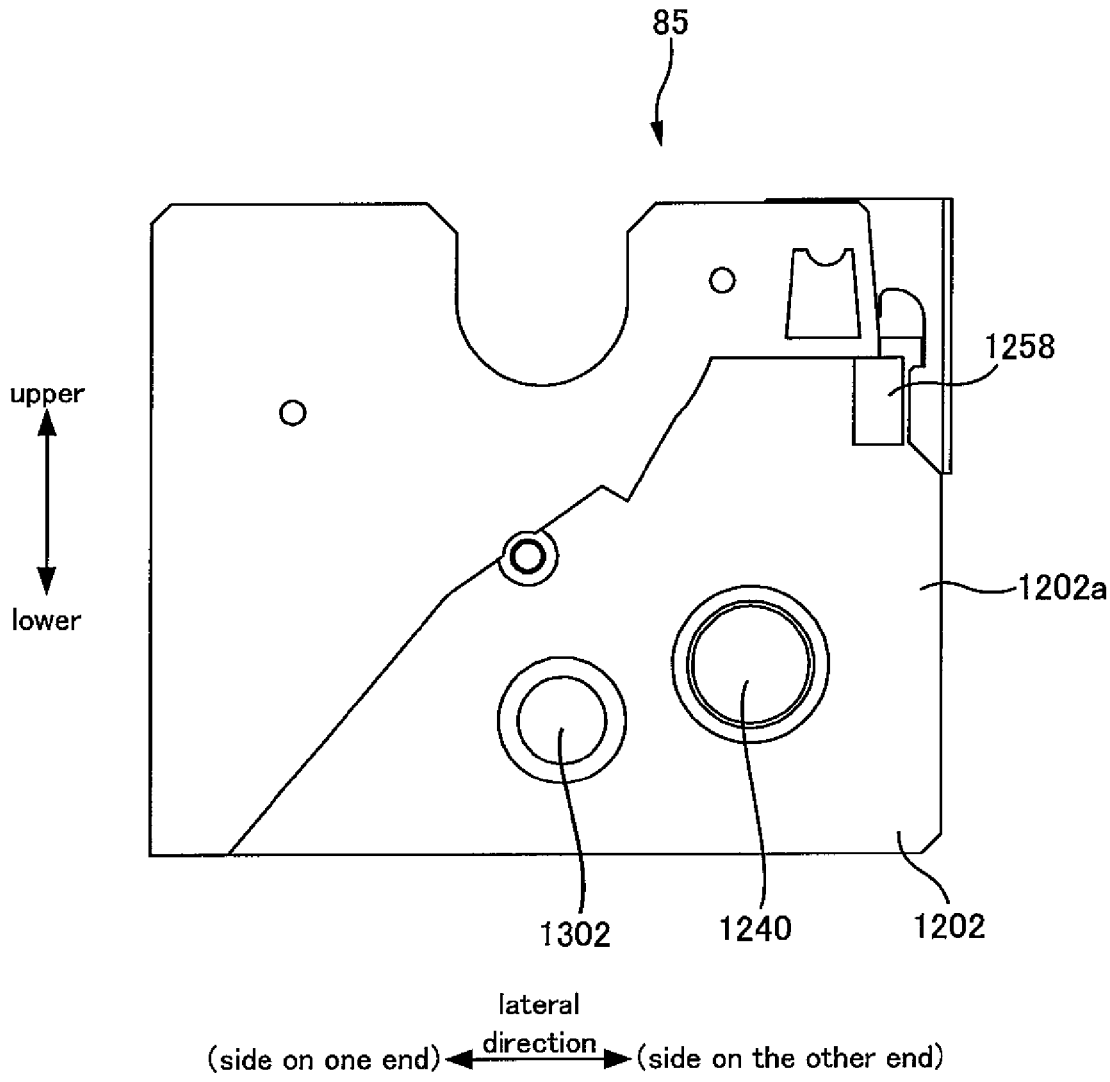
FIG. 19 is a side view showing the intermediate-transfer-body cleaning unit 85 according to the second embodiment.

Example of Configuration of Intermediate-Transfer-Body Cleaning Unit 85 According to Second Embodiment An example of a configuration of the intermediate-transfer-body cleaning unit 85 is described with reference to FIGS. 15 through 19. FIG. 15 is a cross-sectional view showing the intermediate-transfer-body cleaning unit 85 when an intermediate-transfer-body cleaning blade 1210 and an upper seal 1220 abut against the intermediate transfer body 70. FIG. 16 is a cross-sectional view showing the intermediate-transfer-body cleaning unit 85 when the intermediate-transfer-body cleaning blade 1210 and the upper seal 1220 are separated from the intermediate transfer body 70. FIG. 17 is a front view showing the intermediate-transfer-body cleaning unit 85. FIG. 18 is a top view showing the intermediate-transfer-body cleaning unit 85. FIG. 19 is a side view showing the intermediate-transfer-body cleaning unit 85.

Note that FIGS. 15 and 16 are cross-sectional views taken along line I-I of FIG. 17. Further, in FIG. 18, the upper seal 1220, a first sealing member 1261, a second sealing member 1262 and a carry screw 1240 are not shown. In FIGS. 15, 16, 17, and 19, the vertical direction is indicated by an arrow, in the same manner as FIG. 1. In FIGS. 15, 16, 18, and 19, the lateral direction of the intermediate-transfer-body cleaning unit 85 is indicated by an arrow, and in FIGS. 17 and 18, the longitudinal direction of the intermediate-transfer-body cleaning unit 85 is indicated by an arrow.

The intermediate-transfer-body cleaning unit 85 is for collecting toner which has not been transferred onto a recording material and remains on the intermediate transfer body 70, as shown in FIG. 15 and the like. The intermediate-transfer-body cleaning unit 85 includes a case 1202, a toner containing chamber 1206 which serves as an example of a containing chamber, the intermediate-transfer-body cleaning blade 1210, the upper seal 1220, a toner receiver 1235, a gathering chamber 1250 and the like. Note that, in the intermediate-transfer-body cleaning unit 85 according to the present embodiment, the intermediate-transfer-body cleaning blade 1210 and the upper seal 1220 serve as "abutting/separating members" which can abut against and separate from the intermediate transfer body 70.

The case 1202 operates in cooperation with the upper seal 1220, to prevent the collected toner from spilling outside the intermediate-transfer-body cleaning unit 85. The toner containing chamber 1206, the gathering chamber 1250, the toner receiver 1235 and the intermediate-transfer-body cleaning blade 1210 are formed in the case 1202.

The intermediate-transfer-body cleaning blade 1210 has the function of scraping toner on the intermediate transfer body 70 (that is, toner which moves with the rotation of the intermediate transfer body 70) by abutting against the intermediate transfer body 70, as shown in FIG. 15. The intermediate-transfer-body cleaning blade 1210 is an approximately 2 mm thick rubber blade. The intermediate-transfer-body cleaning blade 1210 is arranged such that its front end faces toward the upstream side of the rotating direction of the intermediate transfer body 70. Note that a blade abutting section 1210*a* at which the intermediate-transfer-body cleaning blade 1210 abuts against the intermediate transfer body 70 (FIG. 15) is located below the above-mentioned central axis of the driven roller 72 in the vertical direction.

Further, the intermediate-transfer-body cleaning blade 1210 is configured such that it can contact with and separate from the intermediate transfer body 70, as shown in FIGS. 15 and 16. More specifically, the intermediate-transfer-body cleaning blade 1210 is secured to a rotationally-moving shaft 1302 through a blade-supporting metal plate 1212 supporting the blade 1210, and the intermediate-transfer-body cleaning blade 1210 moves back and forth between a blade abutting position (a position shown in FIG. 15) and a blade non-abutting position (a position shown in FIG. 16) by back-and-forth rotational movement of the rotationally-moving shaft 1302 between the first rotated position and the second rotated position.

The toner containing chamber 1206 is for containing toner. Specifically, the toner containing chamber 1206 is for containing toner scraped by the intermediate-transfer-body cleaning blade 1210 located thereabove.

Besides, notches 1207*a* are formed in the upper section of a containing-chamber wall 1207 of the toner containing chamber 1206, the containing-chamber wall 1207 being located opposite the intermediate-transfer-body cleaning blade 1210. The notches 1207*a* have the function of a ventilation opening (a first ventilation opening) which moves air in the toner containing chamber 1206 outside the toner containing chamber 1206 (that is, the gathering chamber 1250). Further, the notches 1207*a* are rectangular notches as shown in FIGS. 17 and 18, and a plural of the notches 1207*a* are formed along the longitudinal direction of the intermediate-transfer-body cleaning unit 85 on a central portion thereof in the longitudinal direction.

Furthermore, the toner containing chamber 1206 has the carry screw 1240, which serves as an example of a carrying member, below the toner containing chamber 1206. The carry screw 1240 rotates toward a predetermined direction, to carry toner contained in the toner containing chamber 1206 to the waste toner box. In this way, toner in the toner containing chamber 1206 is carried by the carry screw 1240, so that an amount of the toner in the toner containing chamber 1206 does not exceed a certain value. Note that, in the present embodiment, the toner containing chamber 1206 serves as a "first containing chamber" and the waste toner box serves as a "second containing chamber".

Note that the waste toner box is attachable to and detachable from the printer 10, and that the waste toner box is removed from the printer 10 by a user, etc. when the carry screw 1240 carries toner in the toner containing chamber 1206 and an amount of the toner in the waste toner box increases. A waste toner box which does not contain toner is attached to the printer 10 by a user, etc.

The gathering chamber 1250 is located farther apart from the intermediate-transfer-body cleaning blade 1210 in the lateral direction than the toner containing chamber 1206, as shown in FIGS. 15 and 16, and is for gathering toner which moves from the inside of the toner containing chamber 1206 to the gathering chamber 1250 (the outside of the toner containing chamber 1206) passing through the notches 1207*a*. The gathering chamber 1250 is located opposite the containing-chamber wall 1207 and has a gathering-chamber wall 1251 along the longitudinal direction. A central portion of the gathering-chamber wall 1251 in the longitudinal direction (hereinafter referred to as a gathering-chamber-wall central portion 1251*a*) has the function of an opposite wall which is located opposite the notches 1207*a* outside the notches 1207*a*.

Besides, as shown in FIGS. 15 and 16, a bottom section 1252 of the gathering chamber 1250 is in communication with the lower section of the toner containing chamber 1206. Specifically, the bottom section 1252 slants and is in communication with the toner containing chamber 1206 such that one end portion 1253*a* of the bottom surface 1253 of the bottom section 1252 is located vertically below the other end portion 1253*b* of the bottom surface 1253; the one end portion 1253*a* serves as an example of an end on the side of the toner containing chamber 1206 and the other end portion 1253*b* serves as an example of an end opposite the one end portion 1253*a*.

Further, as shown in FIG. 18, the gathering chamber 1250 has ventilation paths 1254 on both ends in the longitudinal direction, and the ventilation paths 1254 serve as an example of a second ventilation opening. The ventilation paths 1254 are for moving air which moves from the inside of the toner containing chamber 1206 to the outside of the toner containing chamber 1206 (that is, to the gathering chamber 1250) passing through the notches 1207*a*, to the outside of the case 1202 (the intermediate-transfer-body cleaning unit 85).

In the ventilation paths 1254, as shown in FIG. 18, three ribs 1256*a*, 1256*b*, and 1256*c* (projecting sections) are alternately formed on two surfaces which are located opposite each other along the longitudinal direction (that is, a surface of a gathering-chamber-wall end portion 1251*b* located at an end of the gathering-chamber wall 125 in the longitudinal direction and a surface of a containing-chamber-wall end portion 1207*b* located at an end of the containing-chamber wall 1207 in the longitudinal direction) These three ribs 1256*a*, 1256*b*, and 1256*c* are for restricting movement of the toner in the ventilation paths 1254 toward either of the ends in the longitudinal direction. Note that a spacing between two ribs from among the three ribs 1256*a*, 1256*b*, and 1256*c* located on a central portion in the longitudinal direction (that is, the first rib 1256*a* and the second rib 1256*b*) is narrower than a spacing between two ribs located closer to the ends in the longitudinal direction (that is, the second rib 1256*b* and the third rib 1256*c*).

Further, the ventilation paths 1254 are connected to an opening 1258 provided in a side surface 1202*a* of the case 1202, and air moving to either of the ends in the longitudinal direction in the ventilation paths 1254 moves outside the case 1202 (the intermediate-transfer-body cleaning unit 85) passing through the opening 1258.

The toner receiver 1235 has a function of receiving toner which has not been contained in the toner container 1205 and which moves to the side opposite the toner container 1205 relative to the intermediate-transfer-body cleaning blade 1210. The toner receiver 1235 is formed in the lower section of the case 1202 and on the side opposite the toner container 1205 relative to the intermediate-transfer-body cleaning blade 1210 (the side of the photoconductor 20).

The upper seal 1220 is located above the intermediate-transfer-body cleaning blade 1210 and the toner container 1205 in the vertical direction, and prevents the collected toner, from spilling outside the intermediate-transfer-body cleaning unit 85 by abutting against the intermediate transfer body 70 at a seal abutting section 1220*a*. The upper seal 1220 is an approximately 120 μm thick sheet-like member. The upper seal 1220 is arranged such that its front end faces toward the downstream side of the rotating direction of the intermediate transfer body 70.

Further, in the same way as the intermediate-transfer-body cleaning blade 1210, the upper seal 1220 is configured such that it can contact with and separate from the intermediate transfer body 70. More specifically, the upper seal 1220 is secured to a rotationally-moving section 1320 through a seal supporting member 1222 supporting the seal 1220, and the upper seal 1220 moves back and forth between a seal abutting position (a position shown in FIG. 15) and a seal non-abutting position (a position shown in FIG. 16) by back-and-forth rotational movement of the rotationally-moving section 1320 between the first rotated position and the second rotated position. Furthermore, in the present embodiment, the upper seal 1220 moves in conjunction with movement of the intermediate-transfer-body cleaning blade 1210, and therefore, when the intermediate-transfer-body cleaning blade 1210 moves from the blade abutting position to the blade non-abutting position, the upper seal 1220 moves from the seal abutting position to the seal non-abutting position, and when the intermediate-transfer-body cleaning blade 1210 moves from the blade non-abutting position to the blade abutting position, the upper seal 1220 moves from the seal non-abutting position to the seal abutting position.

Further, as shown in FIGS. 15 and 16, the first sealing member 1261 is provided between the seal supporting member 1222 and the containing-chamber wall 1207 along the longitudinal direction. The first sealing member 1261 has the function of separating the toner container 1205 into the toner containing chamber 1206 and the gathering chamber 1250 in cooperation with the containing-chamber wall 1207 by contacting the seal supporting member 1222 and the upper section of the containing-chamber wall 1207 (expect for the notches 1207*a*). The first sealing member 1261 is made of sponge, etc., and extends and contracts keeping in contact with the seal supporting member 1222 and the containing-chamber wall 1207, in conjunction with rotational-movement of the rotationally-moving shaft 1302, as shown in FIGS. 15 and 16.

Moreover, as shown in FIGS. 15 and 16, the second sealing member 1262 is provided between the seal supporting member 1222 and the gathering-chamber wall 1251 along the longitudinal direction. The second sealing member 1262 contacts the seal supporting member 1222 and the upper section of the gathering-chamber wall 1251, to prevent toner in the gathering chamber 1250 from spilling. The second sealing member 1262 is made of sponge, etc., and extends and contracts keeping in contact with the seal supporting member 1222 and the gathering-chamber wall 1251, in conjunction with rotational-movement of the rotationally-moving section 1320, as shown in FIGS. 15 and 16.

Here, a positional relationship between the intermediate-transfer-body cleaning blade 1210, the upper seal 1220, the containing-chamber wall 1207 (the notches 1207*a*), and the gathering-chamber wall 1251 (the gathering-chamber-wall central portion 1251*a*) is described. As shown in FIGS. 15 and 16, the intermediate-transfer-body cleaning blade 1210 and the upper seal 1220 are located opposite the notches 1207*a* on the side opposite the gathering-chamber-wall central portion 1251*a* relative to the notches 1207*a*.

Regarding Movement of Air in Intermediate-Transfer-Body Cleaning Unit 85 According to Second Embodiment, and Toner Condition in Conjunction with Air Movement This section describes flow of air which moves from the inside of the toner containing chamber 1206 to the outside of the case 1202 passing through the gathering chamber 1250 when the intermediate-transfer-body cleaning blade 1210 and the upper seal 1220 separate from the intermediate transfer body 70. In addition, toner condition in movement of the air is also described.

When the intermediate-transfer-body cleaning blade 1210 and the upper seal 1220 separate from the intermediate transfer body 70, air in the toner containing chamber 1206 partially passes through the notches 1207*a* in order to move outside the toner containing chamber 1206. In this case, toner in the toner containing chamber 1206 may pass through the notches 1207*a* with movement of the air, and for example, toner which has been flying around either of the intermediate-transfer-body cleaning blade 1210 and the upper seal 1220 may pass through the notches 1207*a*.

Air passing through the notches 1207*a* further moves, to strike the gathering-chamber-wall central portion 1251*a* located opposite the notches 1207*a*. At this time, toner passing through the notches 1207*a* also strikes the gathering-chamber-wall central portion 1251*a*. Then, toner which has struck the gathering-chamber-wall central portion 1251*a* partially drops toward the bottom section 1252 of the gathering chamber 1250 because of the weight of the toner itself, and is gathered into the gathering chamber 1250.

Apart of air which has struck the gathering-chamber-wall central portion 1251*a* further moves within the ventilation paths 1254. Then, air in the ventilation paths 1254 passes through the opening 1258, and moves outside the case 1202 (the intermediate-transfer-body cleaning unit 85). Note that the ribs 1256*a*, 1256*b*, and 1256*c* provided on the ventilation paths 1254 restrict movement of the toner moving within the ventilation paths 1254.

Regarding Effectiveness of Printer According to Second Embodiment

As mentioned above, in the image forming apparatus according to the present embodiment (the printer 10), its collector (the intermediate-transfer-body cleaning unit 85) has an opposite wall (the gathering-chamber-wall central portion 1251*a*) which is located opposite the notches 1207*a* outside the ventilation opening (the notches 1207*a*). This enables to achieve a printer 10 which can suppress diffusion of toner passing through the notches 1207*a*. The section below describes it in detail.

In the intermediate-transfer-body cleaning unit 85, it is desirable to prevent air pressure in the toner containing chamber 1206 containing toner from rising. The reason is that there are cases in which the following occurs, for example: if air pressure in the toner containing chamber 1206 rises, when the intermediate-transfer-body cleaning blade 1210 or the upper seal 1220 separates from the intermediate transfer body 70, toner in the toner containing chamber 1206 passes through a gap between the cleaning blade 1210 and the intermediate transfer body 70 or a gap between the upper seal 1220 and the intermediate transfer body 70, to adhere to other units by moving outside the intermediate-transfer-body cleaning unit 85 and to finally make the printer 10 dirty.

Therefore, in order to prevent air pressure in the toner containing chamber 1206 from rising, the printer 10 may be furnished with an intermediate-transfer-body cleaning unit 85 which has a ventilation opening (a notch 1207*a*) for moving air in the toner containing chamber 1206 outside the toner containing chamber 1206. Moving air in the toner containing chamber 1206 outside the toner containing chamber 1206 passing through the notches 1207*a* enables to prevent air pressure in the toner containing chamber 1206 from rising.

However, if the notches 1207*a* are provided inside the intermediate-transfer-body cleaning unit 85, there are cases in which, when air in the toner containing chamber 1206 passes through the notches 1207*a* and moves outside the toner containing chamber 1206, toner in the toner containing chamber 1206 also passes through the notches 1207*a* and moves outside the toner containing chamber 1206. In such a case, toner which moves outside the toner containing chamber 1206 passing through the notches 1207*a* may diffuse.

Therefore, the intermediate-transfer-body cleaning unit 85 according to the present embodiment has the gathering-chamber-wall central portion 1251*a* located opposite the notches 1207*a* outside the notches 1207*a*, as shown in FIG. 16 and the like. In such a case, before toner which has moved outside the toner containing chamber 1206 (that is, to the gathering chamber 1250) passing through the notches 1207*a* together with air diffuses, the toner strikes the gathering-chamber-wall central portion 1251*a* located opposite the notches 1207*a*. Since, as mentioned above, the gathering-chamber-wall central portion 1251*a* restricts movement of the toner which has moved outside the toner containing chamber 1206 passing through the notches 1207*a*, it is possible to suppress diffusion of the toner. In addition, since the gathering-chamber-wall central portion 1251*a* restricts movement of toner, the toner can be guided to a desired place.

Other Embodiments According to Second Embodiment

In the above-mentioned embodiment, the ventilation opening is a first ventilation opening (the notches 1207*a*). Further, as shown in FIG. 18, the intermediate-transfer-body cleaning unit 85 has a second ventilation opening (the ventilation paths 1254) for moving, outside the intermediate-transfer-body cleaning unit 85, air which has moved outside the toner containing chamber 1206 passing through the notches 1207*a*. However, this invention is not limited thereto. For example, it is possible that the intermediate-transfer-body cleaning unit 85 does not have the ventilation paths 1254.

In a case where the intermediate-transfer-body cleaning unit 85 does not have the ventilation paths 1254, if an extremely large amount of air moves from the toner containing chamber 1206 to the gathering chamber 1250, it may be caused that air in the toner containing chamber 1206 does not move to the gathering chamber 1250. On the other hand, in a case where the intermediate-transfer-body cleaning unit 85 has the ventilation paths 1254, even if an extremely large amount of air moves from the toner containing chamber 1206 to the gathering chamber 1250, movement of air in the gathering chamber 1250 to the outside of the intermediate-transfer-body cleaning unit 85 passing through the ventilation paths 1254 enables air in the toner containing chamber 1206 to continue to move the gathering chamber 1250. Since, as a result thereof, air in the toner containing chamber 1206 can move outside the intermediate-transfer-body cleaning unit 85, it is possible to prevent air pressure in the toner containing chamber 1206 from rising. Accordingly, the above-mentioned embodiment is more desirable.

Besides, in the above-mentioned embodiment, as shown in FIGS. 15 and 16, the intermediate-transfer-body cleaning unit 85 has the gathering chamber 1250 for gathering toner which moves outside the toner containing chamber 1206 passing through the notches 1207*a*. As shown in FIG. 18, the gathering chamber 1250 is furnished with the gathering-chamber-wall central portion 1251*a* on a central portion of the gathering chamber 1250 in the longitudinal direction, and is also furnished with the ventilation paths 1254 on its end in the longitudinal direction. However, this invention is not limited thereto. For example, it is also possible that the gathering chamber 1250 is furnished with the ventilation paths 1254 vertically above the gathering-chamber-wall central portion 1251*a*.

Further, in the above-mentioned embodiment, the containing chamber is a first containing chamber (the toner containing chamber 1206). Also, the printer 10 is furnished with a second containing chamber (the waste toner box) being different from the toner containing chamber 1206. The toner containing chamber 1206 has a carrying member (the carry screw 1240) for carrying to the waste toner box toner contained in the toner containing chamber 1206, as shown in FIGS. 15 and 16. The bottom section 1252 of the gathering chamber 1250 is in communication with the toner containing chamber 1206, as shown in FIG. 16. However, this invention is not limited thereto. For example, the bottom section 1252 of the gathering chamber 1250 can be partitioned by the containing-chamber wall 1207 from the toner containing chamber 1206.

However, if the bottom section 1252 of the gathering chamber 1250 is in communication with the toner containing chamber 1206, toner in the bottom section 1252 of the gathering chamber 1250 moves to the toner containing chamber 1206. And then, the carry screw 1240 carries to the waste toner box toner which has moved to the toner containing chamber 1206, and as a result thereof, it is possible to prevent a large amount of toner in the gathering chamber 1250 from accumulating. Accordingly, the above-mentioned embodiment is more desirable.

Third Embodiment

Figure 20:
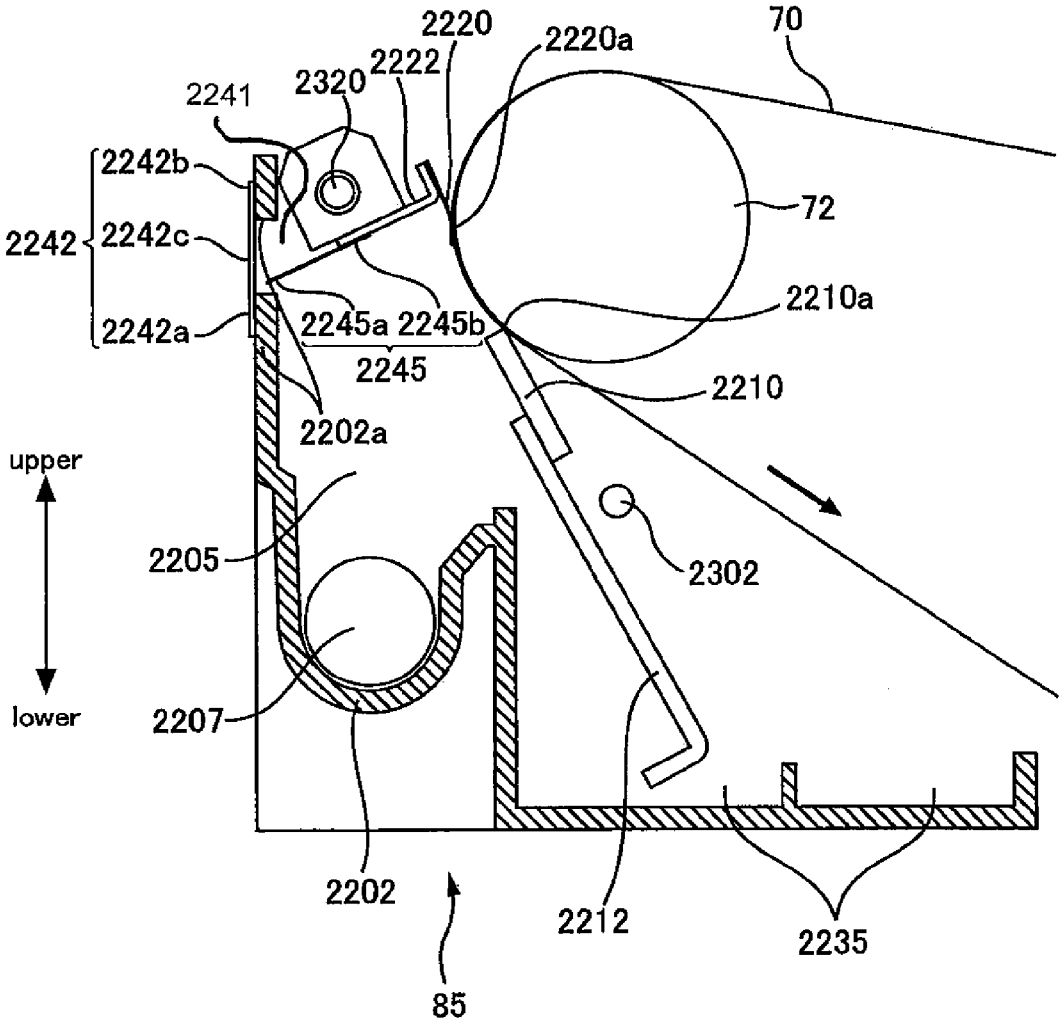
FIG. 20 is a cross-sectional view according to the third embodiment showing the intermediate-transfer-body cleaning unit 85 when an intermediate-transfer-body cleaning blade 2210 and an upper seal 2220 abut against the intermediate transfer body 70.
Figure 21:
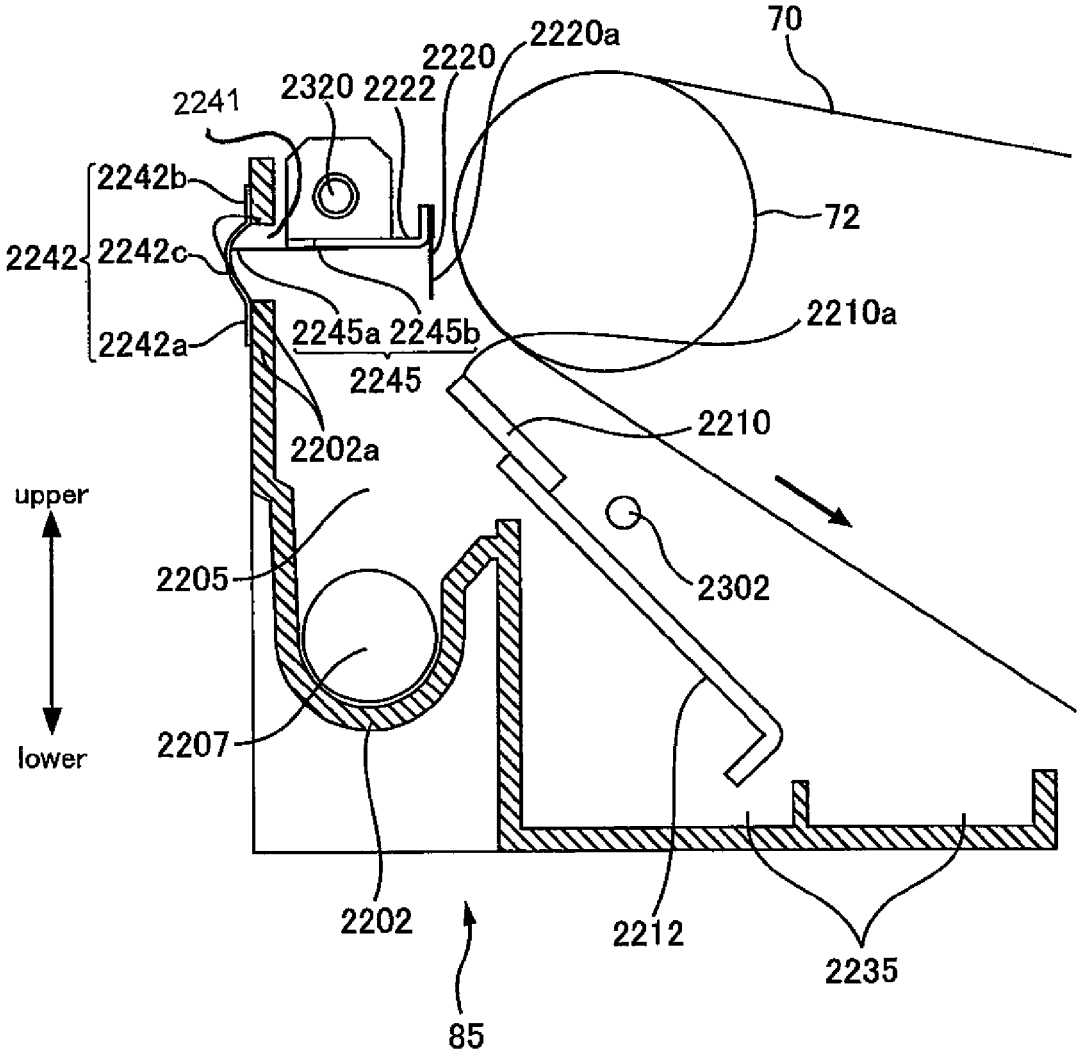
FIG. 21 is a cross-sectional view according to the third embodiment showing the intermediate-transfer-body cleaning unit 85 when the intermediate-transfer-body cleaning blade 2210 and the upper seal 2220 are separated from the intermediate transfer body 70.

Example of Configuration of Intermediate-Transfer-Body Cleaning Unit 85 According to Third Embodiment An example of a configuration of the intermediate-transfer-body cleaning unit 85 is described with reference to FIGS. 20 and 21. FIG. 20 is a cross-sectional view showing the intermediate-transfer-body cleaning unit 85 when an intermediate-transfer-body cleaning blade 2210 and an upper seal 2220 abut against the intermediate transfer body 70. FIG. 21 is a cross-sectional view showing the intermediate-transfer-body cleaning unit 85 when the intermediate-transfer-body cleaning blade 2210 and the upper seal 2220 are separated from the intermediate transfer body 70. Note that the up-and-down direction (the vertical direction) in FIGS. 20 and 21 is indicated by an arrow, in the same manner as FIG. 1.

The intermediate-transfer-body cleaning unit 85 is for collecting toner which has not been transferred onto a recording material and remains on the intermediate transfer body 70, and includes a case 2202, a toner container 2205, the intermediate-transfer-body cleaning blade 2210, the upper seal 2220 which serves as an example of an abutting/separating member, a toner receiver 2235, a ventilation opening 2241, a filter 2242, a cleaning member 2245 and the like.

The case 2202 operates in cooperation with the upper seal 2220 to prevent the collected toner from spilling outside the intermediate-transfer-body cleaning unit 85. Inside the case 2202, the toner container 2205 and the toner receiver 2235 are formed and the intermediate-transfer-body cleaning blade 2210 is also provided.

The intermediate-transfer-body cleaning blade 2210 has the function of scraping toner on the intermediate transfer body 70 (that is, toner which moves with the rotation of the intermediate transfer body 70) by abutting against the intermediate transfer body 70. The intermediate-transfer-body cleaning blade 2210 is an approximately 2 mm thick rubber blade. The intermediate-transfer-body cleaning blade 2210 is arranged such that its front end faces toward the upstream side of the rotating direction of the intermediate transfer body 70. Note that a blade abutting section 2210*a* at which the intermediate-transfer-body cleaning blade 2210 abuts against the intermediate transfer body 70 (FIG. 20) is located below the central axis of the above-mentioned driven roller 72 in the vertical direction.

Further, the intermediate-transfer-body cleaning blade 2210 is configured such that it can abut against and separate from the intermediate transfer body 70 by moving. More specifically, the intermediate-transfer-body cleaning blade 2210 is secured to a rotationally-moving shaft 2302 through a blade-supporting metal plate 2212 supporting the intermediate-transfer-body cleaning blade 2210, and the intermediate-transfer-body cleaning blade 2210 moves back and forth between the blade abutting position (a position shown in FIG. 20) and the blade non-abutting position (a position shown in FIG. 21) by back-and-forth rotational movement of the rotationally-moving shaft 2302 between the first rotated position and the second rotated position.

The toner container 2205 is for containing the toner scraped by the intermediate-transfer-body cleaning blade 2210. The toner container 2205 is formed in the lower section of the case 2202 and is furnished with a screw section 2207 rotatable about the central axis. The screw section 2207 rotates to send toner contained in the toner container 2205 to the not shown waste toner box (which is provided frontward of the screw section 2207 in the direction perpendicular to the surface of the paper in FIG. 20). In other words, the toner container 2205 and the waste toner box serve as a first container and a second container of toner respectively.

The toner receiver 2235 has the function of receiving toner which has not been contained in the toner container 2205 and which moves to the side opposite the toner container 2205 relative to the intermediate-transfer-body cleaning blade 2210. The toner receiver 2235 is formed in the lower section of the case 2202 and on the side opposite the toner container 2205 relative to the intermediate-transfer-body cleaning blade 2210 (i.e., on the side of the photoconductor 20).

The upper seal 2220 is a sealing member for preventing the collected toner from spilling outside the intermediate-transfer-body cleaning unit 85 by abutting against the intermediate transfer body 70 at the seal abutting section 2220*a*, as shown in FIG. 20. The upper seal 2220 is an approximately 120 μm thick sheet-like member. The upper seal 2220 is arranged such that its front end faces toward the downstream side of the rotating direction of the intermediate transfer body 70.

Further, in the same way as the intermediate-transfer-body cleaning blade 2210, the upper seal 2220 is configured such that it can abut against and separate from the intermediate transfer body 70 by moving. More specifically, the upper seal 2220 is secured to a rotationally-moving section 2320 through the seal supporting member 2222 which supports the upper seal 2220 and moves together with the upper seal 2220, and the upper seal 2220 moves back and forth between the seal abutting position (a position shown in FIG. 20) and the seal non-abutting position (a position shown in FIG. 21) by back-and-forth rotational movement of the rotationally-moving section 2320 between the first rotated position and the second rotated position.

Furthermore, in the present embodiment, the upper seal 2220 moves in conjunction with movement of the intermediate-transfer-body cleaning blade 2210. When the intermediate-transfer-body cleaning blade 2210 moves from the blade abutting position to the blade non-abutting position, the upper seal 2220 moves from the seal abutting position to the seal non-abutting position, and when the intermediate-transfer-body cleaning blade 2210 moves from the blade non-abutting position to the blade abutting position, the upper seal 2220 moves from the seal non-abutting position to the seal abutting position.

The ventilation opening 2241 has the function of moving air in the intermediate-transfer-body cleaning unit 85 (the toner container 2205) outside the intermediate-transfer-body cleaning unit 85 in order to lower air pressure in the intermediate-transfer-body cleaning unit 85 (specifically, the toner container 2205). In addition, the ventilation opening 2241 is a rectangular hole formed in the upper section of a wall 2202*a* of the case 2202, the wall 2202*a* being located opposite the intermediate-transfer-body cleaning blade 2210. Through the ventilation opening 2241, the toner container 2205 and the outside of the intermediate-transfer-body cleaning unit 85 are in communication with each other. The ventilation opening 2241 is provided such that its longitudinal direction is along the width direction of the intermediate transfer body 70 (a direction perpendicular to the surface of the paper in FIGS. 20 and 21), and is located opposite the upper seal 2220.

This section describes the reason of lowering air pressure in the intermediate-transfer-body cleaning unit 85 (specifically, the toner container 2205). If air pressure in the toner container 2205 rises, when either of the intermediate-transfer-body cleaning blade 2210 and the upper seal 2220 separates from the intermediate transfer body 70, toner in the toner container 2205 may move outside the intermediate-transfer-body cleaning unit 85 passing between the intermediate-transfer-body cleaning blade 2210 and the intermediate transfer body 70 or between the upper seal 2220 and the intermediate transfer body 70. Toner which has moved outside the intermediate-transfer-body cleaning unit 85 adheres to other units, not to the above-mentioned toner receiver 2235, and as a result thereof, the printer 10 may become dirty. Therefore, the printer 10 according to the present embodiment is furnished with the ventilation opening 2241, to lower air pressure in the toner container 2205, and as a result thereof, the above-mentioned problem is resolved.

The filter 2242 is attached to the ventilation opening 2241, and is for preventing toner in the intermediate-transfer-body cleaning unit 85 (the toner container 2205) from spilling outside the intermediate-transfer-body cleaning unit 85 passing through the ventilation opening 2241. The filter 2242 is a porous membrane made of tetrafluoroethylene resin, and the porous membrane has a structure that does not allow toner to pass through but allows air to pass through. Accordingly, air in the toner container 2205 passes through the filter 2242 and moves outside the intermediate-transfer-body cleaning unit 85.

Besides, the filter 2242 is attached to an exit of the ventilation opening 2241, and is secured to the outside of the wall 2202*a* at both ends of the filter 2242 in its lateral direction (that is, one end portion 2242*a* and the other end portion 2242*b*). The filter 2242 is attached such that its longitudinal direction (the same direction as a longitudinal direction of the ventilation opening 2241) is along the width direction of the intermediate transfer body 70 (a direction perpendicular to the surface of the paper in FIGS. 20 and 21), and a central portion 2242*c* of the filter 2242 in the lateral direction keeps the exit of the ventilation opening 2241 closed. The filter 2242 is flexible and the central portion 2242*c* bends when the cleaning member 2245 is moving while keeping in contact with the filter 2242 in conjunction with movement of the upper seal 2220.

The cleaning member 2245 is for cleaning the filter 2242 by moving while keeping in contact with the filter 2242. The cleaning member 2245 is made of PET film. The cleaning member 2245 is provided such that its longitudinal direction (a same direction as the longitudinal direction of the ventilation opening 2241) is along the width direction of the intermediate transfer body 70 (a direction perpendicular to the surface of the paper in FIGS. 20 and 21).

Besides, the cleaning member 2245 can contact the filter 2242 at one end portion 2245*a* in the lateral direction of the member, and is attached to (provided on) the seal supporting member 2222 with the other end portion 2245*b* in the lateral direction being secured to the seal supporting member 2222. Therefore, the cleaning member 2245 cleans the filter 2242, by movement of the above-mentioned one end portion 2245*a* keeping in contact with the filter 2242 in conjunction with movement of the seal supporting member 2222 (the upper seal 2220). Note that the above-mentioned one end portion 2245*a* of the cleaning member 2245 does not contact the filter 2242 when the upper seal 2220 is located at the seal abutting position, as shown in FIG. 20, and contacts the filter 2242 when the upper seal 2220 moves between the seal abutting and non-abutting positions (see FIG. 21).

Further, the cleaning member 2245 serves as a valve for adjusting an amount of air passing through the ventilation opening 2241 (more exactly, the filter 2242). More specifically, the cleaning member 2245 moves in conjunction with movement of the upper seal 2220, to adjust an amount of air passing through the ventilation opening 2241 (the filter 2242). In the present embodiment, when the cleaning member 2245 is moving in conjunction with movement of the upper seal 2220 from the seal abutting position to the seal non-abutting position, an amount of air passing through the filter 2242 becomes larger.

Furthermore, the central portion 2242*c* of the filter 2242 bends when the cleaning member 2245 moves keeping in contact with the filter 2242 in conjunction with movement of the upper seal 2220, so that the volume of the intermediate-transfer-body cleaning unit 85 increases. Specifically, as shown in FIG. 21, the volume of the toner container 2205 increases because the cleaning member 2245 moves keeping in contact with the filter 2242 in conjunction with movement of the upper seal 2220 from the seal abutting position to the seal non-abutting position and this causes the central portion 2242*c* of the filter 2242 to bend toward a direction opposite the cleaning member 2245.

Regarding Effectiveness of Printer According to Third Embodiment

As mentioned above, the collector (the intermediate-transfer-body cleaning unit 85) of the image forming apparatus (the printer 10) according to the present embodiment includes the cleaning member 2245 which cleans the filter 2242 by moving while keeping in contact with the filter 2242 in conjunction with movement of abutting/separating member (the upper seal 2220), as shown in FIG. 21. Accordingly, even a simple configuration enables to prevent the filter 2242 from being clogged with toner. The section below describes it in detail.

If a large amount of toner in the toner container 2205 adheres to the filter 2242 attached to the ventilation opening 2241, the filter 2242 may become clogged with toner. Then, when the filter 2242 become clogged with toner, air in the intermediate-transfer-body cleaning unit 85 (specifically, the toner container 2205) cannot appropriately move outside the intermediate-transfer-body cleaning unit 85 passing through the ventilation opening 2241 (the filter 2242) (that is, air pressure of the toner container 2205 cannot fall appropriately).

Therefore, as with the present embodiment, if the cleaning member 2245 is provided which is for cleaning the filter 2242 by moving while keeping in contact with the filter 2242, that the cleaning member 2245 scrapes off the toner adhering to the filter 2242, which enables the toner to be removed. Thus, it becomes possible to prevent a large amount of toner from adhering to the filter 2242, and as a result thereof, enables to prevent the filter 2242 from being clogged with toner. In addition, since the cleaning member 2245 moves in conjunction with movement of the upper seal 2220, a simple configuration enables to move the cleaning member 2245 while keeping in contact with the filter 2242. Accordingly, if the cleaning member 2245 according to the present embodiment is provided, a simple configuration enables to prevent the filter 2242 from being clogged with toner. As a result thereof, it becomes possible to cause air in the toner container 2205 to pass through the filter 2242 and to appropriately move outside the intermediate-transfer-body cleaning unit 85 (that is, it becomes possible to lower air pressure of the toner container 2205).

Other Embodiments According to Third Embodiment

In the above-mentioned embodiments, as shown in FIG. 20, the abutting/separating member is a sealing member (the upper seal 2220) which is for preventing toner from spilling outside the intermediate-transfer-body cleaning unit 85 by abutting against the intermediate transfer body 70. And, the upper seal 2220 is located opposite the ventilation opening 2241. However, this invention is not limited thereto. For example, it is also possible that the upper seal 2220 is not located opposite the ventilation opening 2241.

However, if the upper seal 2220 is located opposite the ventilation opening 2241, toner in the toner container 2205 tends to move to the filter 2242 when the upper seal 2220 abutting against the intermediate transfer body 70 separates therefrom. Therefore, providing with the cleaning member 2245 makes the effect achieved more advantageously that it becomes possible to prevent the filter 2242 from being clogged with toner. Accordingly, the above-mentioned embodiment is more desirable.

Furthermore, in the above-mentioned embodiment, as shown in FIGS. 20 and 21, the cleaning member 2245 moves in conjunction with movement of the upper seal 2220, to adjust an amount of air passing through the ventilation opening 2241. However, this invention is not limited thereto. For example, it is possible that the cleaning member 2245 does not adjust an amount of air passing through the ventilation opening 2241.

However, in the case where the cleaning member 2245 adjusts an amount of air passing through the ventilation opening 2241 (the filter 2242), the cleaning member 2245 also serves as a so-called valve. In such circumstances as where it is less necessary to move air in the toner container 2205 outside the intermediate-transfer-body cleaning unit 85, it is possible to effectively prevent the filter 2242 from being clogged with toner because the cleaning member 2245 reduces an amount of air passing through the ventilation opening 2241 (the filter 2242), to reduce an amount of toner moving towards the filter 2242. Accordingly, the above-mentioned embodiment is more desirable.

Furthermore, in the above-mentioned embodiment, as shown in FIG. 21, the filter 2242, which is flexible, bends when the cleaning member 2245 is moving while keeping in contact with the filter 2242 in conjunction with movement of the upper seal 2220, and as a result thereof, the volume of the intermediate-transfer-body cleaning unit 85 (the toner container 2205) increases. However, this invention is not limited thereto. For example, it is also possible that, when the cleaning member 2245 is moving while keeping in contact with the filter 2242, the cleaning member 2245 bends but the volume of the toner container 2205 does not change.

In such circumstances as where it is less necessary to move air in the toner container 2205 outside the intermediate-transfer-body cleaning unit 85, increasing the volume of the toner container 2205 enables to reduce an amount of air passing through the ventilation opening 2241 (the filter 2242), the volume being increased by the filter 2242 bending when the cleaning member 2245 is moving while keeping in contact with the filter 2242 in conjunction with movement of the upper seal 2220. Reducing an amount of air passing through the ventilation opening 2241 (the filter 2242) enables to reduce an amount of toner moving towards the filter 2242. As a result thereof, if the volume of the toner container 2205 is increased by bending of the filter 2242, it is possible to prevent the filter 2242 from being clogged with toner more advantageously. Accordingly, the above-mentioned embodiment is more desirable.

Other Embodiments

Fourth Embodiment Through Seventh Embodiment, Etc.

In the foregoing, an image forming apparatus etc. according to the present invention was described according to the above-mentioned embodiments thereof. However, the foregoing embodiments of the invention are for the purpose of facilitating understanding of the present invention and not to be interpreted as limiting the present invention. The present invention can be altered and improved without departing from the gist thereof, and needless to say, the present invention includes its equivalents.

In the foregoing embodiments, a full-color laser beam printer was described as an example of an image forming apparatus. However, the present invention is also applicable to various other types of image forming apparatuses such as monochrome laser beam printers, copying machines, and facsimiles.

Further, a photoconductor is not limited to a so-called photoconductive roller structured by providing a photoconductive layer on the outer peripheral surface of a cylindrical conductive base, and can be a so-called photoconductive belt structured by providing a photoconductive layer on the surface of belt-like conductive base.

Besides, the following fourth embodiment through seventh embodiment can be given as other preferable embodiments.

Fourth Embodiment

In the printer 10 according to a fourth embodiment, during the period from when an upper seal 3220 located at the contact position starts moving to the non-contact position to when the upper seal 3220 finishes moving to the non-contact position, an extended imaginary line L of the upper seal 3220 extended therefrom in the lateral direction thereof passes through between the intermediate transfer body 70 and a front-end portion 3210*b* of the intermediate-transfer-body cleaning blade 3210.

Figure 22:
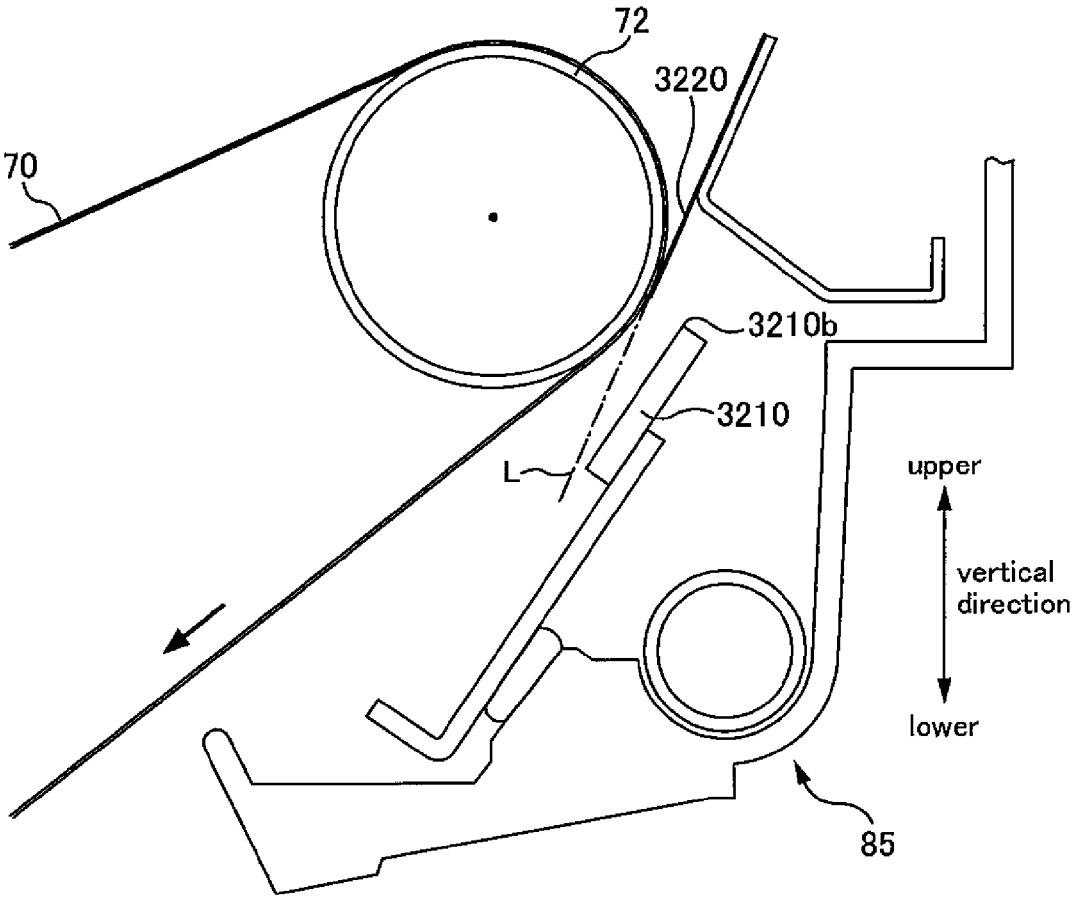
FIG. 22 is a schematic diagram according to the fourth embodiment showing a state at a time when an upper seal 3220 starts moving to the non-contact position.
Figure 23:
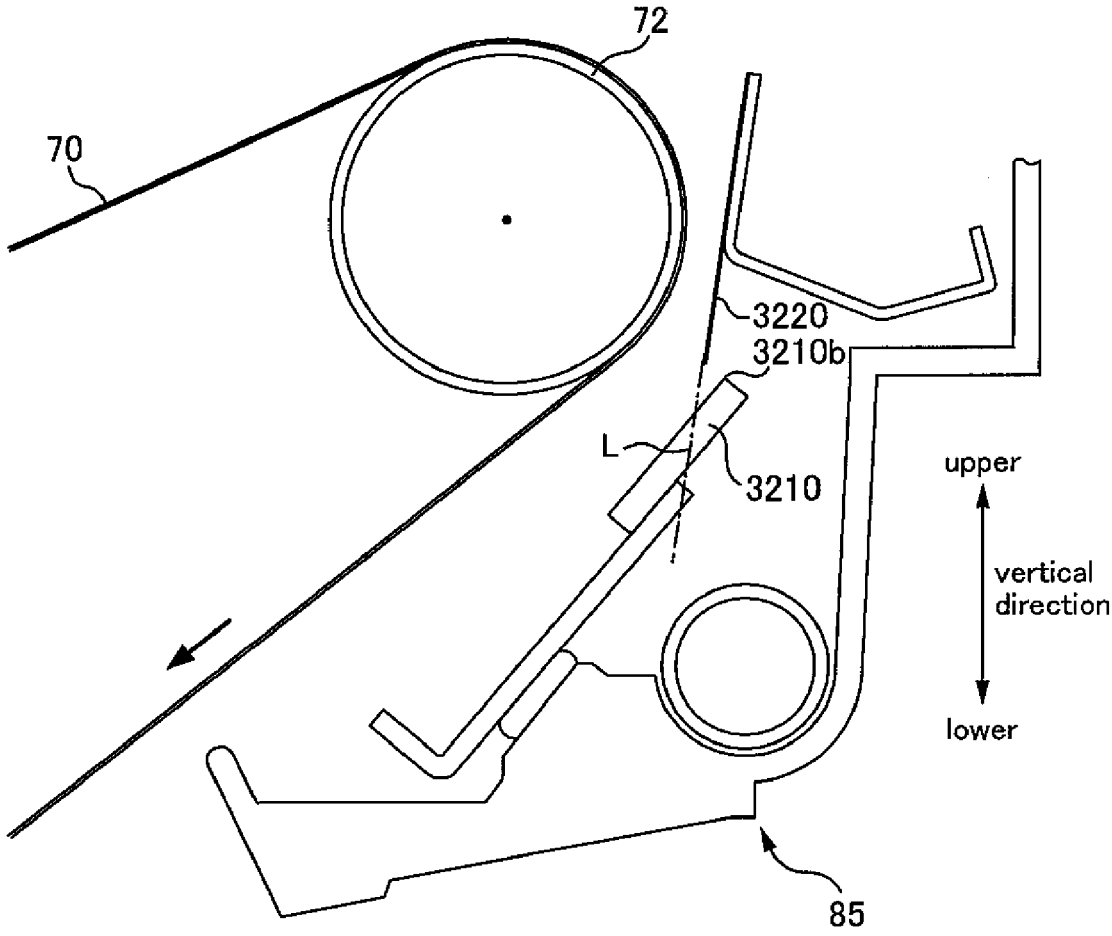
FIG. 23 is a schematic diagram according to the fourth embodiment showing a state at a time when the upper seal 3220 finishes moving to the non-contact position.

This is described with reference to FIGS. 22 and 23. FIG. 22 is a schematic diagram showing a state at a time when the upper seal 3220 starts moving to the non-contact position. FIG. 23 is a schematic diagram showing a state at a time when the upper seal 3220 finishes moving to the non-contact position.

More specifically, as shown in FIG. 22, when the upper seal 3220 located at the contact position starts moving to the non-contact position, the extended imaginary line (indicated by symbol L in FIG. 22) in the lateral direction of the upper seal 3220 passes through between the intermediate transfer body 70 and the front-end portion 3210*b* of the intermediate-transfer-body cleaning blade 3210.

Then, the moving upper seal 3220 finally reaches the non-contact position (FIG. 23). During the period thereof (that is, the period from when the upper seal 3220 located at the contact position starts moving to the non-contact position to when the upper seal 3220 finishes moving to the non-contact position), the condition is maintained in which the extended imaginary line L in the lateral direction of the upper seal 3220 passes through between the intermediate transfer body 70 and the front-end portion 3210*b* of the intermediate-transfer-body cleaning blade 3210.

In the fourth embodiment, the following effect is produced. When the intermediate-transfer-body cleaning blade 3210 scrapes off toner on the intermediate transfer body 70 by abutting against the intermediate transfer body 70, toner accumulates near an abutting section 3210*a* of the intermediate-transfer-body cleaning blade 3210, and finally, the accumulating toner reaches the front-end portion 3210*b* of the intermediate-transfer-body cleaning blade 3210. There are cases in which toner located on the front-end portion 3210*b* remains on the front-end portion 3210*b* even when the intermediate-transfer-body cleaning blade 210 separates from the intermediate transfer body 70.

On the other hand, when the upper seal 3220 located at the contact position separates from the intermediate transfer body 70, airflow flows from the outside of the intermediate-transfer-body cleaning unit 85 passing through between the intermediate transfer body 70 and the upper seal 3220 into the intermediate-transfer-body cleaning unit 85. In such a case, there are cases in which the airflow having flowed into the intermediate-transfer-body cleaning unit 85 blows away toner located at the front-end portion 3210*b* of the intermediate-transfer-body cleaning blade 3210, and it may cause a problem that the blown toner is spilled from between the intermediate-transfer-body cleaning blade 3210 and the intermediate transfer body 70 or from between the upper seal 3220 and the intermediate transfer body 70.

In contrast, in the present embodiment, as shown in FIGS. 22 and 23, it is possible to prevent airflow which has flowed into the intermediate-transfer-body cleaning unit 85 from the outside of the intermediate-transfer-body cleaning unit 85 passing through between the intermediate transfer body 70 and upper seal 3220 from moving directly toward the front-end portion 3210*b* of the intermediate-transfer-body cleaning blade 3210. The reason is that, during the period from when the upper seal 3220 located at the contact position starts moving to the non-contact position to when the upper seal 3220 finishes moving to the non-contact position, the extended imaginary line L in the lateral direction of the upper seal 3220 passes through between the intermediate transfer body 70 and the front-end portion 3210*b* of the intermediate-transfer-body cleaning blade 3210. Accordingly, this enables to appropriately suppress a phenomenon that airflow having flowed into the intermediate-transfer-body cleaning unit 85 blows away toner located at the front-end portion 3210*b* and the blown toner is spilled from between the intermediate-transfer-body cleaning blade 3210 and the intermediate transfer body 70 or from between the upper seal 3220 and the intermediate transfer body 70.

Fifth Embodiment

Figure 24:
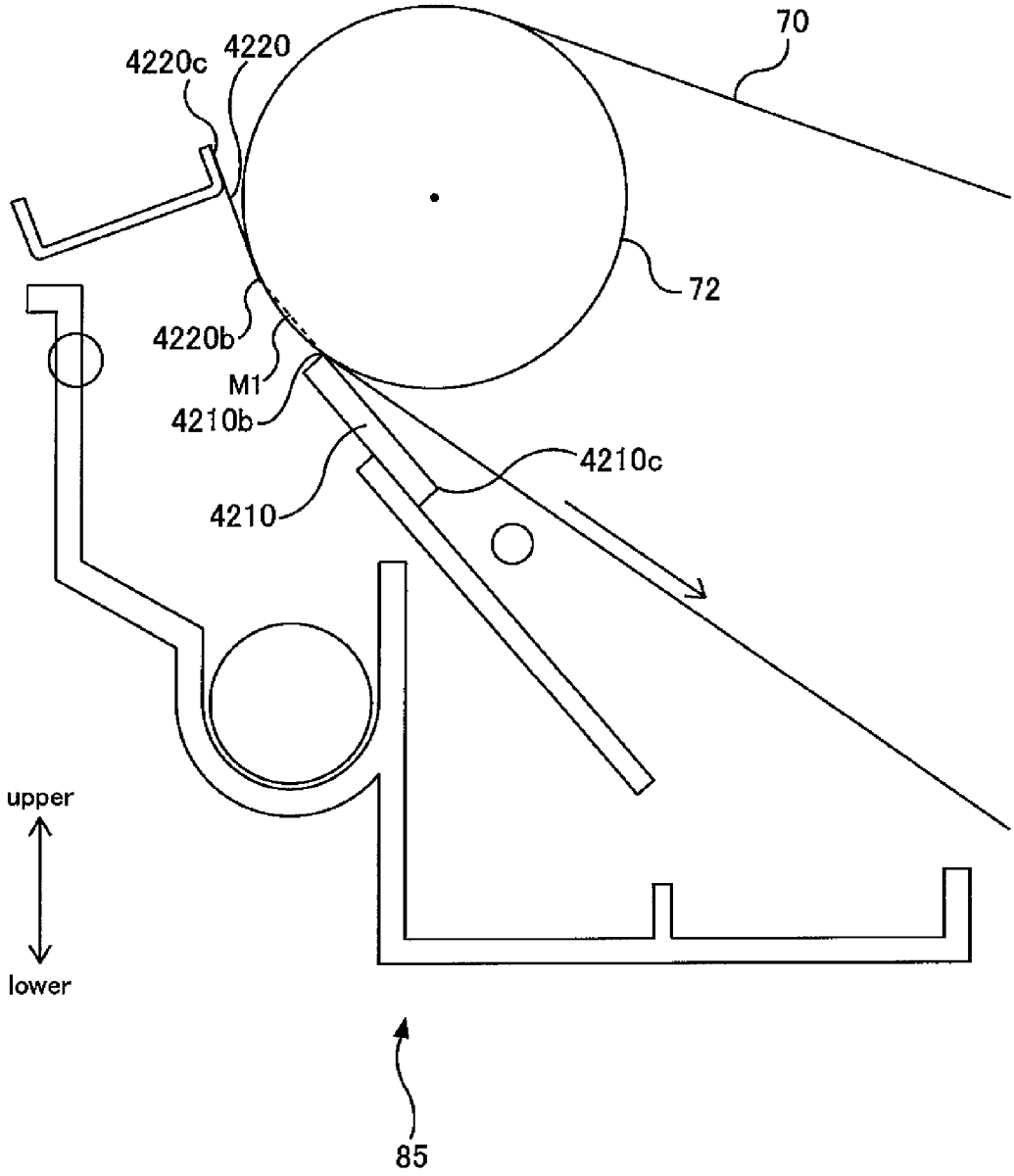
FIG. 24 is a schematic diagram according to the fifth embodiment showing a cross-section of the intermediate-transfer-body cleaning unit 85 when an intermediate-transfer-body cleaning blade 4210 and an upper seal 4220 are located respectively at a first contact position and a second contact position.
Figure 25:
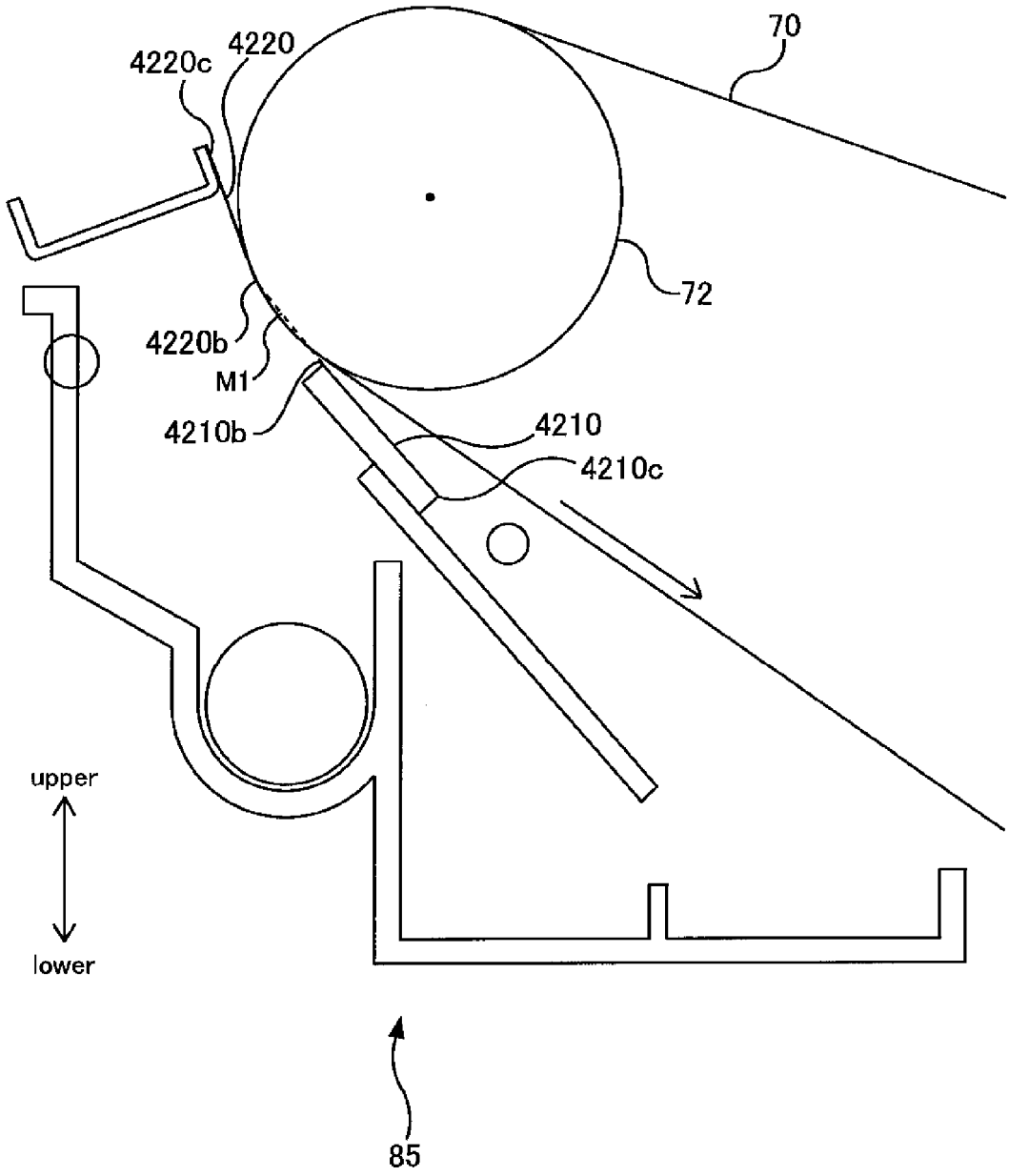
FIG. 25 is a schematic diagram according to the fifth embodiment showing a cross-section of the intermediate-transfer-body cleaning unit 85 when the intermediate-transfer-body cleaning blade 4210 is located between the first contact position and a first non-contact position, and the upper seal 4220 is located at the second contact position.
Figure 26:
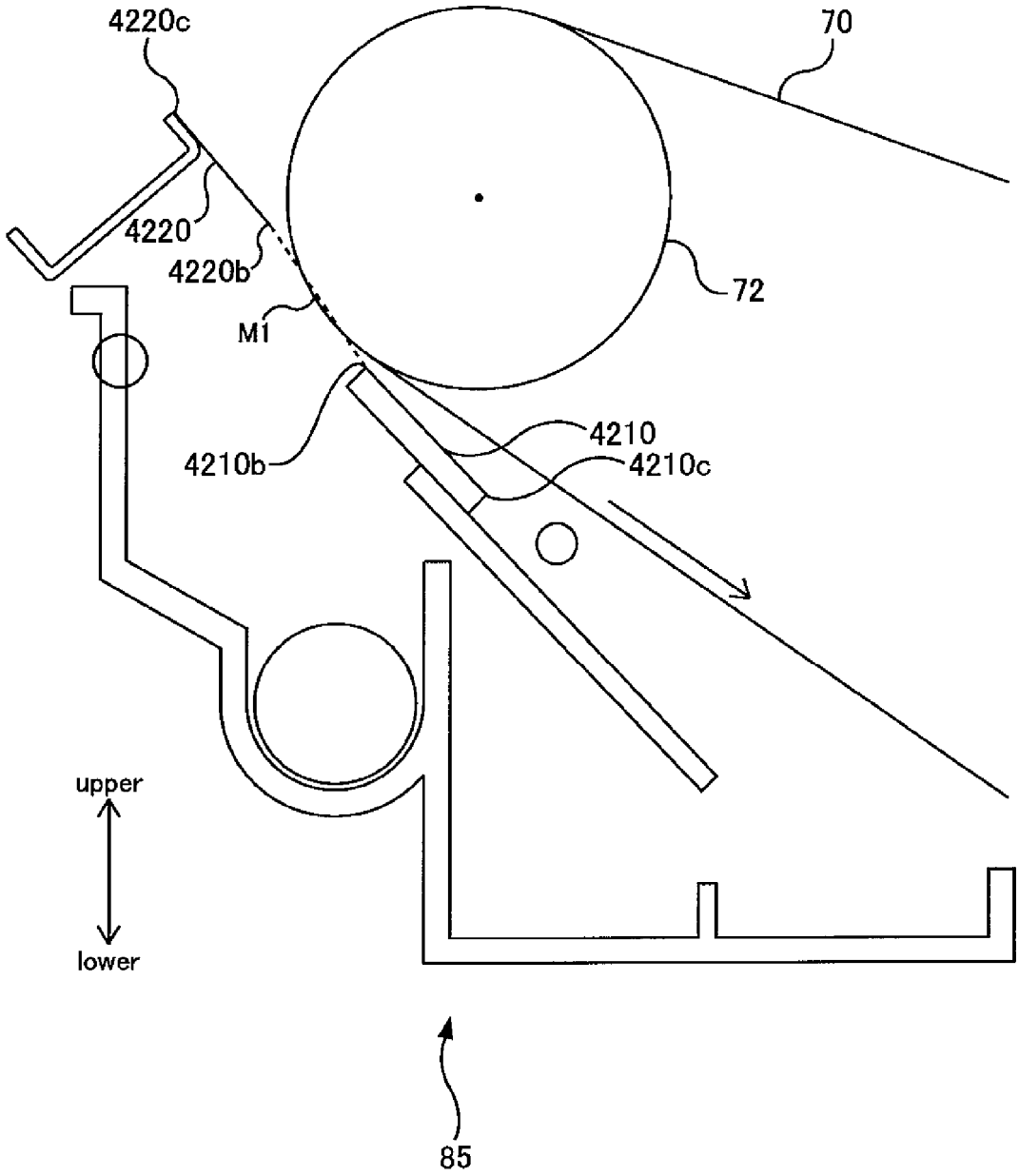
FIG. 26 is a schematic diagram according to the fifth embodiment showing a cross-section of the intermediate-transfer-body cleaning unit 85 when the intermediate-transfer-body cleaning blade 4210 and the upper seal 4220 are located respectively at the first non-contact position and a second non-contact position.

In the printer 10 according to a fifth embodiment, as shown in FIGS. 24 through 26, during the period from when at least one of a first contacting member (an upper seal 4220) located at a first contact position (a seal contact position) and a second contacting member (an intermediate-transfer-body cleaning blade 4210) located at a second contact position (a blade contact position) starts moving to either of a first non-contact position (a seal non-contact position) and a second non-contact position (a blade non-contact position) (in this example, when the upper seal 4220 located at the seal contact position starts moving to the seal non-contact position) to when the upper seal 4220 and the intermediate-transfer-body cleaning blade 4210 finish moving to the seal non-contact position and to the blade non-contact position respectively, a developer moving element (the intermediate transfer body 70) is located on an imaginary line M1; the imaginary line M1 joins one end portion located closer to the intermediate-transfer-body cleaning blade 4210 (in this example, a seal one-end portion 4220*b*) among both end portions of the upper seal 4220 in the lateral direction (that is, the seal one-end portion 4220*b* and a seal other-end portion 4220*c*), and one end portion located closer to the upper seal 4220 (in this example, a blade one-end portion 4210*b*) among both end portions of the intermediate-transfer-body cleaning blade 4210 in the lateral direction (the blade one-end portion 4210*b* and a blade other-end portion 4210*c*).

Note that FIG. 24 is a schematic diagram showing a cross-section of the intermediate-transfer-body cleaning unit 85 when the intermediate-transfer-body cleaning blade 4210 and the upper seal 4220 are located respectively at the first contact position and the second contact position. FIG. 25 is a schematic diagram showing a cross-section of the intermediate-transfer-body cleaning unit 85 when the intermediate-transfer-body cleaning blade 4210 is located between the first contact position and the first non-contact position and when the upper seal 4220 is located at the second contact position. FIG. 26 is a schematic diagram showing a cross-section of the intermediate-transfer-body cleaning unit 85 when the intermediate-transfer-body cleaning blade 4210 and the upper seal 4220 are located respectively at the first non-contact position and the second non-contact position.

In the fifth embodiment, the effect is produced that it becomes possible to prevent diffusion of toner adhering to either of the upper seal 4220 and the intermediate-transfer-body cleaning blade 4210 outside the intermediate-transfer-body cleaning unit 85. The section below describes it in detail.

When the upper seal 4220 is located at the seal contact position (a position shown in FIG. 24) or when the intermediate-transfer-body cleaning blade 4210 is located at the blade contact position (a position shown in FIG. 24), there are cases in which toner borne by the intermediate transfer body 70 adheres to the upper seal 4220 or the intermediate-transfer-body cleaning blade 4210 while the intermediate transfer body 70 is moving. Further, when the upper seal 4220 located at the seal contact position moves to the seal non-contact position (a position shown in FIG. 26) (that is, separates from the intermediate transfer body 70), or when the intermediate-transfer-body cleaning blade 4210 located at the blade contact position moves to the blade non-contact position (a position shown in FIG. 26) (that is, separates from the intermediate transfer body 70), air flows (that is, airflow occurs) from between the upper seal 4220 and the intermediate transfer body 70 or from between the intermediate-transfer-body cleaning blade 4210 and the intermediate transfer body 70 into the intermediate-transfer-body cleaning unit 85 (a toner container 4205).

Under such a circumstance, when the upper seal 4220 separates from the intermediate transfer body 70, air which moves from between the upper seal 4220 and the intermediate transfer body 70 toward the inside of the intermediate-transfer-body cleaning unit 85 (hereinafter also referred to as first air) may diffuse toner adhering to the intermediate-transfer-body cleaning blade 4210 from between the intermediate-transfer-body cleaning blade 4210 and the intermediate transfer body 70 to the outside of the intermediate-transfer-body cleaning unit 85.

In the present embodiment shown in FIGS. 24 through 26, during the period from when the upper seal 4220 located at the seal contact position starts moving to the seal non-contact position to when the upper seal 4220 and the intermediate-transfer-body cleaning blade 4210 finish moving to the seal non-contact position and the blade non-contact position respectively, the intermediate transfer body 70 is located on an imaginary line M1 which joins the seal one-end portion 4220*b* of the upper seal 4220 and the blade one-end portion 4210*b* of the intermediate-transfer-body cleaning blade 4210. In such a case, when the upper seal 4220 separates from the intermediate transfer body 70, the intermediate transfer body 70 becomes an obstruction to movement of the first air toward the intermediate-transfer-body cleaning blade 4210. Therefore, it is possible to prevent toner adhering to the intermediate-transfer-body cleaning blade 4210 from diffusing with the first air outside the intermediate-transfer-body cleaning unit 85.

In the same way, when the intermediate-transfer-body cleaning blade 4210 separates from the intermediate transfer body 70, air which moves from between the intermediate-transfer-body cleaning blade 4210 and the intermediate transfer body 70 toward the inside of the intermediate-transfer-body cleaning unit 85 (hereinafter also referred to as second air) may diffuse toner adhering to the upper seal 4220 from between the upper seal 220 and the intermediate transfer body 70 to the outside of the intermediate-transfer-body cleaning unit 85.

In the present embodiment shown in FIGS. 24 through 26, during the period from when the upper seal 4220 located at the seal contact position starts moving to the seal non-contact position to when the upper seal 4220 and the intermediate-transfer-body cleaning blade 4210 finish moving to the seal non-contact position and the blade non-contact position respectively, the intermediate transfer body 70 is located on the imaginary line M1. In such a case, when the intermediate-transfer-body cleaning blade 4210 separates from the intermediate transfer body 70, the intermediate transfer body 70 becomes an obstruction to movement of the second air toward the upper seal 4220. Therefore, it is possible to prevent toner adhering to the upper seal 4220 from diffusing with the second air outside the intermediate-transfer-body cleaning unit 85.

Sixth Embodiment

Figure 27:
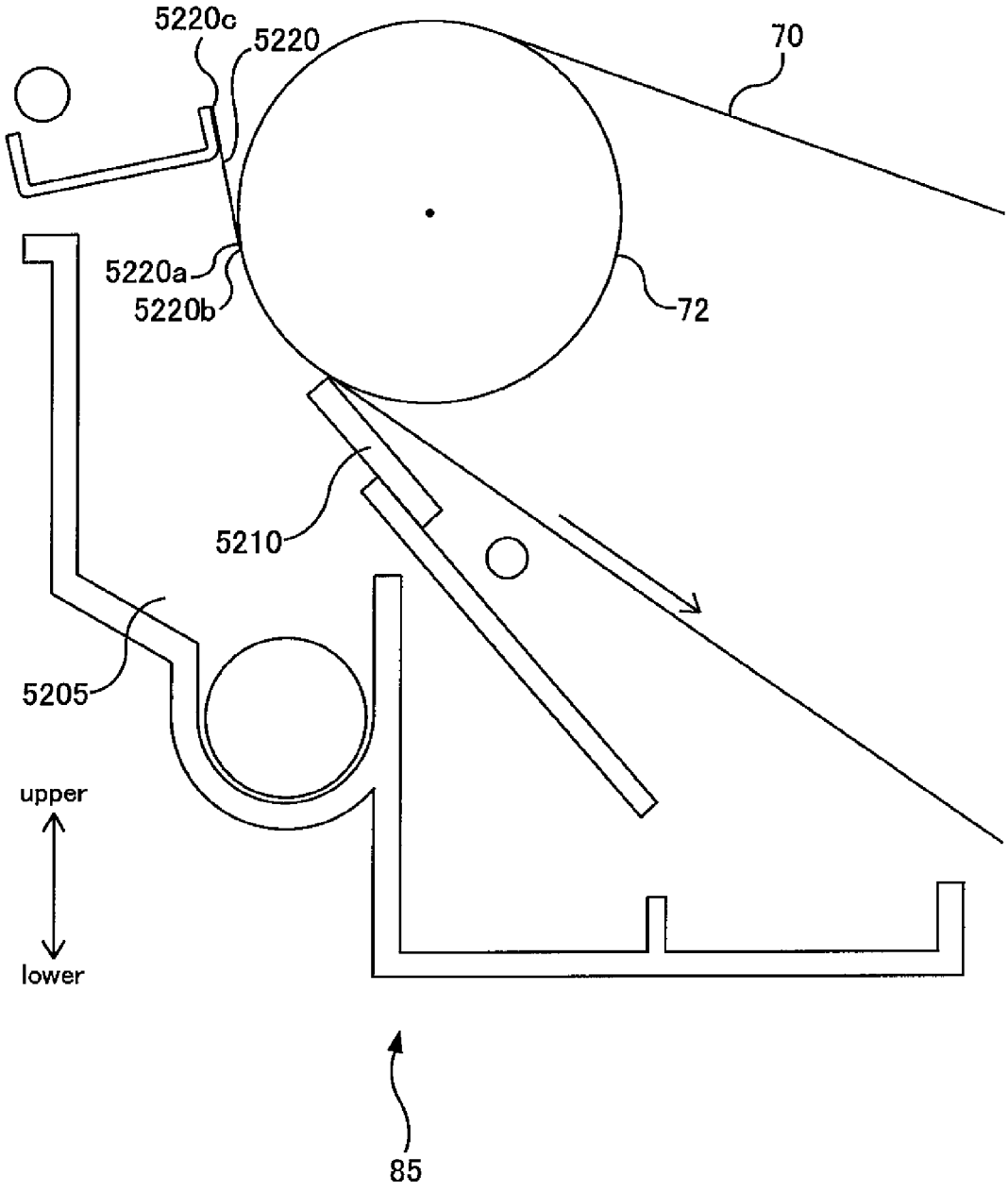
FIG. 27 is a schematic diagram according to the sixth embodiment showing a cross-section of the intermediate-transfer-body cleaning unit 85 when an intermediate-transfer-body cleaning blade 5210 and an upper seal 5220 are located respectively at the abutting position and at the contact position.
Figure 28:
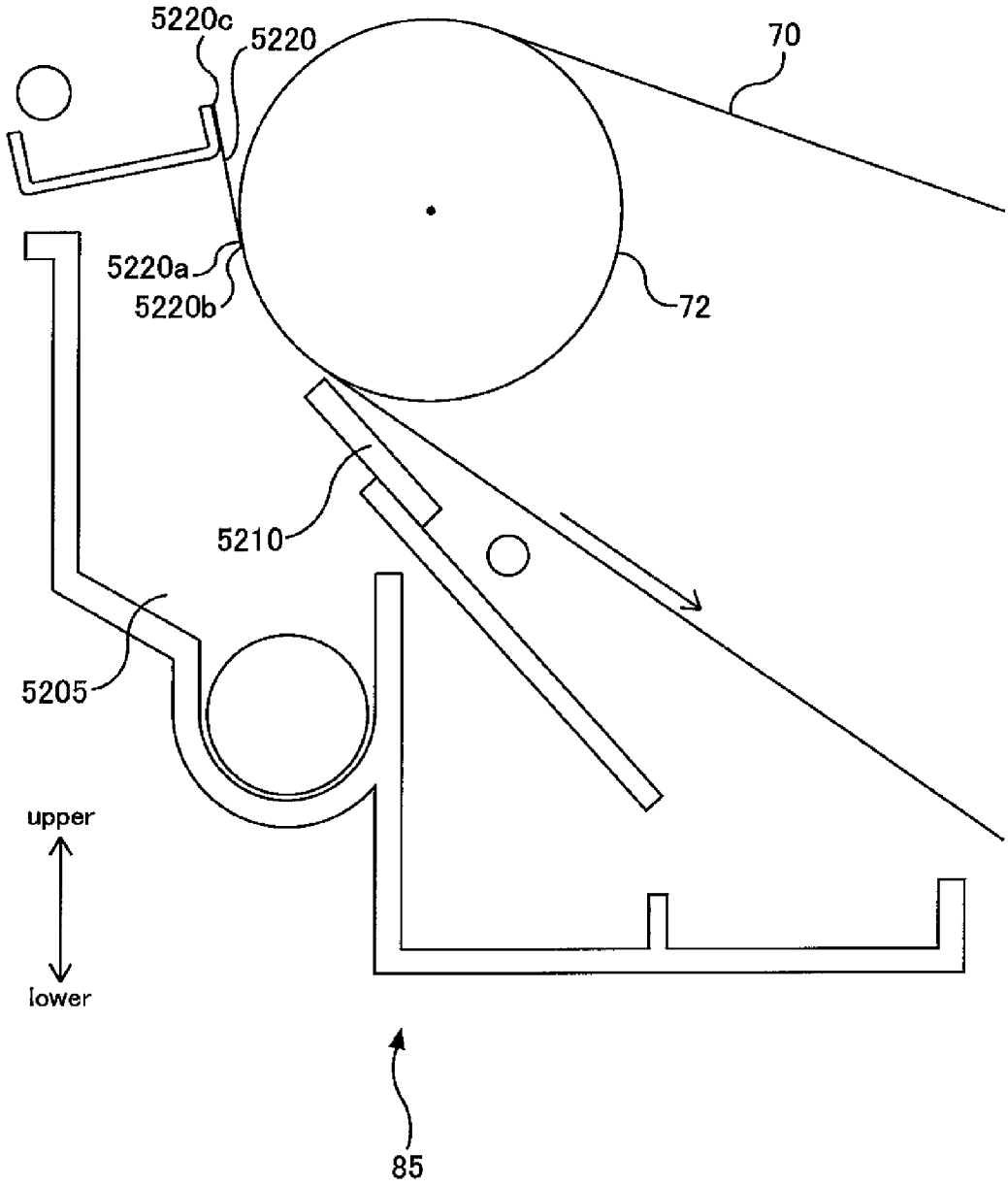
FIG. 28 is a schematic diagram according to the sixth embodiment showing a cross-section of the intermediate-transfer-body cleaning unit 85 when the intermediate-transfer-body cleaning blade 5210 is located between the abutting position and the non-abutting position, and the upper seal 5220 is located at the contact position.
Figure 29:
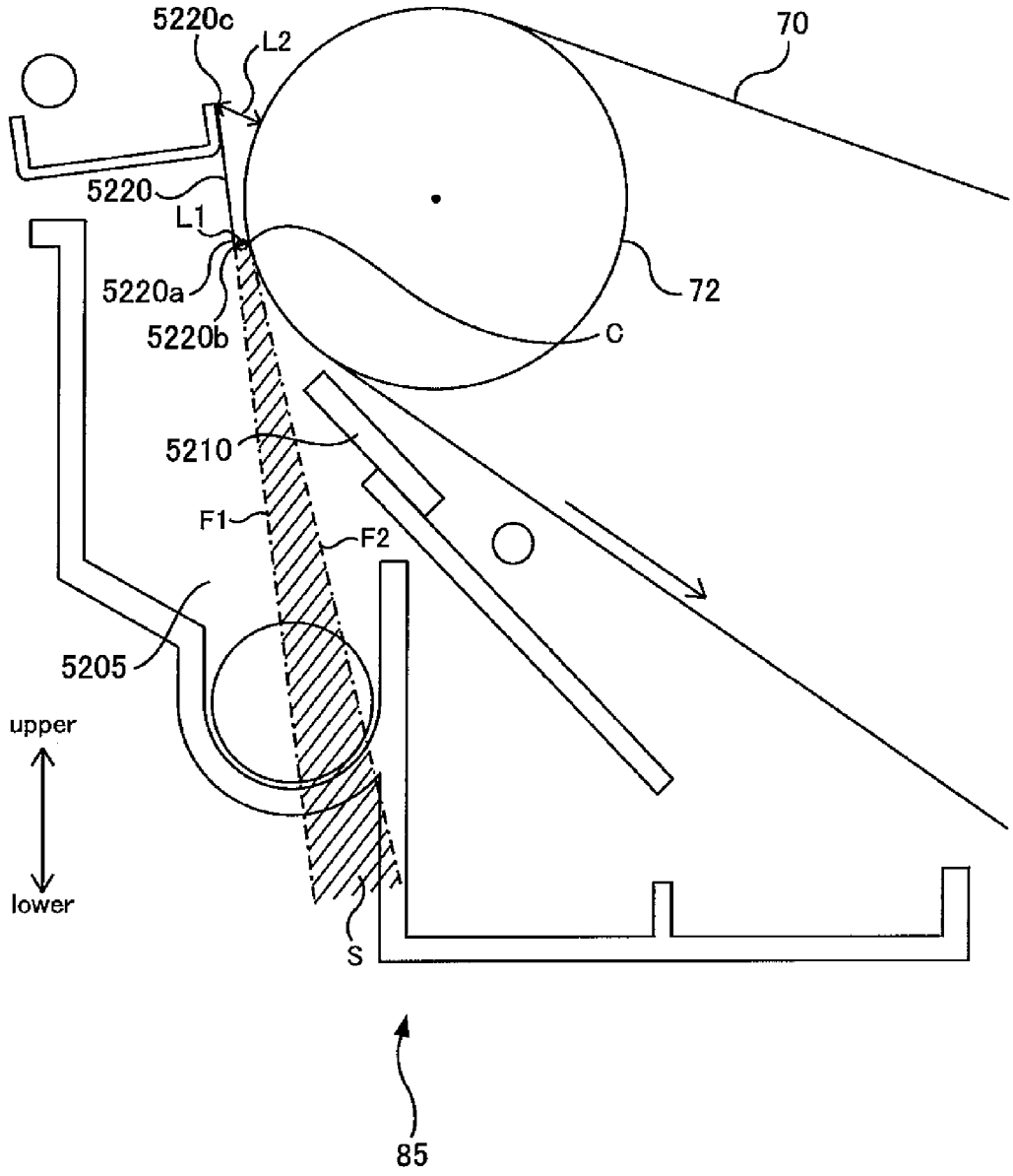
FIG. 29 is a schematic diagram according to the sixth embodiment showing a cross-section of the intermediate-transfer-body cleaning unit 85 when the intermediate-transfer-body cleaning blade 5210 and the upper seal 5220 are located respectively at the abutting position and the contact position.

In the printer 10 according to a sixth embodiment, as shown in FIGS. 27 through 29, during the period from when a contacting member (an upper seal 5220) starts separating from the intermediate transfer body 70 to when the upper seal 5220 finishes moving to the non-contact position, a first minimum distance L1 is shorter than a second minimum distance L2 and at least a part of a container (a toner container 5205) is included in a zone S sandwiched by a first imaginary surface (an imaginary surface F1) and a second imaginary surface (an imaginary surface F2); the first minimum distance L1 being between one end portion closer to the toner container 5205 among both end portions of the upper seal 5220 in the lateral direction (a seal one-end portion 5220*b*) and a developer moving element (the intermediate transfer body 70), the second minimum distance L2 being between the other end portion farther away from the toner container 5205 among these both end portions (a seal other-end portion 5220*c*) and the intermediate transfer body 70, the first imaginary surface being formed by extension of the upper seal 220 in the lateral direction, and the second imaginary surface including an opposite portion which is a portion of the surface of the intermediate transfer body 70 opposite to the above-mentioned seal one-end portion 5220*b* (a portion C shown in FIG. 29) and a line perpendicular to the second imaginary surface being an imaginary line joining the above-mentioned seal one-end portion 5220*b* and the opposite portion.

Note that, FIG. 27 is a schematic diagram showing a cross-section of the intermediate-transfer-body cleaning unit 85 when an intermediate-transfer-body cleaning blade 5210 and the upper seal 5220 are located respectively at the abutting position and the contact position. FIG. 28 is a schematic diagram showing a cross-section of the intermediate-transfer-body cleaning unit 85 when the intermediate-transfer-body cleaning blade 5210 is located between the abutting position and the non-abutting position and when the upper seal 5220 is located at the contact position. FIG. 29 is a schematic diagram showing a cross-section of the intermediate-transfer-body cleaning unit 85 when the intermediate-transfer-body cleaning blade 5210 and the upper seal 5220 are located respectively at the abutting position and the contact position.

In the sixth embodiment, the effect is produced that it becomes possible to appropriately contain toner adhering to the upper seal 5220 into the toner container 5205. The section below describes it in detail.

When the upper seal 5220 is located at the contact position, toner on the intermediate transfer body 70 may adhere to the upper seal 5220 while the intermediate transfer body 70 is moving (specifically, among the seal one-end portion 5220*b* and the seal other-end portion 5220*c*, toner tends to adhere to the side of the seal one-end portion 5220*b* which includes a contacting section 5220*a*). Therefore, there is a demand for a printer 10 which can appropriately contain toner adhering to the upper seal 5220 in the toner container 5205.

In the sixth embodiment, during the period from when the upper seal 5220 starts separating from the intermediate transfer body 70 to when the upper seal 5220 finishes moving to the non-contact position, the first minimum distance L1 between the seal one-end portion 5220*b* of the upper seal 5220 and the intermediate transfer body 70 is shorter than the second minimum distance L2 between the seal other-end portion 5220*c* and the intermediate transfer body 70, and at least a part of the toner container 5205 is included in the zone S sandwiched by the imaginary surface F1 and the imaginary surface F2.

When the upper seal 5220 separates from the intermediate transfer body 70, air flows (that is, airflow occurs) from between the upper seal 5220 and the intermediate transfer body 70 toward the inside of the intermediate-transfer-body cleaning unit 85. In such a case, if the first minimum distance L1 is shorter than the second minimum distance L2, airflow passing through between the seal one-end portion 5220*b* and the intermediate transfer body 70 is stronger than airflow passing through between the seal other-end portion 5220*c* and the intermediate transfer body 70. The strong airflow passing through between the seal one-end portion 5220*b* and the intermediate transfer body 70 makes toner adhering to the side of the seal one-end portion 5220*b* move rapidly in the zone S. Therefore, it becomes difficult for toner moving in the zone S to move out of the zone S, and this enables the toner to appropriately move to the toner container 5205. Besides, appropriate movement of toner adhering to the seal one-end portion 5220*b* into the toner container 5205 makes it possible that the toner container 5205 contains the toner.

Consequently, with the printer 10 according to the sixth embodiment, it is possible to appropriately contain in the toner container 5205 toner adhering to the upper seal 5220.

Seventh Embodiment

The printer 10 according to a seventh embodiment includes the following: the intermediate transfer body 70 as a toner moving element for moving toner by rotating with the toner being borne thereon in order to transfer the toner onto a medium; an intermediate-transfer-body cleaning blade 6210 which is provided such that it can abut against and separate from the intermediate transfer body 70 and which serves as a blade for scraping, by a butting against the intermediate transfer body 70, toner which has not been transferred onto the medium and remains on the intermediate transfer body 70; a toner container 6205 which contains the toner scraped by the intermediate-transfer-body cleaning blade 6210 and serves as a container, a gap between the container and the intermediate transfer body 70 being closed by the intermediate-transfer-body cleaning blade 6210 abutting against the intermediate transfer body 70 on the downstream side of the rotating direction of the intermediate transfer body 70; an upper seal 6220 which is provided such that it can abut against and separate from the intermediate transfer body 70 on the upstream side of the rotating direction of the intermediate transfer body 70 and which is for closing a gap on the upstream side between the intermediate transfer body 70 and the toner container 6205 by abutting against the intermediate transfer body 70; and the patch sensor 73 (a reflective optical sensor) including a light-emitting device 73*a* and a light-receiving device 73*b* which serve as a detector.

Figure 30:
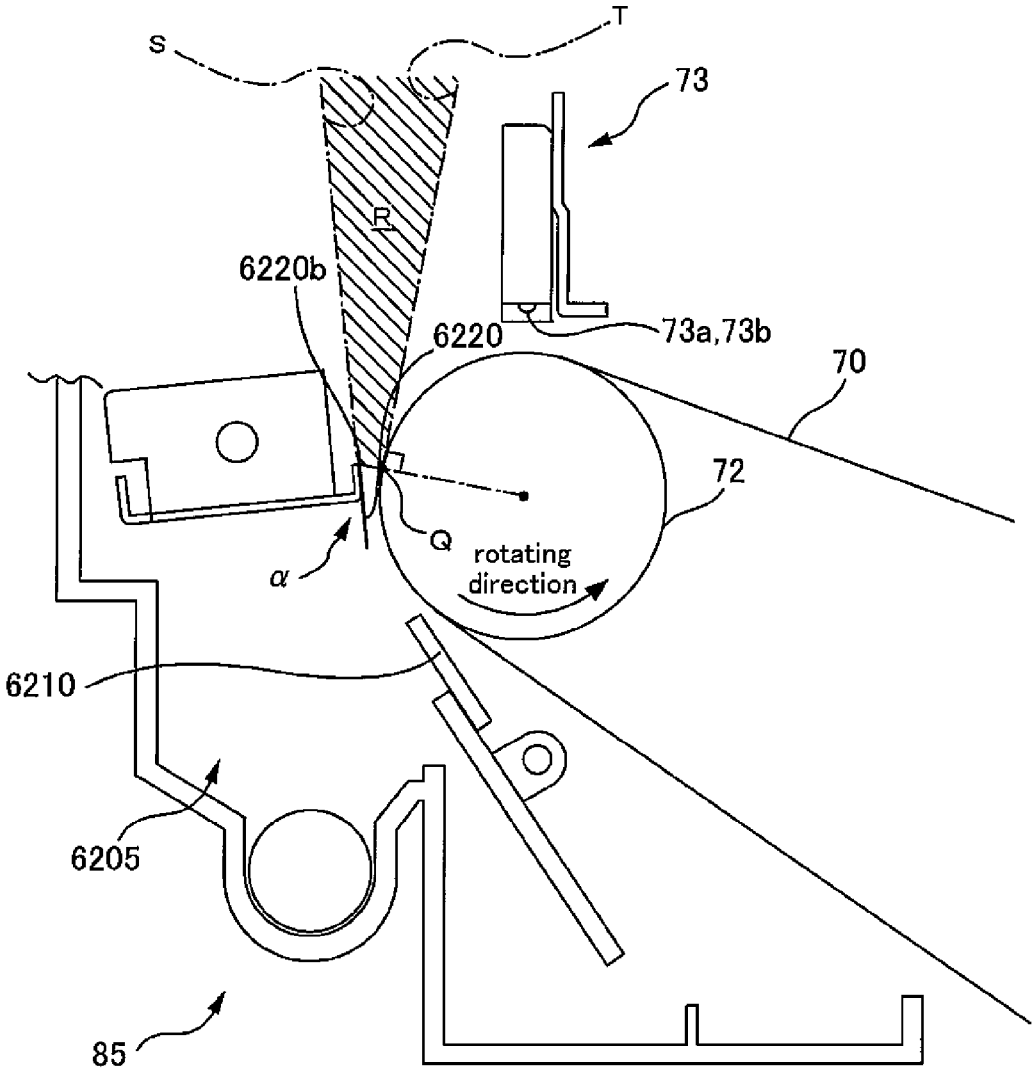
FIG. 30 is a cross-sectional view according to the seventh embodiment showing a state in which an upper seal and an intermediate-transfer-body cleaning blade are separated from an intermediate transfer body.

As shown in FIG. 30, with the upper seal 6220 being separated from the intermediate transfer body 70, the patch sensor 73 (its light-emitting device 73*a* and light-receiving device 73*b*) is arranged outside an imaginary zone R sandwiched by the imaginary surface S and a flat surface T; the imaginary surface S being formed by extension of the separated upper seal 6220 toward the upstream side of the rotating direction of the intermediate transfer body 70, and the flat surface T being perpendicular to a straight line passing through an upstream-side end portion 6220*b* of the upper seal 6220 and the closest point on the surface of the intermediate transfer body 70 to the upstream-side end portion 6220*b*.

Note that FIG. 30 is a cross-sectional view showing a state in which an upper seal and an intermediate-transfer-body cleaning blade are separated from an intermediate transfer body.

In the seventh embodiment, the following effect is produced. When the intermediate-transfer-body cleaning blade 6210 scrapes off toner on the intermediate transfer body 70 by abutting against the intermediate transfer body 70, the scraped toner is scattered in the toner container 6205. There are cases in which, when toner on the intermediate transfer body 70 has been scraped off and the upper seal 6220 separates from the intermediate transfer body 70 in order to form a next toner image on the intermediate transfer body 70, toner scattered in the toner container 6205 flies out of the toner container 6205 from a gap a between the upper seal 6220 and the intermediate transfer body 70. At this time, if toner flying out of the toner container 6205 adheres to either of a light-emitting device 73*a* and a light-receiving device 73*b* of the patch sensor 73, the patch sensor 73 may malfunction in detection.

However, in the above-mentioned printer 10 according to the present embodiment, the patch sensor 73 (its light-emitting device 73*a* and light-receiving device 73*b*) is arranged outside the imaginary zone R sandwiched by the imaginary surface S and the flat surface T; the imaginary surface S being formed by extension of the upper seal 6220 separated from the intermediate transfer body 70 toward the upstream side of the rotating direction of the intermediate transfer body 70, and the flat surface T being perpendicular to a straight line passing through the upstream-side end portion 6220*b* of the upper seal 6220 and the closest point Q on the surface of the intermediate transfer body 70 to the upstream-side end portion 6220*b*. Therefore, there is less possibility that toner flying out of the toner container 6205 directly reaches the light-emitting device 73*a* and the light-receiving device 73*b* of the patch sensor 73. This enables to prevent toner flying out of the toner container 6205 from causing malfunction of the patch sensor 73 in detection.

Configuration of Image Forming System, etc.

Next, embodiments of an image forming system which is an example of an embodiment according to the present invention are described with reference to the drawings.

Figure 31:
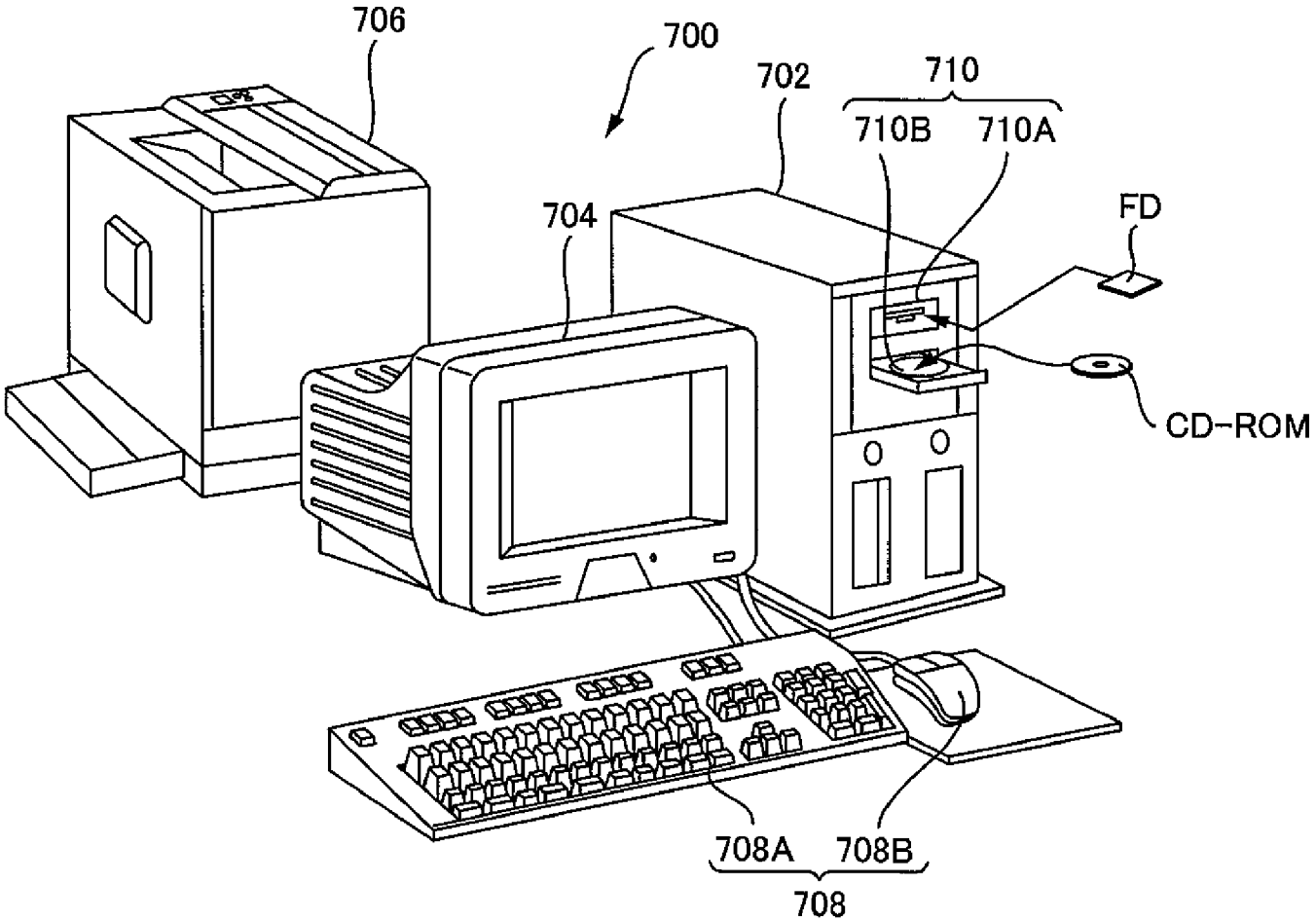
FIG. 31 is an explanatory diagram showing an external structure of an image forming system.

FIG. 31 is an explanatory diagram showing an external structure of an image forming system. An image forming system 700 includes a computer 702, a display device 704, a printer 706, input devices 708, and reading devices 710. In the present embodiment, the computer 702 is accommodated in a mini-tower type enclosure, but this invention is not limited thereto. A CRT (Cathode Ray Tube), a plasma display, or a liquid crystal display device, for example, is generally used as the display device 704, but this invention is not limited thereto. The printer described above is used as the printer 706. For the input devices 708 in the present embodiment, a keyboard 708A and a mouse 708B are used, but this invention is not limited thereto. For the reading devices 710 in the present embodiment, a flexible disk drive device 710A and a CD-ROM drive device 710B are used, but this invention is not limited thereto, and other devices such as an MO (Magneto Optical) disk drive device or a DVD (Digital Versatile Disk) may be used.

Figure 32:
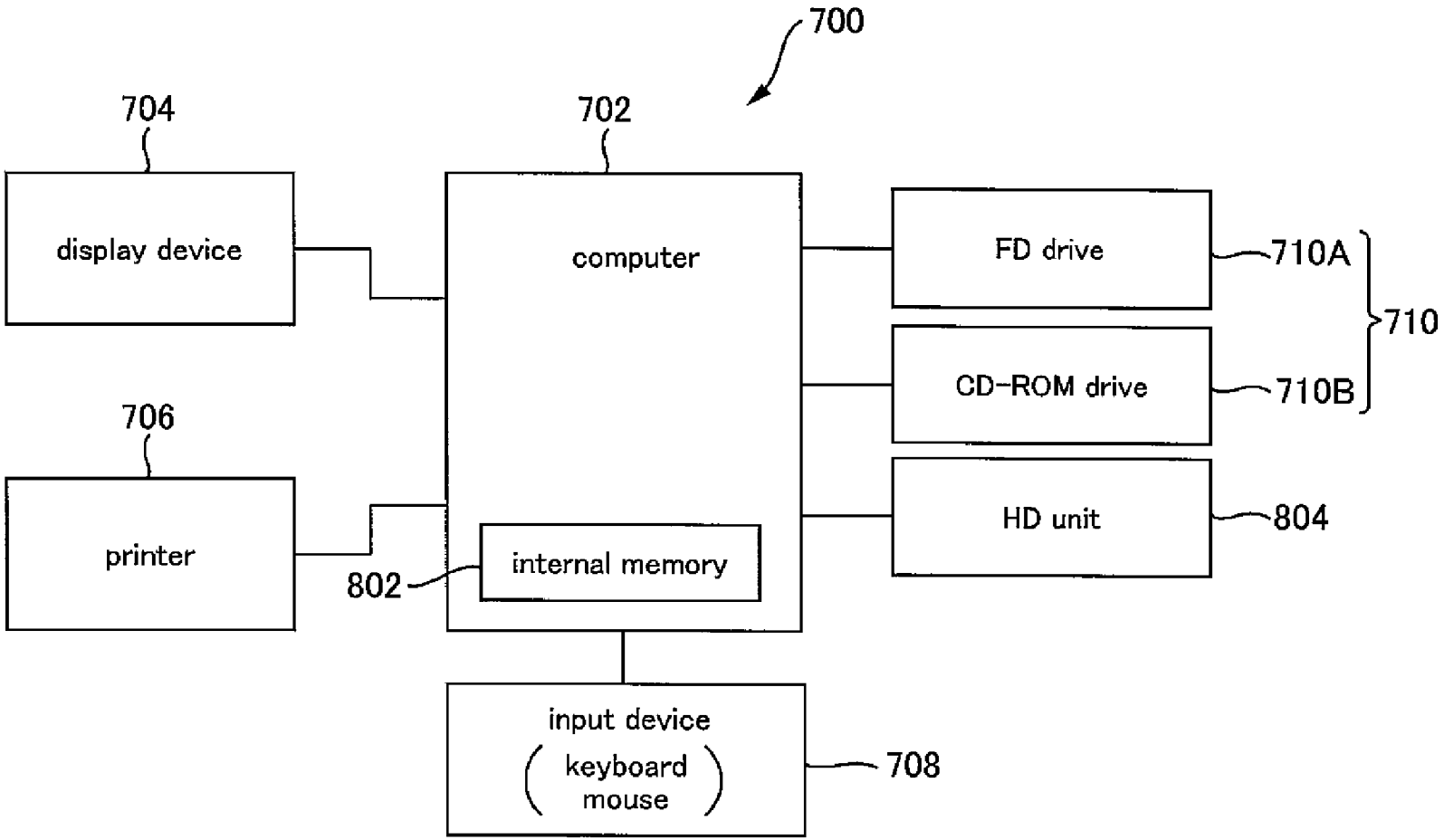
FIG. 32 is a block diagram showing a configuration of the image forming system shown in FIG. 31.

FIG. 32 is a block diagram showing a configuration of the image forming system shown in FIG. 31. Further provided are an internal memory 802 such as a RAM inside the enclosure accommodating the computer 702, and an external memory such as a hard disk drive unit 804.

Note that, in the above description, an example in which the image forming system is structured by connecting the printer 706 to the computer 702, to the display device 704, to the input devices 708 and to the reading devices 710 was described, but this invention is not limited thereto. For example, the image forming system can be configured by the computer 702 and the printer 706, and the image forming system does not have to be furnished with any of the display device 704, the input devices 708, and the reading devices 710.

Further, for example, the printer 706 can have some of the functions or mechanisms of the computer 702, the display device 704, the input devices 708, and the reading devices 710. As an example, the printer 706 can be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to heretofore systems.

What is claimed is:

1. An image forming apparatus, comprising:

a developer moving element that moves developer in order to transfer the developer onto a medium by rotating with the developer being borne on the developer moving element; and a collector for collecting the developer that has not been transferred onto the medium and remains on the developer moving element, the collector having a scraper blade that can abut against and separate from the developer moving element and that is for scraping off the developer on the developer moving element by abutting against the developer moving element, a sealing member that can contact with and separate from the developer moving element and that is for preventing, by contacting the developer moving element, the developer from spilling outside the collector, a ventilation opening for moving air in the collector outside the collector, and a valve for adjusting an amount of air passing through the ventilation opening, and the collector being made such that when either one of the scraper blade and the sealing member, whichever separates earlier from the developer moving element, starts separating therefrom, air can pass through the ventilation opening.

2. An image forming apparatus according to claim 1, wherein:

before either one of the scraper blade and the sealing member, whichever separates earlier from the developer moving element, starts separating therefrom, the valve opens the ventilation opening that is closed thereby.

3. An image forming apparatus according to claim 1, wherein:

when either one of the scraper blade and the sealing member, whichever separates earlier from the developer moving element, starts separating therefrom, the valve keeps the ventilation opening closed; and the valve is breathable.

4. An image forming apparatus according to claim 1, wherein:

the collector has a housing that forms the ventilation opening and that is furnished with a rib; and when either one of the scraper blade and the sealing member, whichever separates earlier from the developer moving element, starts separating therefrom, the valve does not keep the ventilation opening closed and contacts the rib.

5. An image forming apparatus, comprising:

a developer moving element that moves developer in order to transfer the developer onto a medium by rotating with the developer being borne on the developer moving element; and a collector for collecting the developer that has not been transferred onto the medium and remains on the developer moving element, the collector having a scraper blade that is for scraping off the developer on the developer moving element by abutting against the developer moving element and that moves between an abutting position and a non-abutting position, a sealing member that is for preventing, by contacting the developer moving element, the developer from spilling outside the collector and that moves between a contact position and a non-contact position, a ventilation opening for moving air in the collector outside the collector, and a valve for adjusting an amount of air passing through the ventilation opening, the volume of the collector changing depending on movement of the scraper blade and the sealing member; wherein the valve adjusts the amount such that the amount reaches a maximum when a change rate of the volume changing depending on the movement reaches a maximum.

6. An image forming apparatus according to claim 5, wherein:

the valve adjusts the amount such that the amount does not decrease when the change rate is increasing and such that the amount does not increase when the change rate is decreasing.

7. An image forming apparatus according to claim 5, wherein:

the collector has a seal supporting member that supports the sealing member and is movable together with the sealing member; and the valve is provided in the seal supporting member.

8. An image forming apparatus according to claim 7, wherein:

the sealing member moves in conjunction with movement of the scraper blade.

9. An image forming apparatus comprising:

a developer moving element that moves developer in order to transfer the developer onto a medium by rotating with the developer being borne on the developer moving element; and a collector that is for collecting the developer that has not been transferred onto the medium and remains on the developer moving element, and that has a containing chamber for containing the developer, a ventilation opening for moving air in the containing chamber outside the containing chamber, and an opposite wall located opposite the ventilation opening outside the ventilation opening, wherein:

the ventilation opening is a first ventilation opening;

the collector has a second ventilation opening for moving, outside the collector, air that moves outside the containing chamber passing through the first ventilation opening:

the collector includes a gathering chamber that is for gathering the developer that has moved outside the containing chamber passing through the first ventilation opening, and that is furnished with the opposite wall on a central portion of the gathering chamber in a longitudinal direction thereof and the second ventilation opening in an end portion of the gathering chamber in the longitudinal direction;

the containing chamber serves as a first containing chamber;

a second containing chamber different from the first containing chamber is provided;

the first containing chamber has a carrying member for carrying the developer contained in the first containing chamber to the second containing chamber; and a bottom section of the gathering chamber is in communication with the first containing chamber.

10. An image forming apparatus, comprising:

a developer moving element that moves developer in order to transfer the developer onto a medium by rotating with the developer being borne on the developer moving element; and a collector for collecting the developer that has not been transferred onto the medium and remains on the developer moving element, the collector having a ventilation opening for moving air in the collector outside the collector, a filter attached to the ventilation opening in order to prevent the developer in the collector from spilling outside the collector passing through the ventilation opening, an abutting/separating member that abuts against and separates from the developer moving element by moving, and a cleaning member that cleans the filter by moving, while keeping in contact with the filter, in conjunction with movement of the abutting/separating member.

11. An image forming apparatus according to claim 10, wherein:

the abutting/separating member is a sealing member for preventing, by abutting against the developer moving element, the developer from spilling outside the collector; and the sealing member is located opposite the ventilation opening.

12. An image forming apparatus according to claim 11, wherein:

the cleaning member adjusts an amount of air passing through the ventilation opening by moving in conjunction with movement of the sealing member.

13. An image forming apparatus according to claim 10, wherein:

the filter is flexible; and the volume of the collector is increased by bending of the filter when the cleaning member moves, while keeping in contact with the filter, in conjunction with movement of the abutting/separating member.

14. An image forming apparatus, comprising:

a developer moving element that moves developer in order to transfer the developer onto a medium by rotating in a predetermined rotating direction with the developer being borne on the developer moving element; and a collector for collecting the developer that has not been transferred onto the medium and remains on the developer moving element, the collector having a scraper blade that is for scraping off the developer on the developer moving element by abutting against the developer moving element at an abutting section, and that moves between an abutting position and a non-abutting position, and a sealing member that is for preventing the developer from spilling outside the collector by contacting the developer moving element at a contacting section located on the upstream side in the rotating direction than the abutting section, and that moves between a contact position and a non-contact position;

wherein, after the sealing member located at the contact position starts moving to the non-contact position, the scraper blade located at the abutting position starts moving to the non-abutting position.

15. An image forming apparatus, comprising:

a developer moving element that moves developer in order to transfer the developer onto a medium by rotating with the developer being borne on the developer moving element; and a collector for collecting the developer that has not been transferred onto the medium and remains on the developer moving element, the collector having a scraper blade that is for scraping off the developer on the developer moving element by abutting against the developer moving element at an abutting section, and that moves between an abutting position and a non-abutting position, and a sealing member that is located above the scraper blade in the vertical direction and is for preventing the developer from spilling outside the collector by contacting the developer moving element at a contacting section, and that moves between a contact position and a non-contact position;

wherein, during a period from when the sealing member located at the contact position starts moving to the non-contact position to when the sealing member finishes moving to the non-contact position, an extended imaginary line of the sealing member extended therefrom in a lateral direction thereof passes through between the developer moving element and a front-end portion of the scraper blade.

16. An image forming apparatus, comprising:

a developer moving element that moves developer in order to transfer the developer onto a medium by rotating with the developer being borne on the developer moving element; and a collector for collecting the developer that has not been transferred onto the medium and remains on the developer moving element, the collector having a first contacting member that is provided on the upstream side of a rotating direction in the developer moving element and contacts the developer moving element, and that moves between a first contact position and a first non-contact position, and a second contacting member that is provided on the downstream side in the rotating direction of the developer moving element and contacts the developer moving element, and that moves between a second contact position and a second non-contact position;

wherein, during a period from when at least one of the first contacting member located at the first contact position and the second contacting member located at the second contact position starts moving to either of the first non-contact position and the second non-contact position to when the first contacting member and the second contacting member finish moving to the first non-contact position and the second non-contact position respectively, the developer moving element is located on an imaginary line joining one end portion, among both end portions of the first contacting member in a lateral direction thereof, that is closer to the second contacting member, and one end portion, among both end portions of the second contacting member in a lateral direction there of, that is closer to the first contacting member.

* * * * *